US010031473B2

(12) United States Patent
Nakama et al.

(10) Patent No.: US 10,031,473 B2
(45) Date of Patent: Jul. 24, 2018

(54) IMAGE FORMING APPARATUS AND IMAGE FORMING SYSTEM HAVING A CONTROLLER THAT CONTROLS A RUBBING TREATMENT FOR A FIXING ROLLER OF A REPLACEABLE FIXING PORTION

(71) Applicant: CANON KABUSHIKI KAISHA, Tokyo (JP)

(72) Inventors: Katsuya Nakama, Nagareyama (JP); Satoru Yamamoto, Noda (JP); Masahiro Tsujibayashi, Nagareyama (JP); Yasuharu Chiyoda, Nagareyama (JP); Nobuhiro Kikuchi, Moriya (JP); Akinobu Nishikata, Abiko (JP); Akihiro Kawakita, Abiko (JP); Toshiyuki Miyake, Abiko (JP); Koji Yumoto, Toride (JP); Riki Fukuhara, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/218,181

(22) Filed: Jul. 25, 2016

(65) Prior Publication Data

US 2017/0031307 A1 Feb. 2, 2017

(30) Foreign Application Priority Data

Jul. 30, 2015 (JP) ..... 2015-151202
Jul. 30, 2015 (JP) ..... 2015-151203
Jul. 30, 2015 (JP) ..... 2015-151204

(51) Int. Cl.
*G03G 21/16* (2006.01)
*G03G 15/20* (2006.01)
*G03G 15/00* (2006.01)

(52) U.S. Cl.
CPC ..... *G03G 21/1685* (2013.01); *G03G 15/2025* (2013.01); *G03G 15/553* (2013.01)

(58) Field of Classification Search
CPC ..... G03G 21/1685; G03G 15/2025; G03G 15/553

(Continued)

(56) References Cited

U.S. PATENT DOCUMENTS 7,460,821 B2 12/2008 Ai et al.
9,075,355 B2 7/2015 Chiyoda et al.

(Continued)

FOREIGN PATENT DOCUMENTS

JP 2008040364 A 2/2008
JP 2011056945 A 3/2011

(Continued)

OTHER PUBLICATIONS

U.S. Appl. No. 15/227,431, filed Aug. 3, 2016.

(Continued)

*Primary Examiner* — Billy Lactaoen
(74) *Attorney, Agent, or Firm* — Fitzpatrick, Cella, Harper & Scinto

(57) ABSTRACT

An image forming apparatus has an image forming station, a mounting portion, and a fixing portion that includes a first rotatable member, a second rotatable member, a rubbing rotatable member configured to rub a surface of the first rotatable member during a rubbing treatment, and a storing portion capable of storing number information. A number of recording materials fed to the fixing portion is counted, written into the storing portion, and used to determine whether to execute the rubbing treatment. In a case in which, in sequence, the recording material is fed to the mounted fixing portion, the mounted fixing portion is removed and replaced with another fixing portion, and the removed fixing (Continued)

portion is remounted, both number information acquired from the storing portion and the number of recording materials fed to the remounted fixing portion are used to determine whether to execute the rubbing treatment.

32 Claims, 32 Drawing Sheets

(58) Field of Classification Search
USPC ..... 399/43
See application file for complete search history.

(56) References Cited

U.S. PATENT DOCUMENTS

| | | | | |
|---|---|---|---|---|
| 9,261,825 | B2 | 2/2016 | Chiyoda | |
| 9,298,140 | B2 | 3/2016 | Moteki et al. | |
| 2005/0185978 | A1* | 8/2005 | Kemmochi | G03G 15/2017 399/69 |
| 2009/0297233 | A1* | 12/2009 | Kameda | G03G 15/5029 399/322 |
| 2011/0058201 | A1 | 3/2011 | Mueller | |
| 2011/0129253 | A1 | 6/2011 | Takahashi et al. | |
| 2011/0157641 | A1 | 6/2011 | Furukawa | |
| 2013/0100467 | A1* | 4/2013 | Miyazaki | H04N 1/00015 358/1.9 |
| 2015/0016831 | A1 | 1/2015 | Chiyoda | |
| 2016/0170345 | A1 | 6/2016 | Moteki et al. | |
| 2016/0170346 | A1 | 6/2016 | Moteki et al. | |

FOREIGN PATENT DOCUMENTS

| | | | |
|---|---|---|---|
| JP | 2011-069951 | A | 4/2011 |
| RU | 2012150864 | A | 6/2014 |

OTHER PUBLICATIONS

European Search Report issued in corresponding European Application No. 16180711.0, dated Mar. 29, 2017.
Notice of Allowance dated Jan. 19, 2018, in co-pending Russian Patent Application No. 2016131018/08.
European Office Action dated Feb. 9, 2018, issued in corresponding European Application No. 16180711.0.

* cited by examiner

| | STORED |
|---|---|
| NUMBER (WIDTH ~ 140) | 100 |
| NUMBER (WIDTH ~ 145) | 12 |
| NUMBER (WIDTH ~ 150) | 200 |
| NUMBER (WIDTH ~ 155) | 250 |
| NUMBER (WIDTH ~ 160) | 300 |
| NUMBER (WIDTH ~ 165) | 120 |
| ... | ... |
| NUMBER (WIDTH ~ 300) | 22 |
| NUMBER (WIDTH ~ 305) | 300 |
| NUMBER (WIDTH ~ 310) | 321 |
| NUMBER (WIDTH ~ 315) | 200 |
| NUMBER (WIDTH ~ 320) | 0 |
| NUMBER (WIDTH ~ 325) | 130 |
| NUMBER (WIDTH ~ 330) | 450 |

Fig. 10

STORED

| FIXING DEVICE ID | A(RESISTANCE R1) | B(RESISTANCE R1) |
|---|---|---|
| NUMBER (WIDTH ~ 140) | 100 | 300 |
| NUMBER (WIDTH ~ 145) | 12 | 12 |
| NUMBER (WIDTH ~ 150) | 200 | 154 |
| NUMBER (WIDTH ~ 155) | 250 | 250 |
| NUMBER (WIDTH ~ 160) | 300 | 300 |
| NUMBER (WIDTH ~ 165) | 120 | 120 |
| ... | ... | ... |
| NUMBER (WIDTH ~ 300) | 22 | 22 |
| NUMBER (WIDTH ~ 305) | 300 | 300 |
| NUMBER (WIDTH ~ 310) | 321 | 200 |
| NUMBER (WIDTH ~ 315) | 200 | 200 |
| NUMBER (WIDTH ~ 320) | 0 | 0 |
| NUMBER (WIDTH ~ 325) | 130 | 130 |
| NUMBER (WIDTH ~ 330) | 450 | 450 |

Fig. 19

(a)

STORED

| FIXING DEVICE ID | DEVICE A | DEVICE B |
|---|---|---|
| NUMBER (WIDTH ~ 140) | 100 | 300 |
| NUMBER (WIDTH ~ 145) | 12 | 12 |
| NUMBER (WIDTH ~ 150) | 200 | 154 |
| NUMBER (WIDTH ~ 155) | 250 | 250 |
| NUMBER (WIDTH ~ 160) | 300 | 300 |
| NUMBER (WIDTH ~ 165) | 120 | 120 |
| ... | ... | ... |
| NUMBER (WIDTH ~ 300) | 22 | 22 |
| NUMBER (WIDTH ~ 305) | 300 | 300 |
| NUMBER (WIDTH ~ 310) | 321 | 200 |
| NUMBER (WIDTH ~ 315) | 200 | 200 |
| NUMBER (WIDTH ~ 320) | 0 | 0 |
| NUMBER (WIDTH ~ 325) | 130 | 130 |
| NUMBER (WIDTH ~ 330) | 450 | 450 |
| TIME INFORMATION | 2014/12/30 12:00:00 | 2014/12/31 18:30:00 |

(b)

STORED

| FIXING DEVICE ID | DEVICE A |
|---|---|
| NUMBER (WIDTH ~ 140) | 100 |
| NUMBER (WIDTH ~ 145) | 30 |
| NUMBER (WIDTH ~ 150) | 200 |
| NUMBER (WIDTH ~ 155) | 400 |
| NUMBER (WIDTH ~ 160) | 300 |
| NUMBER (WIDTH ~ 165) | 120 |
| ... | ... |
| NUMBER (WIDTH ~ 300) | 22 |
| NUMBER (WIDTH ~ 305) | 300 |
| NUMBER (WIDTH ~ 310) | 321 |
| NUMBER (WIDTH ~ 315) | 200 |
| NUMBER (WIDTH ~ 320) | 0 |
| NUMBER (WIDTH ~ 325) | 130 |
| NUMBER (WIDTH ~ 330) | 450 |
| TIME INFORMATION | 2015/01/01 21:00:00 |

Fig. 28

IMAGE FORMING APPARATUS AND IMAGE FORMING SYSTEM HAVING A CONTROLLER THAT CONTROLS A RUBBING TREATMENT FOR A FIXING ROLLER OF A REPLACEABLE FIXING PORTION

FIELD OF THE INVENTION AND RELATED ART

The present invention relates to an electrophotographic type image forming apparatus and an electrophotographic type image forming system.

The electrophotographic type image forming apparatus comprises a fixing device (fixing portion) for fixing the toner image on a recording material. It is known to replace the fixing device depending on the size and/or kind of the recording material for the purpose of high quality prints. Japanese Laid-open Patent Application 2011-56945, for example, proposes that identifying information of the fixing device is detected, and when the fixing device is not proper for the requirements of the printing job to be performed, the user is notified of the fact.

On the other hand, when an unfixed toner image is fixed in a fixing device, a widthwise edge of the recording material (an edge at an end portion of the recording material with respect to a direction perpendicular to a feeding direction of the recording material) contacts a rotatable member with the result of fine scores of the surface of the fixing member. When such damage occurs on the same position of the fixing member, the surface property of the fixing member at the portion becomes coarse as compared with the other portion of the fixing member, and there is a liability that the unevenness in glossiness appears on the image of the recording material having been subjected to the fixing process. Therefore, it is known that the surface of the fixing member is rubbed by a rubbing rotatable member (fixing refresh operation) each time that a predetermined number of the recording materials is processed by the fixing member, by which the surface property of the fixing member is uniformized (Japanese Laid-open Patent Application 2008-40364).

However, when a system is employed in which a plurality of fixing devices are exchanged and used for the image fixing operation, the counting of the processed recording materials may not be proper for the fixing refresh operation, and the fixing refresh operation may not be carried out at proper timing. As a result, the glossiness non-uniformity of the output image may not be avoidable.

SUMMARY OF THE INVENTION

It is an object of the present invention to provide an image forming apparatus, an image forming system and a fixing device, with which the image quality is maintained even in the case that the fixing device is replaceable.

According to an aspect of the present invention, there is provided an image forming apparatus comprising an image forming station configured to form an unfixed toner image on a recording material; a mounting portion configured to mount one of a plurality of fixing devices each including a first rotatable member and a second rotatable member which cooperate with each other to form a nip for fixing the unfixed toner image on the recording material fed from said image forming station, a rubbing rotatable member configured to rub a surface of said first rotatable member, and a storing portion capable of storing information; a counter configured to count recording materials fed to said fixing device mounted on said mounting portion and to store number information indicative of the number counted by said counter in said storing portion of said fixing device mounted on said mounting portion; and an executing portion configured to execute a rubbing treatment of a rubbing rotatable member to said first rotatable member of the fixing device mounted on said mounting portion, when the number counted by said counter on the basis of the number information acquired from said storing portion of said fixing device mounted on said mounting portion exceeds a predetermined number.

According to another aspect of the present invention, there is provided an image forming system comprising an image forming apparatus including an image forming station configured to form an unfixed toner image on a recording material; a mounting portion configured to mount one of a plurality of fixing devices each including a first rotatable member and a second rotatable member which cooperate with each other to form a nip for fixing the unfixed toner image on the recording material fed from said image forming station, a rubbing rotatable member configured to rub a surface of said first rotatable member, and a discrimination portion indicative of identifying information for discriminating said fixing device from another fixing device; and a counter configured to count the recording materials fed to said fixing device mounted on said mounting portion; and a storing device configured to store number information indicative of the number counted by said counter, in correlation with the identifying information, wherein said counter counts the recording materials fed to said fixing device mounted on said mounting portion, on the basis of the number information stored in said storing device in correlation with the identifying information of said fixing device mounted on said mounting portion, and wherein said image forming apparatus executes a rubbing treatment of a rubbing rotatable member to said first rotatable member of the fixing device mounted on said mounting portion, when the number counted by said counter exceeds a predetermined number.

According to a further aspect of the present invention, there is provided an image forming apparatus comprising an image forming station configured to form an unfixed toner image on a recording material; a mounting portion configured to mount one of fixing devices each including a first rotatable member and a second rotatable member which cooperate with each other to form a nip for fixing the unfixed toner image on the recording material fed from said image forming station, a discrimination portion indicative of identifying information for discriminating said fixing device from another fixing device mountable on said mounting portion in place of said fixing device mounted on said mounting portion, a rubbing rotatable member configured to rub a surface of said first rotatable member, and a fixing device storing portion capable of storing information; a counter configured to count the recording materials fed to said fixing portion mounted on said mounting portion; a main assembly storing portion capable of storing information; a writing portion configured to write the number information indicative of the number counted by said counter in said main assembly storing portion in correlation with the identifying information and to write the number information in said fixing device storing portion; and an executing portion configured to execute a rubbing treatment of a rubbing rotatable member to said first rotatable member of the fixing device mounted on said mounting portion, when the number counted by said counter on the basis of the information acquired from said fixing storing portion and said main assembly storing portion exceeds a predetermined number.

Further features of the present invention will become apparent from the following description of exemplary embodiments with reference to the attached drawings.

BRIEF DESCRIPTION OF THE DRAWINGS

FIG. 10 illustrates an example of information stored in a memory of a fixing device.

FIG. 19 illustrates an example of information stored in the main assembly memory.

Part (a) of FIG. 28 illustrates an example of information stored in the main assembly memory, and part (b) illustrates an example of information stored in the memory of the fixing device.

Figure 29:
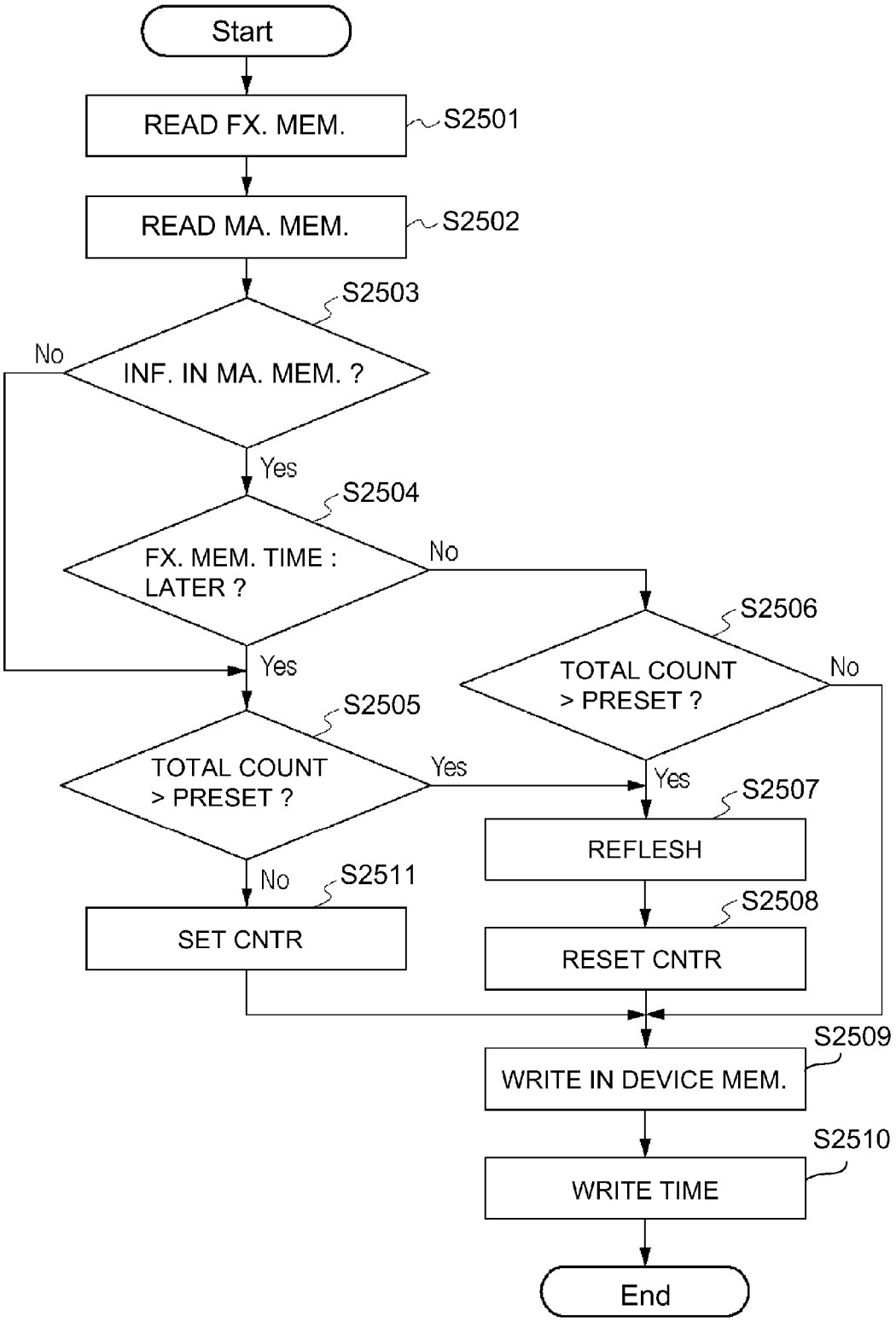

FIG. 29 is a flow chart of a refreshing sequence.

Figure 30:
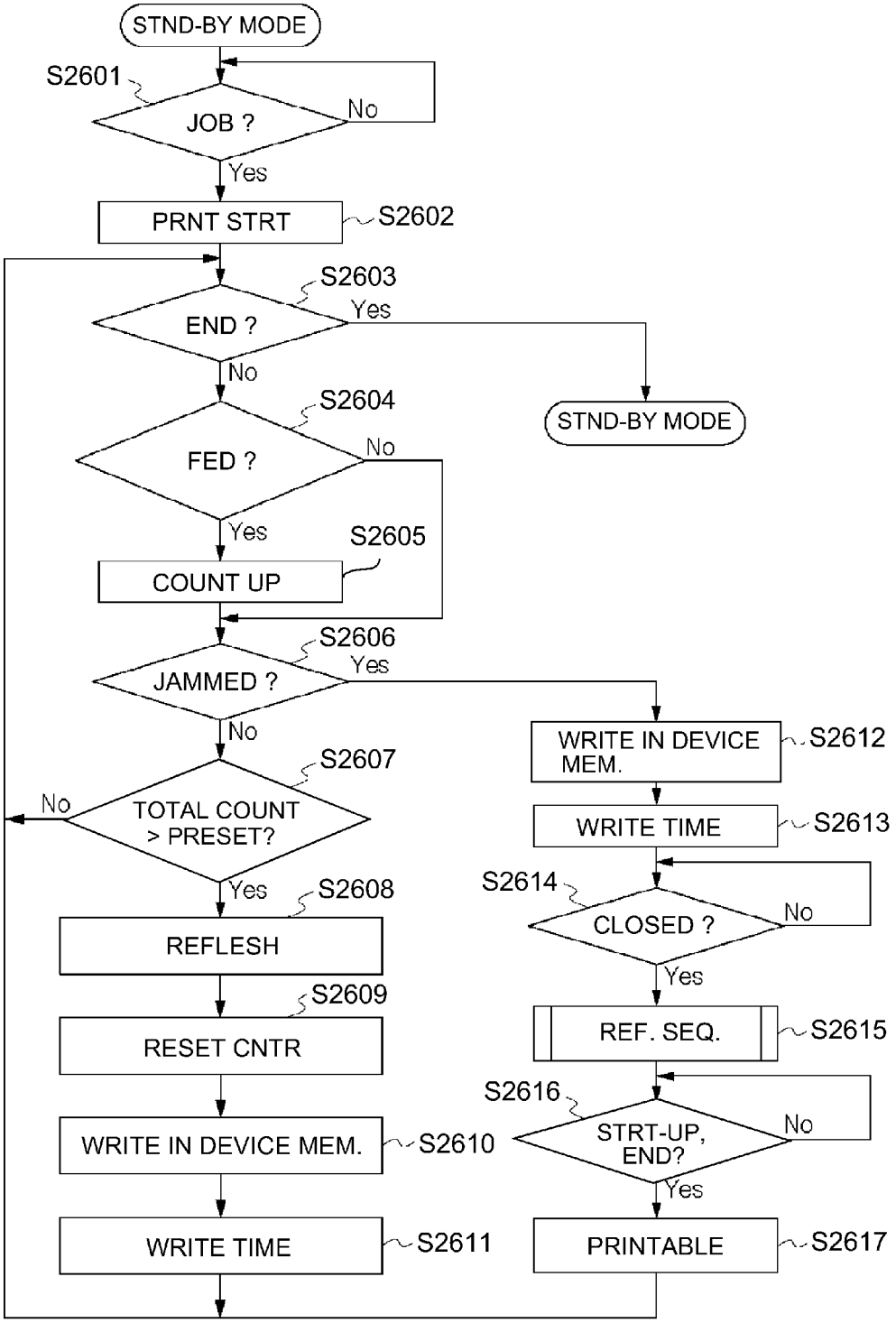

FIG. 30 is a flow chart of counting of the recording materials.

Figure 31:
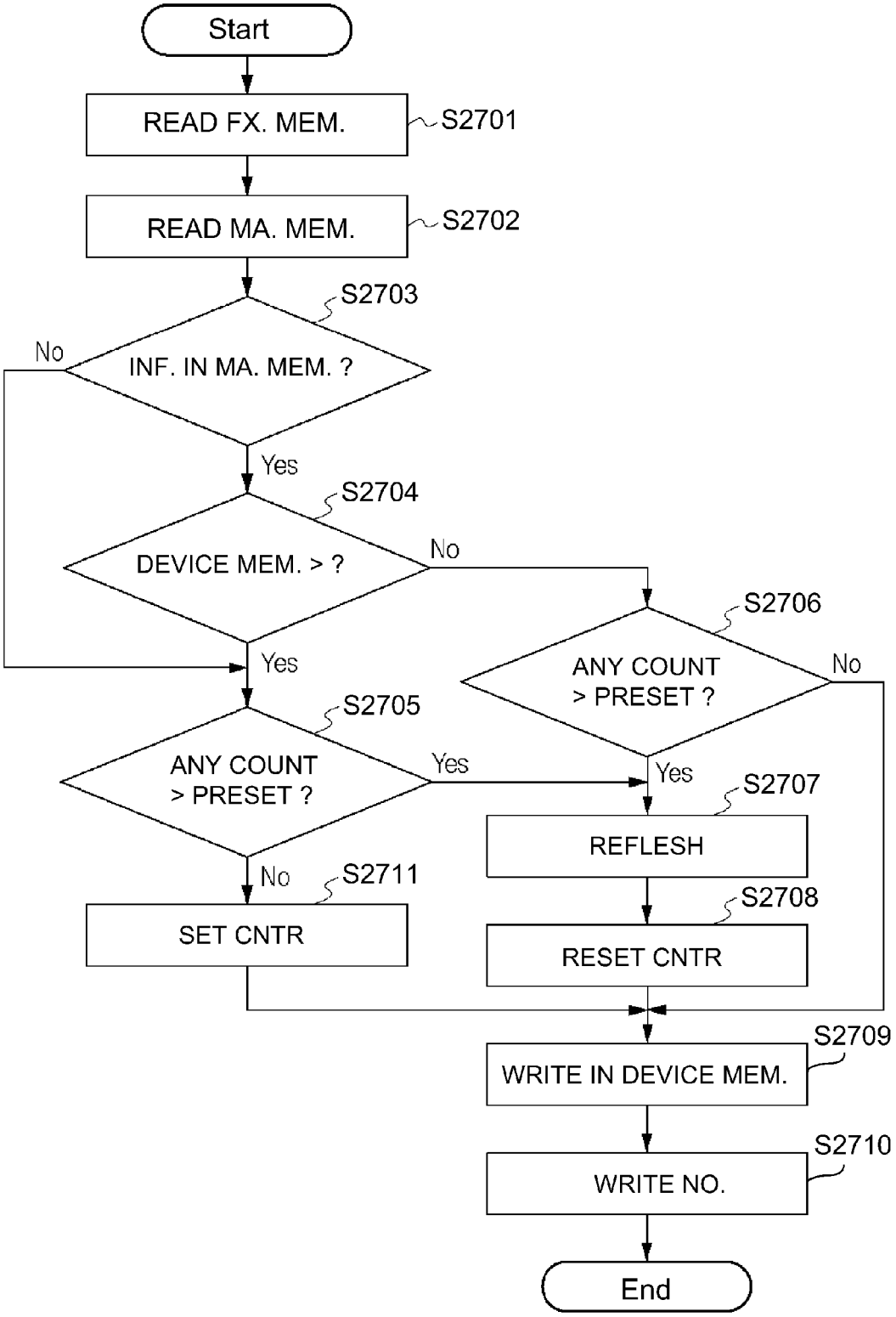

FIG. 31 is a flow chart of a refreshing sequence.

Figure 32:
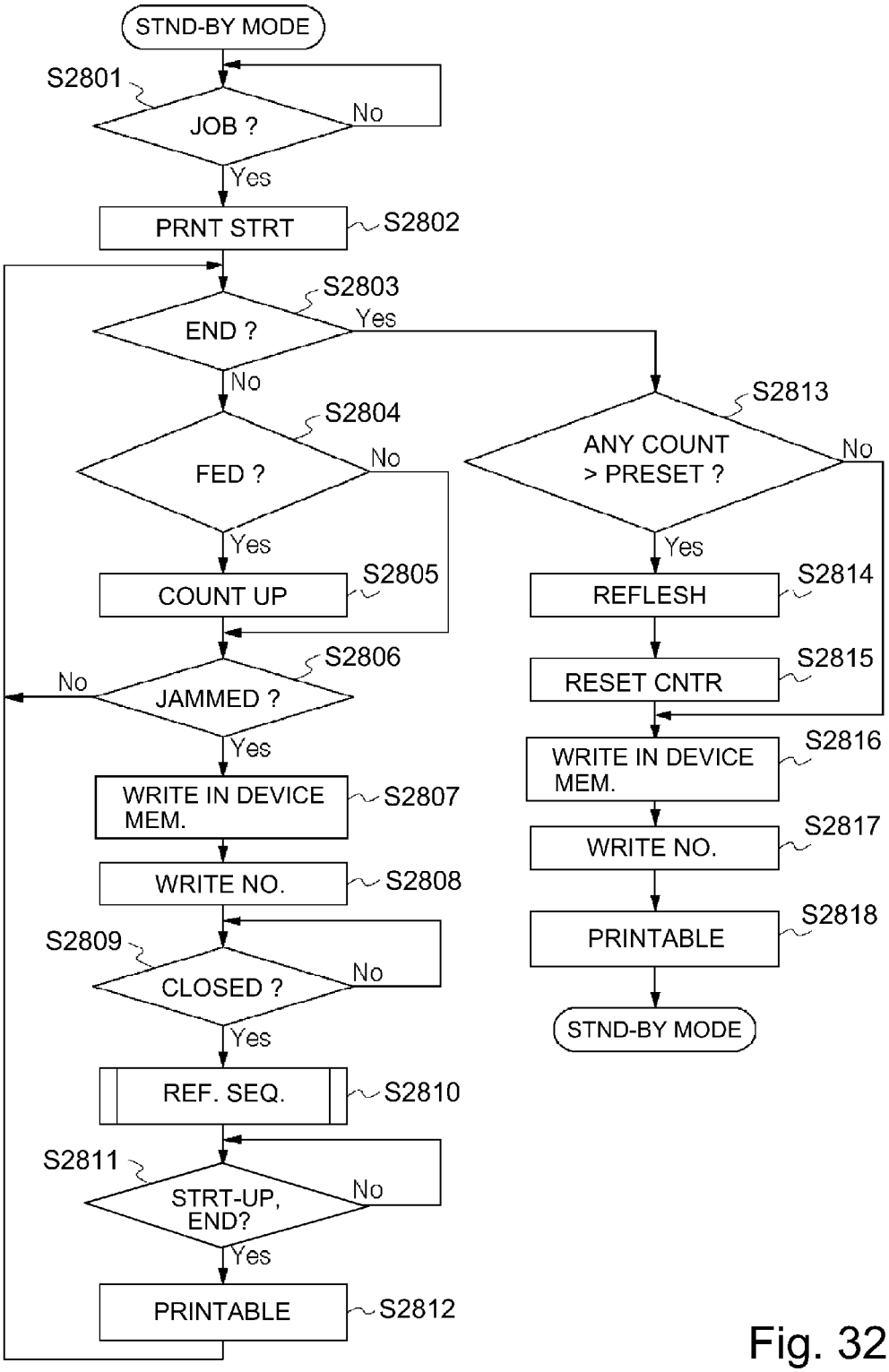

FIG. 32 is a flow chart of counting of the recording materials.

DESCRIPTION OF THE EMBODIMENTS

The preferred embodiments of the present invention will be described in conjunction with the accompanying drawings. The structures of the embodiments are examples, to which the present invention is not limited.

Embodiment 1

(1. General Arrangement of Image Forming Apparatus)

Figure 1:
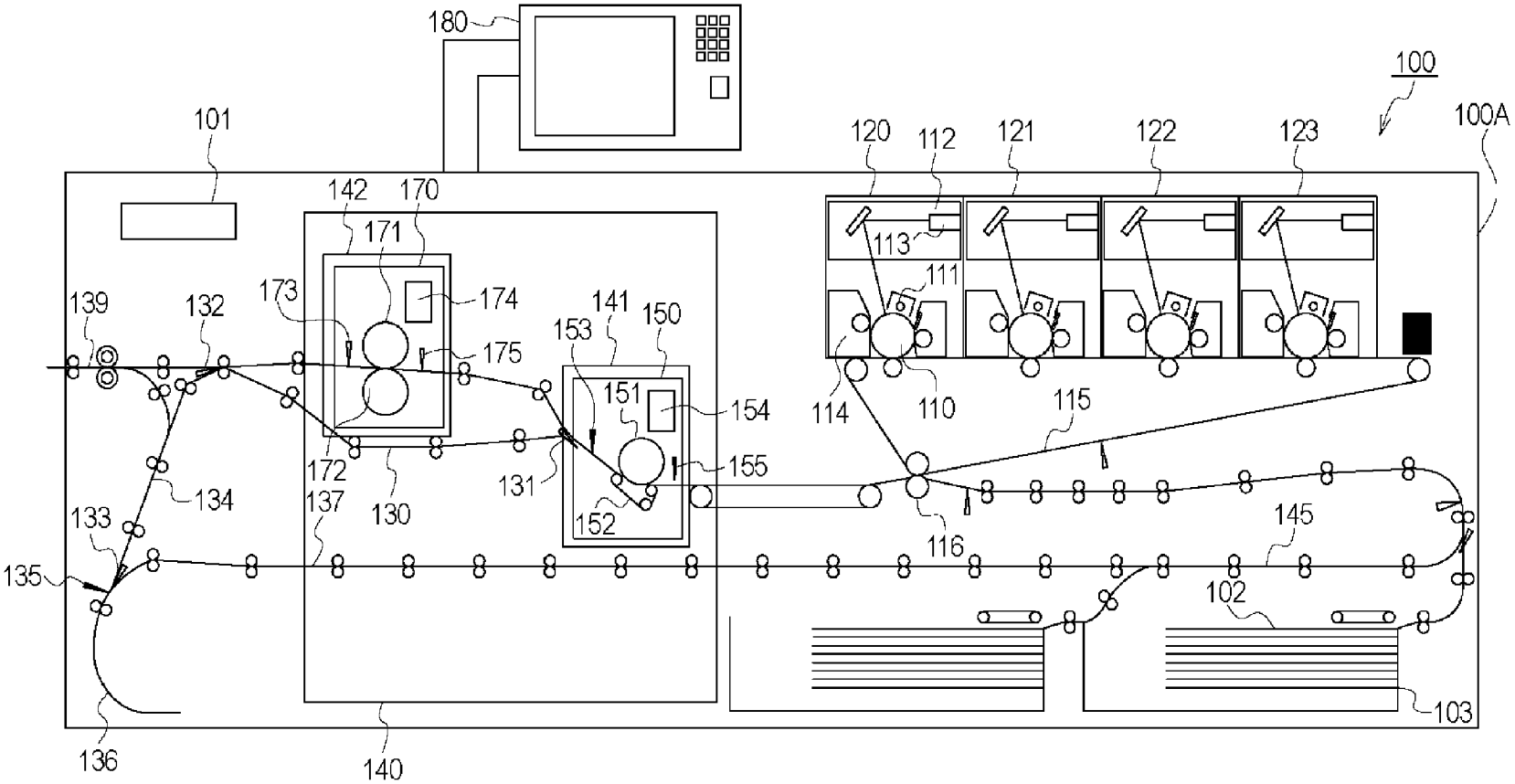
FIG. 1 is a sectional view of an example of an image forming apparatus.

FIG. 1 is a sectional view of an example of an image forming apparatus.

The general arrangement of the image forming apparatus 100 will be described.

The image forming apparatus 100 feeds a recording material 102 from a recording material accommodating portion 103 into an image forming station 309 (FIG. 2) to form a toner image on the recording material 102. The details of the image forming station 309 will be described hereinafter.

Thereafter, the image forming apparatus 100 feeds the recording material 102 carrying the formed toner image to a fixing portion (first fixing device 150 and second fixing device 170), where the toner image is fixed on the recording material 102 by heat and pressure. The details of the fixing portion will be described hereinafter.

In the case of a one-side printing operation, the recording material 102 having the fixed image is guided into the discharging path 139 by a flapper 132 and is discharged to an outside of the image forming apparatus 100.

On the other hand, in the case of a two-side printing operation, the image forming apparatus 100 reverses the recording material 102 already having the image on one side and refeeds it into the image forming station 309. More particularly, the flapper 132 guides the recording material 102 having departed the fixing device into a feeding path 134 and then into a reversing portion 136. When a reversion sensor 135 detects a trailing edge of the recording material 102, a flapper 133 switches the recording material feeding direction to a feeding path 137. The image forming apparatus 100 refeeds the reversed recording material 102 into the image forming station 309 and the fixing portion through the feeding path 137.

The recording material 102 having been subjected to the image forming operations and the respective sides is fed by the flapper 132 into the discharging path 139, and then is discharged to the outside of the image forming apparatus 100.

The flapper 132 is a switching member for switching the feeding of the recording material 102 having passed through the image forming station 309 and the fixing portion between the feeding path 134 and the outside of the image forming apparatus 100.

The recording material 102 may be paper, OHP sheet, or the like, on which the image is to be formed by the image forming apparatus 100.

An operating portion 180 functioning as a notifying portion, a selector, a setting portion and/or a receiving portion, and is provided with a display screen and a selection key. The operating portion 180 displays the status of the image forming apparatus 100 on the display screen, and receives the instructions from the operator by the selection keys. Examples of the operation include setting of a kind of recording material (surface property, basis weight, size or the like), setting of the number of the prints, setting of the single-sided printing or double-sided printing, or the like.

The main switch 101 is a starting switch for actuating the image forming apparatus 100.

The front door 140 as an opening and closing portion is provided for the opening of the main assembly of the image forming apparatus 100 for mounting a fixing device (first fixing device 150, second fixing device 170) to a mounting portion (first mounting portion 141, second mounting portion 142).

The image forming apparatus 100 is provided with an opening and closing sensor (optical sensor) 305 (FIG. 2) as a sensor for sensing a closed state of the front door 140. The opening and closing sensor 305 and a CPU 301 (FIG. 2) function as an opening and closing detecting portion. The front door 140 is provided with a projection (unshown), which is inserted into a receiving portion (unshown) of the main assembly 100A of the image forming apparatus 100 by the closing of the front door 140. The CPU 301 detects the closing of the front door 140 on the basis of a signal produced by the opening and closing sensor 305 upon the insertion of the projection into the receiving portion. On the other hand, when no output signal is produced by the opening and closing sensor 305, the CPU 301 detects that the front door 140 is open. In an alternative structure, the CPU 301 detects the opening of the front door 140 on the basis of the signal produced by the opening and closing sensor 305 upon the opening of the front door 140, and the CPU 301 detects that the front door 140 is closed when the signal from the sensor 305 is not detected.

(2. Structure of Control System)

Figure 2:
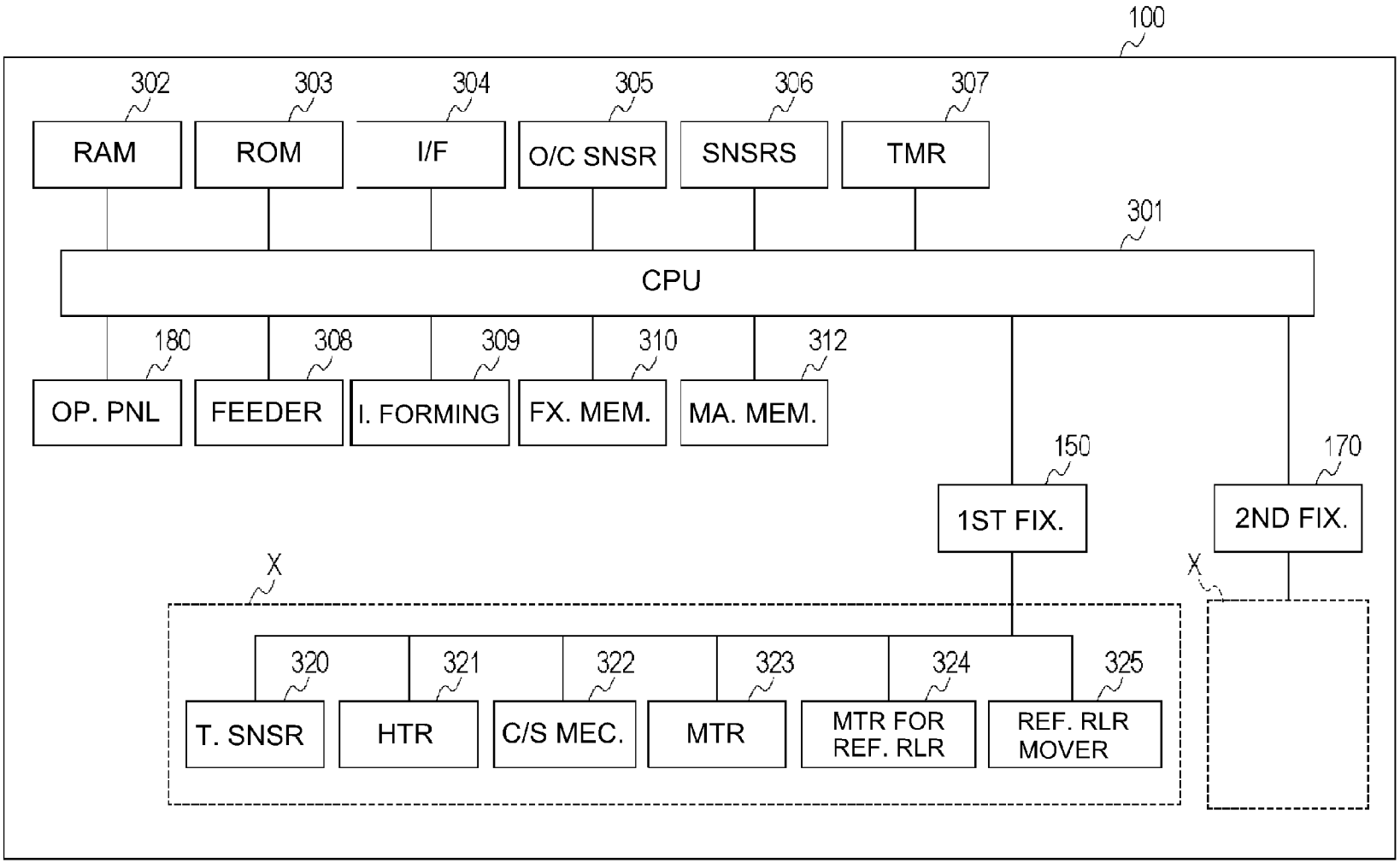
FIG. 2 is a block diagram of a control system.

FIG. 2 is a block diagram of a control system.

The image forming apparatus 100 (FIG. 1) is provided with the CPU 301, a RAM 302, and a ROM 303 for controlling the operation of the image forming apparatus 100.

The CPU 301 functioning as a controller carries out a basic control of the image forming apparatus 100 by executing control programs stored in the ROM 303. The CPU 301 uses the RAM 302 as a work area for executing the processing of a control program.

The CPU 301 is electrically connected with the RAM 302 and the ROM 303, and various mechanisms to be controlled.

In addition, the CPU 301 functions also as a counter for counting the recording materials 102 fed into the first fixing device 150 or second fixing device 170. The specific structure will be described hereinafter.

An external I/F portion 304 is a communication circuit for communication with an external device connected through a network (LAN and/or WAN). The external device may include a PC or another image forming apparatus or the like.

The CPU 301 is connected with the opening and closing sensor 305 to detect whether or not the front door 140 is closed.

A sensor group 306, including sensors 153, 155, 173, and 175, shown in FIG. 1, is disposed along the feeding path, by which the CPU 301 detects the presence, absence, and passing of the recording material 102.

In addition, the CPU 301 is connected with the operating portion 180. The CPU 301 receives the instructions of switching of the display content on the display screen and other operations, given by the operator at the selection keys of the operating portion 180. The CPU 301 displays, on the display screen of the operating portion 180, the status of operation of the image forming apparatus 100, an operation mode selected by the selection key, and so on.

The CPU 301 is connected with a timer 307. The timer 307 functions as a clock portion for measuring a time period. As will be described hereinafter, it counts the time for detection of a jammed sheet, and/or for a fixing element refreshing operation (fixing roller refreshing operation).

The CPU 301 is connected with a feeding portion 308 to control feeding of the recording material 102. The feeding portion 308 includes a supply portion for feeding the recording material 102 from the recording material accommodating portion 103 to the feeding path, feeding rollers for feeding the recording material 102 on the feeding path, and flappers (flappers 131, 132, 133, in FIG. 1) for the feeding paths.

In addition, the CPU 301 is connected with the image forming station 309, which will be described hereinafter, to control the image forming station 309.

The memory 310 of the fixing device includes the memory 154 of the first fixing device 150 mounted in the image forming apparatus 100, and a memory 174 of the second fixing device 170 mounted to the image forming apparatus 100. The CPU 301 is connected with the memories 154, 174 of the first fixing device 150 and the second fixing device 170 mounted in the image forming apparatus 100 and writes in and reads out of the memories 154, 174.

The CPU 301 is connected with a main assembly memory 312. The main assembly memory 312 is rewritable, nonvolatile memory, and may be integral with the RAM 302.

The CPU 301 is connected with a mechanism group X of the first fixing device 150 mounted in the image forming apparatus 100 to effect a temperature adjustment control and fixing element refreshing operation. The mechanism group X includes a temperature sensor 320, a heater 321, a moving mechanism 322, a motor 323, and a refreshing roller moving mechanism 325.

The temperature sensor 320 includes a plurality of temperature sensors provided in the first fixing device 150, including a thermister 159 (FIG. 3), and a thermister (unshown) for a pressing belt 152.

The heater 321 includes a plurality of heaters provided in the first fixing device 150, including a halogen heater 161 (FIG. 3), and a halogen heater (unshown) provided in a heating roller 163.

The CPU 301 is connected with a mechanism group X of the second fixing device 170 mounted in the image forming apparatus 100 to effect temperature adjustment control and the fixing element refreshing operation. The mechanism group X for the second fixing device 170 is substantially the same as the mechanism group X of the first fixing device 150, and therefore, the detailed description thereof is omitted by applying the same reference numerals to the corresponding elements. (In the description of the mechanism group X for the first fixing device 150, the first fixing device 150, the pressing belt 152, and the heating roller 163 correspond to the second fixing device 170, the pressing roller 172, and the pressing roller 172, respectively).

In this embodiment, the mechanisms are controlled by the CPU 301. Alternatively, however, CPU circuit portions can be used for controlling the respective mechanisms, along with a main CPU circuit portion connected with the respective CPU circuit portions to effect the overall control.

(3. Image Forming Station)

The image forming apparatus 100 comprises stations 120, 121, 122 and 123 as the image forming station 309 (FIG. 2), an intermediary transfer belt 115 as an intermediary transfer member, and a transfer roller 116 as a transfer portion.

The stations 120, 121, 122, 123 form yellow, magenta, cyan and black toner images, respectively, and transfer the toner images onto the intermediary transfer belt 115.

The structure of the station 120 will be described. A photosensitive drum 110 as the image bearing member is rotatable in the counterclockwise the direction in FIG. 1. A primary charger 111 as a charge portion uniformly charges the surface of the photosensitive drum 110. A laser unit 112 as an exposing portion includes a light source 113 for producing a laser beam to form an electrostatic latent image on the photosensitive drum 110 in accordance with an original image. A developing device 114 as a developing portion develops the electrostatic latent image formed on the photosensitive drum 110, using toner, into a toner image. The structures of the stations 121, 122, 123 are the same as that of the station 120, and therefore, the description is omitted for the sake of simplicity.

The toner images formed by the stations 120, 121, 122, 123 are transferred onto the intermediary transfer belt 115. The transfer roller 116 transfers the toner images superimposed on the intermediary transfer belt 115 onto the recording material 102 fed from the recording material accommodating portion 103.

(4. Fixing Portion)

(4.1. Tandem Fixing)

The first fixing device 150 and the second fixing device 170, as the fixing portions, fix the toner image transferred onto the recording material 102 by applying heat and pressure to the recording material 102.

The second fixing device 170 is disposed downstream of the first fixing device 150 with respect to the feeding direction of the recording material 102. The second fixing device 170 functions to provide the toner image fixed on the recording material 102 by the first fixing device 150 with glossiness and/or to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130 bypassing the second fixing device 170, for the purpose of saving the energy consumption. For example, this occurs in the case that the recording material 102 is plain paper or thin sheet, and high glossiness is not desired. As to whether to feed the recording material 102 into the second fixing device 170 or to feed the recording material 102 so as to bypass the second fixing device 170 (bypass route), the CPU 301 controls such an operation by switching the flapper 131.

(4.2. Structure of Fixing Device)

The first fixing device 150 and the second fixing device 170 are detachably mountable to the first mounting portion 141 and the second mounting portion 142 (collectively, the mounting portion) of the image forming apparatus 100, respectively. The first fixing device 150 and a second fixing device 170 can be replaced with other fixing devices having the following structures, respectively.

The first fixing device 150 is provided with a memory 154 as a storing portion. The second fixing device 170 is provided with a memory 174 as a storing portion. The details will be described hereinafter.

The first fixing device 150 is provided with sensors 153 and 155 as a jam detecting portion, and the second fixing device 170 is provided with sensors 173, 175 as a jam detecting portion. The details will be described hereinafter. For the respective fixing devices, the upstream sensors 155, 175 with respect to the feeding direction of the recording material 102 functions also as detecting portions for detecting the feeding of the recording material 102 to the respective fixing devices. The details will be described hereinafter.

Figure 3:
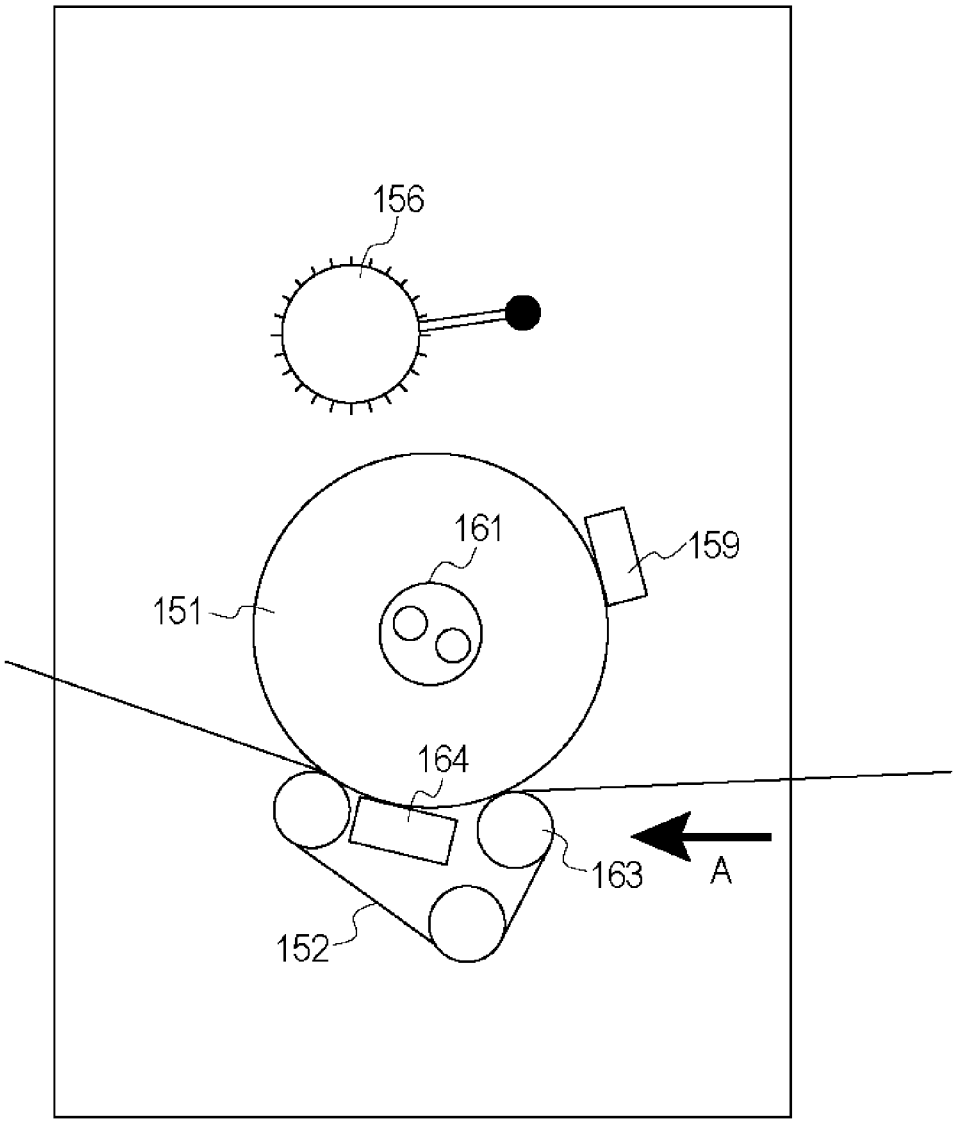
FIG. 3 is a sectional view of an example of a fixing portion.

FIG. 3 is a sectional view of an example of a fixing portion. Referring to FIG. 3, the first fixing device 150 will be described in detail.

The first fixing device 150 comprises a fixing roller 151 (fixing member, rotatable member) and a pressing belt 152 (pressing member, rotatable member), which are cooperative with each other to form a nip for fixing the toner image on the recording material 102.

The fixing roller 151 is a hollow roller containing therein a halogen heater 161 as a heating source. The thermister 159 as a temperature detecting portion is a sensor for sensing a temperature of the fixing roller 151. The halogen heater 161 is controlled by the CPU 301 to be ON or OFF on the basis of the information of the temperature detected by the thermister 159. This is done to adjust and maintain the temperature of the fixing roller 151 at a predetermined temperature. The predetermined temperature includes a tolerance.

The pressing belt 152 is an endless belt stretched around three rollers. To the inner surface of the pressing belt 152, a pressing pad 164 is contacted to urge the pressing belt 152 toward the fixing roller 151. The heating roller 163, which is one of the three rollers around which the pressing belt 152 is stretched, is a hollow roller, and contains therein a halogen heater (unshown) as the heating source. Similarly to the fixing roller 151, for the pressing belt 152, the CPU 301 controls the halogen heater (unshown) in the heating roller 163 on the basis of detected temperature information by the thermister (unshown) for sensing the temperature. As a result, the temperature of the pressing belt 152 is maintained at a predetermined temperature.

The fixing roller 151 is rotated by a motor 323 (FIG. 2) as a driving source to feed the recording material 102 in the direction indicated by an arrow A in FIG. 3. The pressing belt 152 is rotated by the fixing roller 151.

The first fixing device 150 is provided with a moving mechanism 322 (FIG. 2) for moving the pressing belt 152 to provide a contact state, in which the fixing roller 151 and the pressing belt 152 contact with each other to form the nip, and a spaced state in which they are spaced from each other. In this embodiment, the moving mechanism 322 moves the pressing belt 152, but the fixing roller 151 may be moved instead of the pressing belt 152, or both the fixing roller 151 and the pressing belt 152 may be moved.

On the other hand, the second fixing device 170 includes a pressing roller 172, instead of a pressing belt, as the pressing member, and the fixing roller 171 (fixing member) and the pressing roller 172 (pressing member) form a nip for fixing the toner image on the recording material 102. The pressing roller 172 is a hollow roller, and contains therein a halogen heater (unshown) as a heating source. The pressing roller 172 is provided with a thermister (unshown) as a temperature sensor. The CPU 301 controls the thermister and the halogen heater (unshown), so that the temperature of the pressing roller 172 is maintained at a predetermined temperature.

The above-described structures of the second fixing device 170 are similar to those of the first fixing device 150, and therefore, the description of the structures of the second fixing device 170 will be omitted for the sake of simplicity.

In the following description, the first fixing device 150 will be taken, and the description also applies to the second fixing device 170 unless otherwise stated (i.e., the structures of the first fixing device 150 apply to the structures of the second fixing device 170).

In this embodiment, the structures of the pressing sides of the first fixing device 150 and the second fixing device 170 are different from each other, but they may be the same. More particularly, the pressing side structures of the first fixing device 150 and the second fixing device 170 may use pressing belts or pressing rollers. Alternatively, the pressing side may comprise the pressing roller in the first fixing device 150, and the pressing side may comprise a pressing belt in the second fixing device 170.

(4.3. Refreshing Roller)

The description will be made as to a refreshing roller 156 as a rubbing rotatable member for effecting a rubbing treatment for the surface of the rotatable member. The description will be made taking the rubbing treatment surface of the fixing roller 151 of the first fixing device 150. The following description is applied also to the second fixing device 170.

In this embodiment, the refreshing roller 156 effects the rubbing treatment of the surface of the fixing roller 151. The refreshing roller 156 is capable of moving to contact or to be spaced from the fixing roller 151, and is capable of rubbing the peripheral surface of the fixing roller 151. The refreshing roller 156 comprises abrasive grain fixed on the peripheral surface thereof, and is rotated at a peripheral speed which is different from that of the fixing roller 151, so that the peripheral surface of the fixing roller 151 is roughened (roughening roller).

More particularly, the refreshing roller 156 comprises a stainless steel pipe (SUS304) (base material) having an outer diameter of 12 mm, and a rubbing layer on the peripheral surface with a bonding layer therebetween, the rubbing layer including the abrasive grain bonded at a high density.

The rubbing layer can be provided by bonding various commercially available abrasive grain or a mixture thereof on the bonding layer. The examples of the material of the commercially available abrasive grain includes aluminum oxide, aluminum hydroxide oxide, silicon oxide, cerium oxide, titanium oxide, zirconia, lithium silicate, silicon nitride, silicon carbide, iron oxide, chromium oxide, antimony oxide, diamond or the like.

In this embodiment, the abrasive grain of the rubbing layer is abrasive grain of aluminum oxide (alumina abrasive grain, Alundum, Molundum). The abrasive grain of aluminum oxide is most widely used, and has sufficient hardness as compared with the fixing roller 151, and in addition, the particles have acute angles, and therefore, the abrasive grain of aluminum oxide is preferable for the rubbing layer. In order that the rubbing treatment of the refreshing roller 156 performs the sufficient fixing element refreshing operation to provide the surface roughness of the fixing roller 151, the particle size of the abrasive grain of the rubbing layer is preferably not less than 5 μm and not more than 20 μm, as a result of the experiments which will be described hereinafter.

The refreshing roller 156 is movable between a contact state position, in which it contacts the fixing roller 151, and a spaced state position, in which it is spaced from the fixing roller 151, by a refreshing roller moving mechanism 325. The CPU 301 controls the refreshing roller moving mechanism 325 to control the state (contacting-spacing) of the refreshing roller 156.

The refreshing roller 156 is driven by a motor 324 as a driving source with a peripheral speed difference relative to the fixing roller 151. The CPU 301 controls the motor 324 for the refreshing roller 156 to control rotating and stopping of the refreshing roller 156. The peripheral speed difference of the refreshing roller 156 may be provided by moving the peripheral surface thereof in the same or opposite peripheral moving direction relative to the surface of the fixing roller 151.

The refreshing roller 156 is rotated by the motor 324 while being in contact with the fixing roller 151 by the refreshing roller moving mechanism 325 to rub the peripheral surface of the fixing roller 151. The CPU 301 controls the refreshing roller moving mechanism 325 and the motor 324 for the refreshing roller 156 to cause the refreshing roller 156 to rub the fixing roller 151 to provide an even surface state of the peripheral surface of the fixing roller 151.

(5. Glossiness Unevenness at the Widthwise End Portion of the Recording Material)

The preferability of the fixing element refreshing operation will be described.

The fixing roller 151 comprises a base layer of aluminum having an outer diameter of 68 mm, and an elastic layer of silicone rubber thereon having a rubber hardness of 20° (JIS-A under 1 kg load) and having a thickness of approx. 1.0 mm. The surface of the elastic layer is coated with a parting layer of fluorine resin tube having a thickness of 30 μm.

In the image forming operation of the image forming apparatus 100, the first fixing device 150 forms a nip between the fixing roller 151 and the pressing belt 152.

In the case that the toner having a high melting property is used in the oil-less fixing type device, as in this embodiment, the surface state of the fixing roller 151 tends to be reflected on the surface of the toner layer. In other words, fine pits and projections of the surface of the fixing roller 151 tend to appear on the surface of the output image. Such a property is called a reflection property. When the reflection property becomes high as a result of enhancement of the melting property of the toner, it is important to maintain the surface state of the fixing roller 151 from the standpoint of forming an image of the high image quality with high glossiness.

The fixing roller 151 in the initial state has a uniform specular-surface state over the entirety of the peripheral surface. At this time, the surface roughness of (ten point average roughness) Rz of the peripheral surface is about 0.1 μm-0.3 μm. The surface roughness Rz is a ten point average roughness (JIS) measured using a surface roughness measuring device SE-3400 available from Kabushiki Kaisha KOSAKA Kenkyusho, Japan. As the measuring condition, the feeding speed is 0.5 mm/sec, the cut-off level is 0.8 mm, and measurement length is 2.5 mm.

Figure 4:
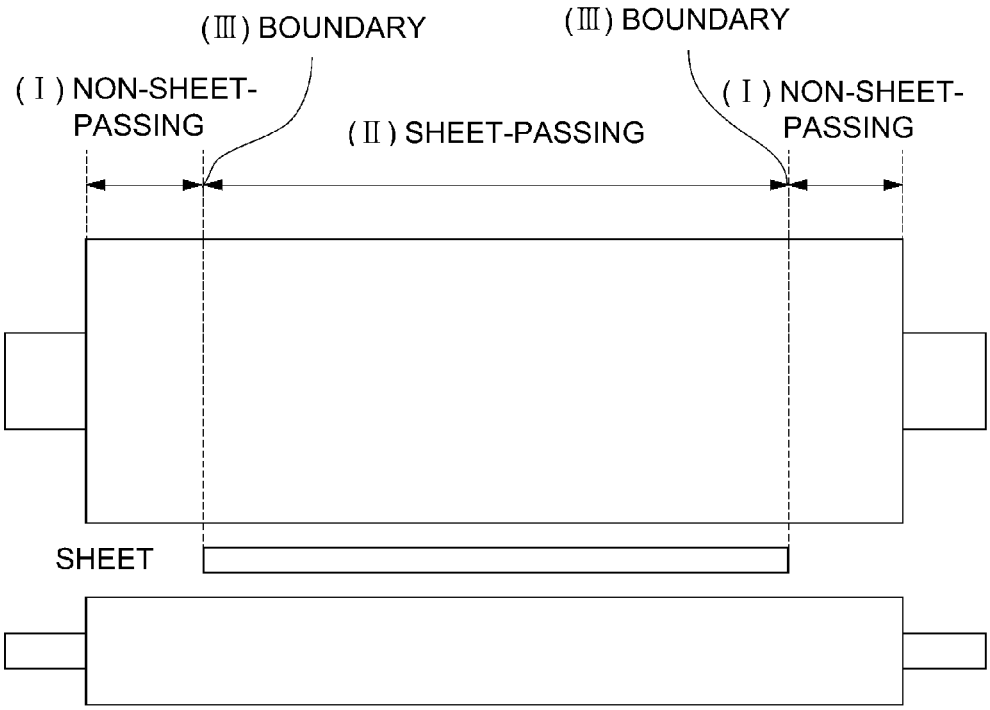
FIG. 4 illustrates a state in which the fixing portion nips and feeds a recording material.

FIG. 4 illustrates a state in which the fixing portion nips and feeds a recording material.

When the fixing process operation of the first fixing device 150 on the recording material 102 is repeated, the surface state of the fixing roller 151 gradually changes due to the contact with the end portions of the recording material 102, paper dust, offset toner, or the like, and therefore, the surface of the fixing roller 151 is gradually roughened. By the recording materials 102 passing the same position with respect to the direction of the rotational axis of the fixing roller 151, the degrees of the roughness of the fixing roller 151 are different between (I) a non-passing portion, (II) a passing portion, and (III) a boundary area there between.

The end portion of the recording material 102 is the end portion with respect to a direction perpendicular to the feeding direction of the recording material 102, and is called edge portion.

Figure 5:
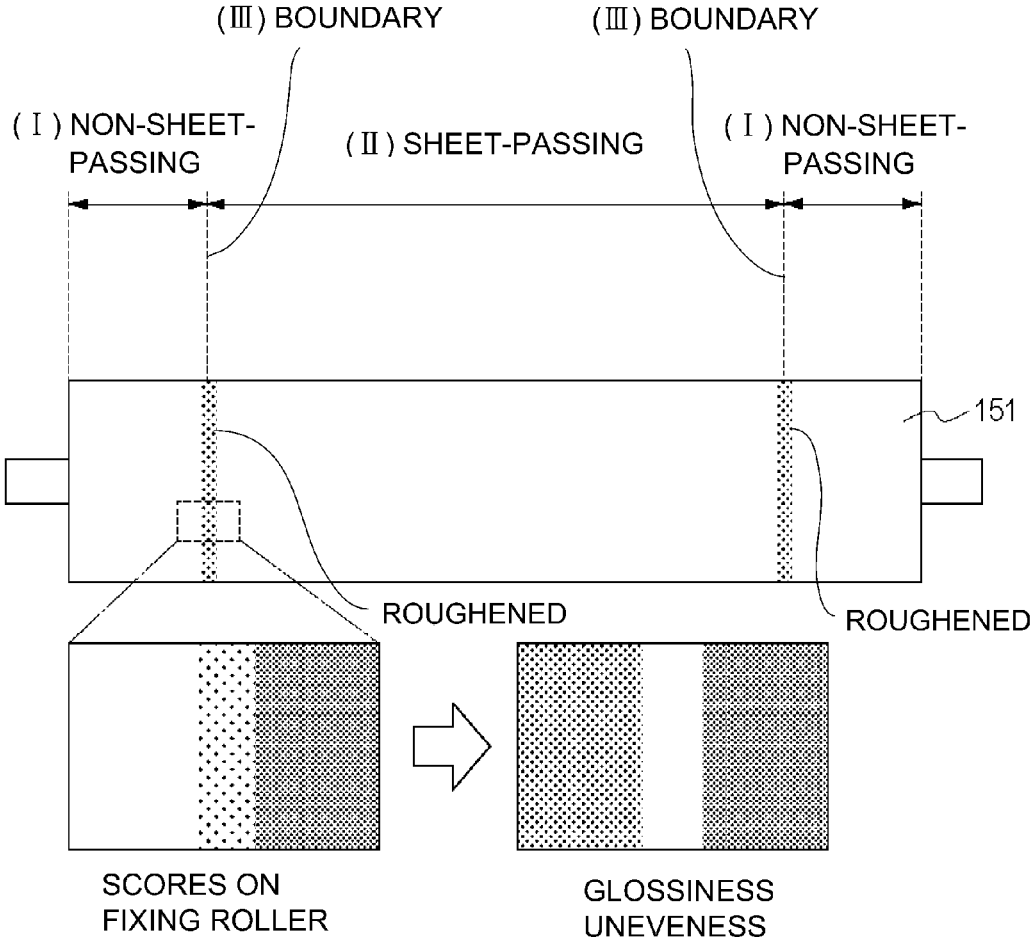
FIG. 5 illustrates glossiness unevenness at the edge of the recording material.

FIG. 5 illustrates glossiness unevenness at the edge of the recording material 102. In the enlarged view of FIG. 5 (in which the damage on the fixing roller 151 is shown), the left side portion (white portion) is the (I) non-passing portion, the central portion (coarse dot portion) is the (III) boundary area, and the right side portion (gray portion) is the (II) passing portion.

The (I) non-passing portion is the area in which no sheet passes, and therefore, is not contacted by the recording material 102. In the (I) non-passing portion, the surface of the fixing roller 151 contacts only the surface of the pressing belt 152.

In the (II) passing portion, the recording material 102 passes, and therefore, contacts the fixing roller 151. In the (II) passing portion, the surface of the fixing roller 151 is gradually roughened by the contact with fibers and loading material of the recording material 102, and by externally added material of the developer on the recording material 102. The (III) boundary area between the (II) passing portion and the (I) non-passing portion is repeatedly contacted by the edge portion of the recording material 102, and therefore, the surface roughness of the fixing roller 151 in the (III) boundary area is higher than that in the (II) passing portion.

That is, the surface roughnesses of the fixing roller 151 are, (III) boundary area>(II) passing portion>(I) non-passing portion.

In the process of fixing the toner image on the recording material 102, the fine surface shape of the fixing roller 151 is transferred onto the surface of the fixed image.

As shown in FIG. 5, if the surface states of the fixing roller 151 are different between the (II) passing portion and the (III) boundary area, the surface state of the fixed image is not even, and therefore, the fixed image exhibits a glossiness unevenness. In the portion of FIG. 5 showing the glossiness unevenness on the image (on the recording material), the left side portion (dot portion) is the portion corresponding to the (I) non-passing portion, the central portion (white portion) is the portion corresponding to the (III) boundary area, and the right side portion (grey portion) is the portion corresponding to the (II) passing portion. The width of the (III) boundary area is as small as approx. 1-2 mm, and the glossiness difference between the (I) non-passing portion and the (II) passing portion is remarkable because the glossiness unevenness is in the wide range.

The glossiness unevenness of the fixed image is dependent also on the kind of paper of the recording material 102. For example, the glossiness unevenness which is not visible on the plain paper is remarkable on the gloss coated paper sheet having a high glossiness with which a high image quality is required because of the high smoothness of the surface. In the fixed image on the gloss coated paper sheet, a low glossiness stripe is remarkable at the position corresponding to the (III) boundary area (rougher than the other area) of the fixing roller 151, and the glossiness difference between the (I) non-passing portion and the (II) passing portion. Therefore, the glossiness unevenness on the fixed image is remarkable as a whole.

As a result of the difference in the roughness of the surface of the fixing roller 151 between the (I) non-passing portion and the (II) passing portion, as described above, the difference in the glossiness on the fixed image occurs. Particularly, the (III) boundary area tends to be roughened and provides the glossiness difference relative to the (I) non-passing portion and the (II) passing portion.

In the foregoing, the description has been made with respect to the first fixing device 150, but the same applies to the second fixing device 170, and therefore, the description is omitted for the second fixing device 170.

(6. Fixing Roller Refreshing Operation).

As described in the foregoing, when the recording materials 102 pass through the nip repeatedly, the unevenness of the surface state is produced in the longitudinal direction of the fixing roller 151 (the direction of the rotational axis).

In view of this, in the image forming apparatus 100, after a predetermined number of recording materials 102 are fed into the first fixing device 150, the fixing element refreshing operation for improving the surface state of the fixing roller 151 is carried out. In the following, the description will be made taking the first fixing device 150 as an example, and the same applies to the second fixing device 170, and therefore, the description about the second fixing device will be omitted in this respect.

The refreshing roller 156 rubs the fixing roller 151 in the fixing element refreshing operation. By this, the surface roughness of the fixing roller 151 is made uniform in the longitudinal direction, thus improving the surface state of the fixing roller 151.

The refreshing roller 156 provides the portion of the surface of the fixing roller 151 roughened by the passing of the recording materials 102 and the portion of the surface relatively less roughened with a great number of fine scores, to a predetermined level. That is, the refreshing roller 156 decreases the difference in the surface state of the entirety of the fixing roller 151.

By this operation, the low glossiness stripe on the image at the position corresponding to the edge portion ((III) boundary area) and the glossiness difference between the (I) non-passing portion and the (II) passing portion are reduced. Thus, the surface state of the fixing roller 151 can be improved. By providing the surface of the fixing roller 151 with the great number of fine scores by the refreshing roller 156, the scores are difficult to see on the image. That is, by superimposing the fine scores on the portion of the fixing roller 151 roughened by the end portion of the recording material 102, using the refreshing roller 156, the damage on the fixing roller 151 produced by the end portion of the recording materials 102 does not visibly appear on the recording material 102.

The intended function of the refreshing roller 156 is to provide the surface of the fixing roller 151 with the fine scores, not to scrape the surface of the fixing roller 151. That is, the refreshing roller 156 provides the surface with the scores substantially without scraping the surface of the fixing roller 151. The rubbing by the refreshing roller 156 does not abrade the surface of the fixing roller 151, and is as if it imprints the surface into the initial state.

(6.1. Recording Material Count Method)

In this embodiment, the fixing element refreshing operation is executed on the basis of the number of the recording materials 102 fed into the first fixing device 150. More particularly, the predetermined number of the recording materials is 500 in this embodiment, and the fixing element refreshing operation is executed upon the number of the recording materials 102 (feeding number) into the first fixing device 150 exceeding 500.

In this embodiment, the CPU 301 functioning as the counter counts the feeding number on the RAM 302 in response to the signal from a sensor 155.

The sensor 155 as the detecting portion is provided on the first fixing device 150 at a position upstream of the nip of the first fixing device 150 with respect to the feeding direction. The sensor 155 functions to detect the feeding of the recording material 102 into the first fixing device 150, and is an optical sensor, for example. The CPU 301 detects the feeding of the recording material 102 into the first fixing device 150 by receiving the signal outputted in response to the passage of the recording material 102 by the sensor 155.

The CPU 301 increases the value (count) on the RAM 302 for each detection of the feeding of the recording material 102 into the first fixing device 150, and manages the number of the recording materials 102 fed into the first fixing device 150.

The CPU 301 executes the fixing element refreshing operation after the count exceeds a predetermined number (500, in this embodiment).

The count method for the number of the recording materials 102 fed into the first fixing device 150 is not limited to the described method.

For example, the number fed into the first fixing device 150 may be counted on the basis of the printing number instructed in the printing job received by the operating portion 180. For example, when the instructed printing job is 30 sheets, the CPU 301 feeds the 30 sheets into the first fixing device 150 one by one. Simultaneously, the CPU 301 increases the count on the RAM 302 by 30.

(6.2. Fixing Roller Refreshing Operation)

More specifically, the description will be made as to the fixing element refreshing operation which is executed after the predetermined number of the recording materials 102 are fed into the first fixing device 150.

In the fixing element refreshing operation, the CPU 301 controls the motor 324 for the refreshing roller to rotate the refreshing roller 156. At this time, the CPU 301 controls the refreshing roller moving mechanism 325 to contact the refreshing roller 156 to the fixing roller 151. By this, the refreshing roller 156 rubs the surface of the fixing roller 151.

After the CPU 301 executes the rubbing of the fixing roller 151 by the refreshing roller 156 for a predetermined time, the CPU 301 spaces the refreshing roller 156 from the fixing roller 151.

The time period of the rubbing treatment by the refreshing roller 156 (30 sec in this embodiment) is counted by the timer 307 provided in the image forming apparatus 100. The time counting may be accomplished by a clock provided in the image forming apparatus 100 counting the time on the basis of the clock time outputted by the CPU 301.

After elapse of the predetermined time period, the CPU 301 spaces the refreshing roller 156 from the fixing roller 151 and stops the rotation of the refreshing roller 156. By this, the fixing element refreshing operation is completed.

(7. Effects of the Fixing Element Refreshing Operation)

In the fixing element refreshing operation, the refreshing roller 156 provides the surface of the fixing roller 151 with the great number of scores (directional thin grooves) extending along the rotational moving direction of the fixing roller 151 such that the surface roughness of Rz (10 point average roughness) of the fixing roller 151 is not less than 0.5 μm and not more than 2.0 μm. The grooves (scores) have a width not more than 10 μm at a density not less than 10 per 100 μm in the rotational axis direction of the fixing roller 151.

By the great number of fine scores thus provided on the entirety of the peripheral surface of the fixing roller 151 by the refreshing roller 156, the difference in the surface state between the (I) non-passing portion, the (II) passing portion, and the (III) boundary area is reduced, and therefore, the unevenness of the surface state on the fixing roller 151 is less remarkable.

By this, the glossiness difference of the fixed image onto which the surface state of the fixing roller 151 is transferred decreases to such an extent that it is difficult to observe. In addition, the low glossiness stripe at the position corresponding to the (III) boundary area on the fixed image is substantially eliminated, and the glossiness unevenness between the (I) non-passing portion and the (II) passing portion on the fixed image is not remarkable.

More particularly, the surface roughness of Rz (10 point average roughness) of the image (toner portion on the recording material 102) on the recording material 102 having been fixed by the fixing roller 151 thus rubbed is not more than approximately 0.5 μm, with which the gloss difference is not easily observed. Sparsely distributed scores are easily observed, but densely (at high frequency) distributed scores are not easily observed as the glossiness difference.

The rubbing time period of the refreshing roller 156 suitable for the refreshment of the surface state of the fixing roller 151 (30 sec in this embodiment) is preset (stored in the ROM 303). Also, the predetermined number for the start of the fixing element refreshing operation (500 sheets in this embodiment) is preset (stored in the ROM 303). The time period and/or the number is not limited to the above examples, and can be properly selected depending on the structures of the device by one skilled in the art.

(8. Stand-by Mode)

The stand-by mode is a state in which the image forming apparatus 100 is in the state capable of starting of the image forming operation and waits for the printing instructions (printing job) by the operator. The operating portion 180 receives the printing job, including information regarding the kind of recording material 102 (surface property, basis weight, size or the like) on which the image is to be formed, the number of prints, and one-side printing/both side printing.

When the main switch 101 of the image forming apparatus 100 is actuated, the image forming apparatus 100 carries out preparing operations (start-up operations) for the preparation for the image forming operation, and in particular, preparation of the respective parts of the image forming apparatus 100, such as the first fixing device 150, the second fixing device 170, and the image forming station 309. In the case that no printing job to start is received, even after the image forming operation of the image forming apparatus 100 is enabled (that is, the start-up operations are completed), or that the execution of the printing job is completed, the image forming apparatus 100 shifts to the stand-by mode.

When the image forming apparatus 100 is enabled to start the image forming operation, the CPU 301 displays "printable" on the operating portion (notifying portion) 180.

In this embodiment, in the stand-by mode, the temperature control for the first fixing device 150 and the second fixing device 170 (the fixing roller 151 and pressing belt 152, for example) is continued so that the printing operation can be started as soon as the printing job is received.

If a printing operation is received during the start-up operation, the received printing job is executed without entering the stand-by mode.

If sheet jamming occurs during the execution of the printing job, for example, the image forming apparatus 100 stops the operation and interrupts the printing job. In such a case, the start-up operation is carried out to enable the image forming operation of the image forming apparatus 100 after the jammed sheet is cleared. When the job is resumed after the interruption, the apparatus does not enter the stand-by mode, and restarts the job immediately after the completion of the start-up operation.

(9. Fixing Device Exchanging System)

The exchanging system of the fixing device will be described.

The image forming apparatus 100 is capable of printing on various kinds and sizes of the recording material 102. In order to provide high quality prints, in the image forming apparatus 100 of this embodiment, the fixing device can be exchanged depending on the kinds of the recording material 102 or the preference of the operator.

For example, the fixing device used when the recording material 102 is an envelope and the fixing device used when another material are different from each other. When the recording material 102 is an envelope, the fixing device exclusively for the envelope is used. The envelope is easily creased by the pressure applied during the fixing process. Therefore, it is desirable to use a fixing device adjusted in the pressure between the fixing roller 151 and the pressing belt 152 (nip pressure) particularly for envelopes.

The same applies to the second fixing device 170.

Thus, according to the image forming apparatus 100 of this embodiment, the operator can exchange the fixing device depending on the kinds of the recording materials 102 or preferences of the operator.

When the fixing device is exchanged, the operator opens the front door 140 to take the mounted fixing device out of the image forming apparatus 100. Then, the operator mounts another fixing device into the image forming apparatus 100, and closes the front door 140. In this embodiment, the first fixing device 150 and the second fixing device 170 are exchangeable, respectively.

(10. Memory of the Fixing Device)

In this embodiment, the fixing device is exchangeable, and therefore, the first fixing device 150 is provided with a memory 154 as a storing portion, and the second fixing device 170 is provided with a memory 174 as a storing portion. The memories 154, 174 are rewritable non-volatile memories (storing portions), typically an EEPROM, a flash memory, or the like. A memory is also provided on a fixing device (not the first fixing device 150 or the second fixing device 170 already mounted in the image forming apparatus 100) kept outside of the image forming apparatus 100.

Each fixing device of a group of fixing devices, including the first fixing device 150 and the second fixing device 170, is provided with the memory in order to solve the problem described below. The problem arises when the first and/or second fixing device is taken out of an image forming apparatus 300, and then the fixing device is remounted in the image forming apparatus 300. The following description will be made taking the first fixing device 150 as an example, but the same applies to the second fixing device 170.

(10.1. Specific Situation)

More particularly, the following situation may occur. That is, the fixing device to be replaced is the first fixing device 150.

For example, the first fixing device 150 carries out the fixing element refreshing operation after 500 recording materials 102 are processed. In the case that a fixing device A, which is not exclusively for envelopes, is mounted in the main assembly of the apparatus as the first fixing device 150, a printing job is carried out on 450 sheets (on A4 size plain paper longitudinally fed, for example). Thereafter, the operator is required to print on envelopes, and then the operator removes the fixing device A from the image forming apparatus 100 to mount the fixing device B exclusively for envelopes. The operator carries out the printing job including 50 envelopes with the fixing device B mounted as the first fixing device 150.

The CPU 301 counts the number of the recording materials 102 fed into the first fixing device 150 by the counter provided in the main assembly 100A of the image forming apparatus 100, and the fixing element refreshing operation is executed after the feeding number exceeds the predetermined number. Therefore, when the fixing device is switched from the fixing device A to the fixing device B, the CPU 301 discriminates that the feeding number to the first fixing device 150 exceeds 500 when 50 sheets are processed by the fixing device B, and carries out the fixing element refreshing operation only for the fixing device B. Then, the CPU 301 discriminates that the fixing element refreshing operation after the 500 sheets feeding has been completed.

Some days later, when the operator is going to print on the recording material 102 (plain paper, for example) other than the envelope, the operator changes the fixing device to remount the fixing device A. The operator then executes printing on 50 sheets of recording material (on A4 size plain paper longitudinally fed, for example).

The fixing device A has already processed 450 sheets in the previous operation, and therefore, the uneven surface state of the fixing roller arises with respect to the longitudinal direction after only 50 sheets are processed. If the next printing job is carried out (on A4 size plain paper longitudinally fed, for example), the glossiness unevenness occurs on the outputted image, and as a result, the image quality is significantly deteriorated.

In view of this, this embodiment employs the memory 154 on the first fixing device 150. By this embodiment, the first fixing device 150 and the replacement fixing device are capable of storing the information relating to the number of the recording materials 102 having been processed thereby, as shown in FIG. 10, for example, and the CPU 301 causes the memory 154 to store the information of the feeding number. FIG. 10 illustrates an example of information stored in a memory of a fixing device.

(10.2. Count on the Basis of the Information Stored in the Memory of the Fixing Device)

The CPU 301, functioning as the counter, counts the feeding number of the recording materials 102 fed into the first fixing device 150 on the basis of the information of the memory 154.

By the CPU 301 counting the feeding number on the basis of the information of the memory 154, a proper fixing element refreshing operation can be carried out for the first fixing device 150 on the basis of the information indicative of the correct feeding number. Therefore, the deterioration of the image quality on the output recording material 102 can be suppressed.

The structure of this embodiment will be described in more detail.

Upon the operator remounting the first fixing device 150, the CPU 301 acquires the number of information from the memory 154.

When the first fixing device 150 is to be exchanged, the operator opens the front door 140, and draws the first fixing device 150 out of the image forming apparatus 100 and then exchanges the fixing device. Then, the first fixing device 150 is moved in the opposite direction to set it in the image forming apparatus 100, and the front door 140 is closed.

The CPU 301 detects that the front door 140 is closed, on the basis of the signal from the opening and closing sensor 305. Upon the detection of the closure of the front door 140, the CPU 301 accesses the memory 154 of the first fixing device 150. By this, it is confirmed that the first fixing device 150 is mounted. If the CPU 301 is unable to access the memory 154, the CPU 301 discriminates that the first fixing device 150 is not mounted. The method for discriminating whether or not the first fixing device 150 is mounted is not limited to that described above, and may be discriminated by electrical conduction or non-conduction state between the image forming apparatus 100 and the first fixing device 150, for example.

If the fixing device is exchanged in the OFF-state of the main switch 101, the opening and closing sensor 305 is unable to detect in the closure of the front door 140.

Therefore, the CPU 301 accesses the memory 154 of the first fixing device 150 in response to the actuation of the main switch 101. By this, it is confirmed that the first fixing device 150 is mounted. If the CPU 301 is unable to access the memory 154, the CPU 301 discriminates that the first fixing device 150 is not mounted.

If the information acquired from the memory 154 upon the remounting of the first fixing device 150 exceeds the predetermined number, the CPU 301 executes the fixing element refreshing operation. When the information acquired from the memory 154 does not exceed the predetermined number, the CPU 301 increases the count of the feeding number of the recording materials 102 fed into the first fixing device 150 and stores the feeding number in the RAM 302, continuing from the feeding number stored in the memory 154. For example, when the information acquired from the memory 154 indicates 30 sheets, the CPU 301 increases the count to 31, 32, 33, and so on, and stores the count in the RAM 302. When the count stored in the RAM 302 exceeds the predetermined number, the CPU 301 executes the fixing element refreshing operation. In this embodiment, the feeding of the recording material 102 into the first fixing device 150 is detected by the sensor 155. After executing the fixing element refreshing operation, the CPU 301 resets the count on the RAM 302.

The count per one sheet may be weighted depending on the length of the recording material 102 measured in the feeding direction. That is, the count value incremented on the RAM 302 or stored in memory 154 as the reference for executing the fixing element refreshing operation may be any data that corresponds to the recording material feeding number into the first fixing device 150. In this case, similarly to the information relating to the length of the recording material 102 in the main-scanning direction, the information of the length of the recording material 102 in the feeding direction is acquired from the content of the printing job received by the CPU 301. The degree of the weighting is prestored in the ROM 303 and is acquired by the CPU 301.

The method for counting the feeding number on the basis of the information of the memory 154 is not limited to that described above. For example, the CPU 301 may count the number of the recording materials 102 fed into the first fixing device 150, by renewing and recording the information of the feeding number of the memory 154 of the first fixing device 150 for each feeding of the recording material 102 into the first fixing device 150. The CPU 301 counts the information of the feeding number stored in the memory 154. Also in this case, therefore, the CPU 301, as the counter, counts the feeding number of the recording materials 102 fed into the first fixing device 150 on the basis of the information in the memory 154.

The CPU 301 may count the feeding number plus the feeding number acquired from the memory 154 up to the predetermined number. More particularly, when the information acquired from the memory 154 is 30, the CPU 301 increments the count value by one on the RAM 302 for each feeding of the recording material 102 into the first fixing device 150. Assuming that the predetermined number is 500, the CPU 301 discriminates exceeding of the predetermined number, when the count on the RAM 302 reaches 470.

The reference on which the fixing element refreshing operation is executed may not be the number of the sheets of the recording material 102 fed into the first fixing device 150. For example, it may be a total of the lengths of the recording materials 102 in the feeding direction fed into the first fixing device 150. In this case, the memory 154 stores the total length of the recording materials 102 fed into the first fixing device 150. The CPU 301 adds the length of the recording material 102 in the feeding direction fed into the first fixing device 150 to the value acquired from the memory 154. When the value exceeds the predetermined length, the CPU 301 executes the fixing element refreshing operation.

In addition, for example, the reference on which the fixing element refreshing operation is executed, the time period in which the fixing roller 151 is fixing the image may be counted and stored in the memory 154. In this case, the reference on which the fixing element refreshing operation is executed is also the time period (4000 sec, for example). The time period in which the fixing roller 151 is in contact with the pressing belt 152 counted by the timer (clock) 307 is measured by the timer 307.

More particularly, the CPU 301 sets the timer 307 at an initial value acquired from the memory 154 as the initial fixing period. The timer 307 counts the time period in which the fixing roller 151 is in contact with the pressing belt 152, continuing from the set initial value. When the value of the timer 307 exceeds the predetermined time period, the CPU 301 executes the fixing element refreshing operation. Alternatively, the initial value of the timer 307 may be zero, in which the CPU 301 adds the time counted by the timer 307 to the time stored in the memory 154, so that the total image fixing period of the fixing roller 151 is obtained.

Also when no information of the feeding number is stored in the memory 154 (zero), the CPU 301 deems the information of the feeding number stored.

The memory 154 may store information other than the feeding number information. For example, as the information indicative of the usage, the memory 154 may store the kind of the recording material processed by the first fixing device 150, such as the envelope or the A4 size.

(10.3. Count for Each Width Size)

Furthermore, in this embodiment, the feeding number is stored for each widthwise size of the recording material 102. The widthwise size measured in the direction perpendicular to the feeding direction of the recording material 102 is called the main scan direction length (or width size). FIG. 10 shows an example in which the feeding numbers are stored for each 5 mm main scan direction length of the recording material 102.

As described hereinbefore, the roughened area in the (III) boundary area is produced by the edge portions of the recording materials 102 repeatedly contacting the same position of the fixing roller 151 with respect to the direction of the rotational axis of the fixing roller 151. That is, the roughened area is produced with the increase of the feeding number of the recording materials 102.

By the fixing element refreshing operation, the surface state of the fixing roller 151 is uniformized in the entirety of the longitudinal range (i.e., in the (I) non-passing portion, the (II) passing portion, and the (III) boundary area). Therefore, the unevennesses of the surface state of the fixing roller 151 produced by the edge portions of the recording materials 102 having different main scan direction lengths are also eliminated.

Therefore, in this embodiment, the number of the recording materials 102 fed into the first fixing device 150 is stored for each 5 mm of the main scan direction length of the recording material 102, in the memory 154. When the feeding number for any one of the main scan direction lengths exceeds the predetermined number (500, in this example), the CPU 301 executes the fixing element refreshing operation. Thereafter, the feeding numbers for all of the main scan direction lengths are reset (zero). When the feeding number for any one of the main-scanning lengths exceeds the predetermined number, the CPU 301 executes the fixing element refreshing operation.

The information of the main scan direction length of the recording material 102 is acquired from the content of the printing job received by the CPU 301. When the operating portion 180 receives the printing job from the operator, it also receives the size of the recording material 102 (A3, for example) on which the image is to be formed, as one of the contents of the printing job.

By this, the glossiness unevenness on the output images can be suppressed, and also, the frequency of the fixing element refreshing operations is made lower than when the fixing element refreshing operation is carried out irrespective of the main scan direction length of the recording material 102.

(11. Control Flow)

In this embodiment, the CPU 301 counts and stores in the memory 154 the feeding number of the recording materials 102 fed into the first fixing device 150 for each main scan direction length (i.e., for each width). When the count of the recording material 102 for any one of the main scan direction lengths exceeds the predetermined value during the printing operation, the fixing element refreshing operation is carried out after completion of the printing job currently being executed, and then the apparatus shifts into the stand-by mode. That is, if the count at the time of the completion of the image forming operation exceeds the predetermined value, the fixing element refreshing operation is executed after the completion of the current printing job. In addition, the CPU 301 executes the fixing element refreshing operation and shifts the apparatus into the stand-by mode, if the count of the recording materials 102 for any one of the main scan direction lengths exceeds the predetermined value when the main switch is actuated, or when the front door 140 is closed.

The description will be made in conjunction with the flow charts of FIGS. 6 and 7.

The operations of the flow charts are carried out by the CPU 301 functioning as the executing portion (recording portion) controlling the related mechanisms of the image forming apparatus 100 in accordance with the control program stored in the ROM 303. The description will be made as to the first fixing device 150, but the same applies to the second fixing device 170.

(11.1. Sequence Upon Actuation of the Main Switch and Upon Closing the Front Door)

Figure 6:
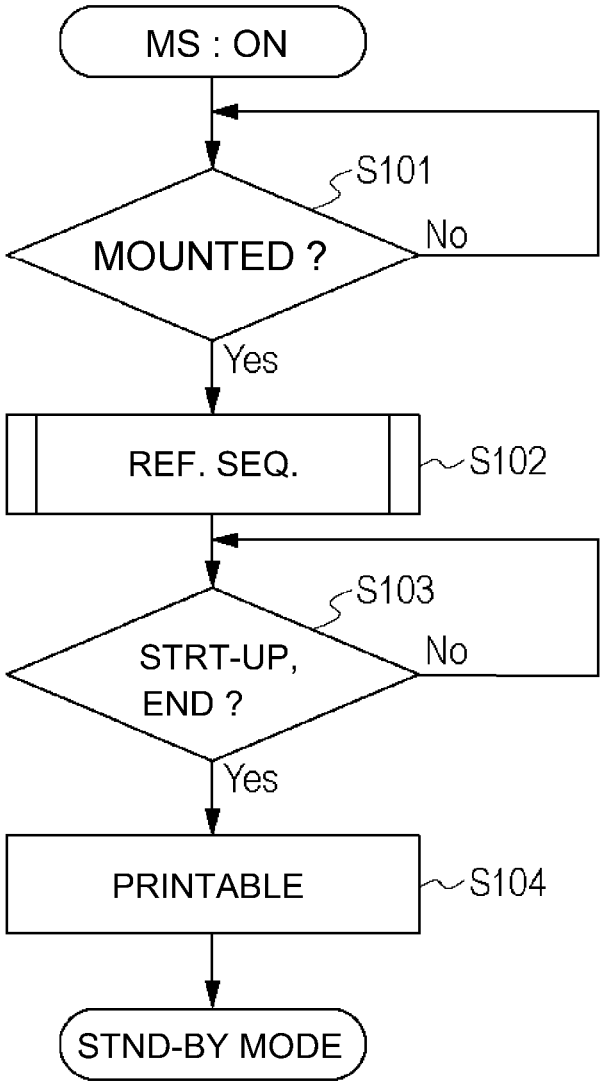
FIG. 6 is a flow chart showing the operations from the actuation of a main switch to a stand-by mode.

FIG. 6 is a flow chart showing the operations from the actuation of a main switch to a stand-by mode.

With the actuation of the main switch 101, the CPU 301 starts. The CPU 301 discriminates whether or not the first fixing device 150 is mounted in the image forming apparatus 100 (S101). If the result of the discrimination is affirmative, the CPU 301 becomes accessible to the memory 154. If the result of the discrimination at the step (S101) is negative, the operation returns to the step S101. In such a case, the CPU 301 may display a message, prompting the insertion of the first fixing device 150, on the operating portion 180. If the first fixing device 150 is mounted in the image forming apparatus 100, the operation proceeds to the step S102.

Figure 8:
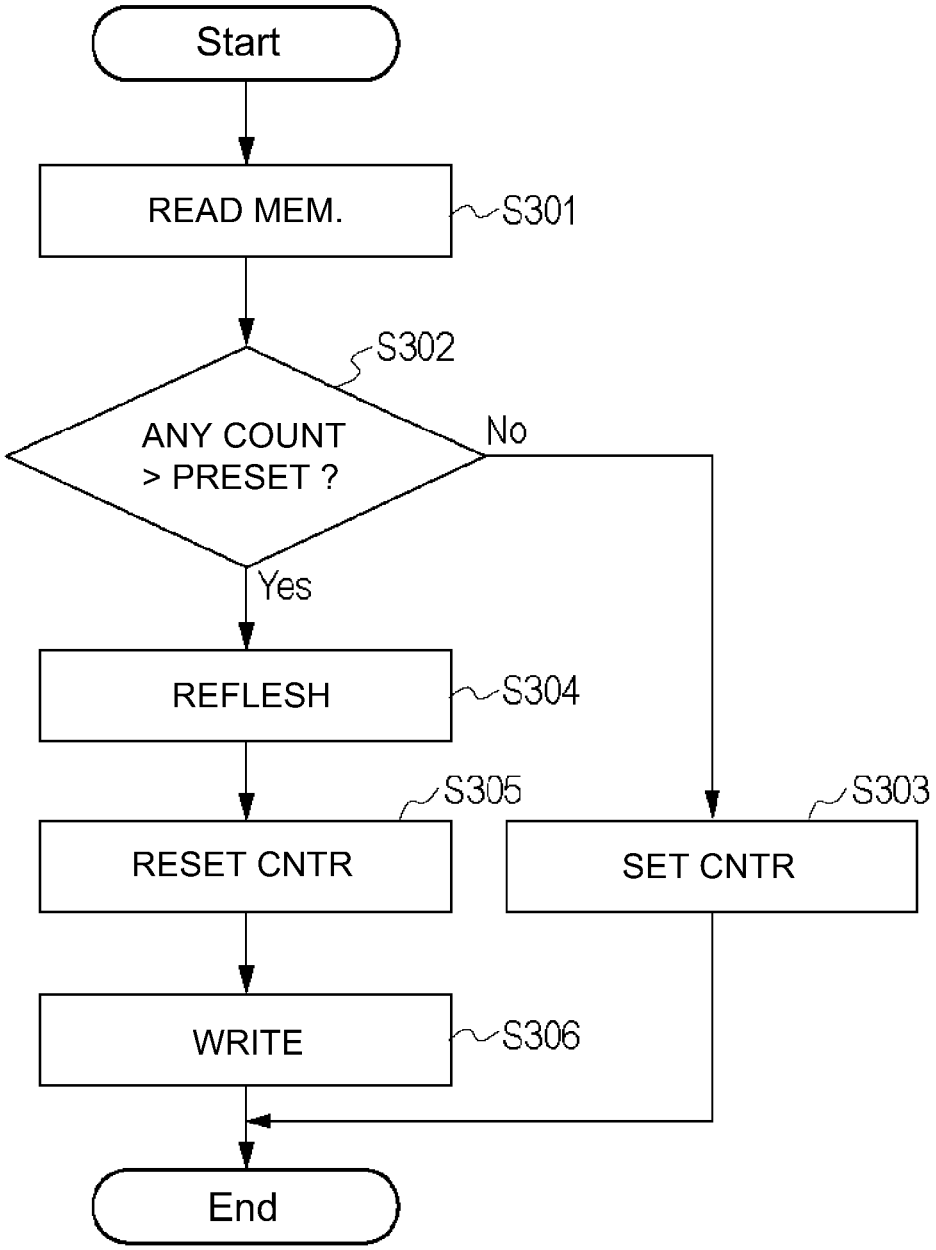
FIG. 8 is a flow chart of a refreshing sequence.

The CPU 301 carries out the refreshing sequence shown in FIG. 8 for the first fixing device 150. The details of the operation will be described hereinafter.

In step S103, the CPU 301 waits for the image forming apparatus 100 to become capable of carrying out the image forming operation. The CPU 301 carries out the preparing operation (starting-up operation) for the start of the image forming operation for various mechanisms, such as the first fixing device 150 and the image forming stations 309, after the actuation of the main switch 101. The temperature control for the fixing roller 151 is part of the preparing operation, for example.

When the image forming apparatus 100 becomes capable of carrying out the image forming operation after the completion of the starting-up operations (Yes, S103), the CPU 301 displays "printable" or the like on the operating portion 180 (S104). By this, the operator is notified of the fact that the image forming apparatus 100 has become capable of carrying out the image forming operation. The apparatus is shifted into the stand-by mode.

Figure 7:
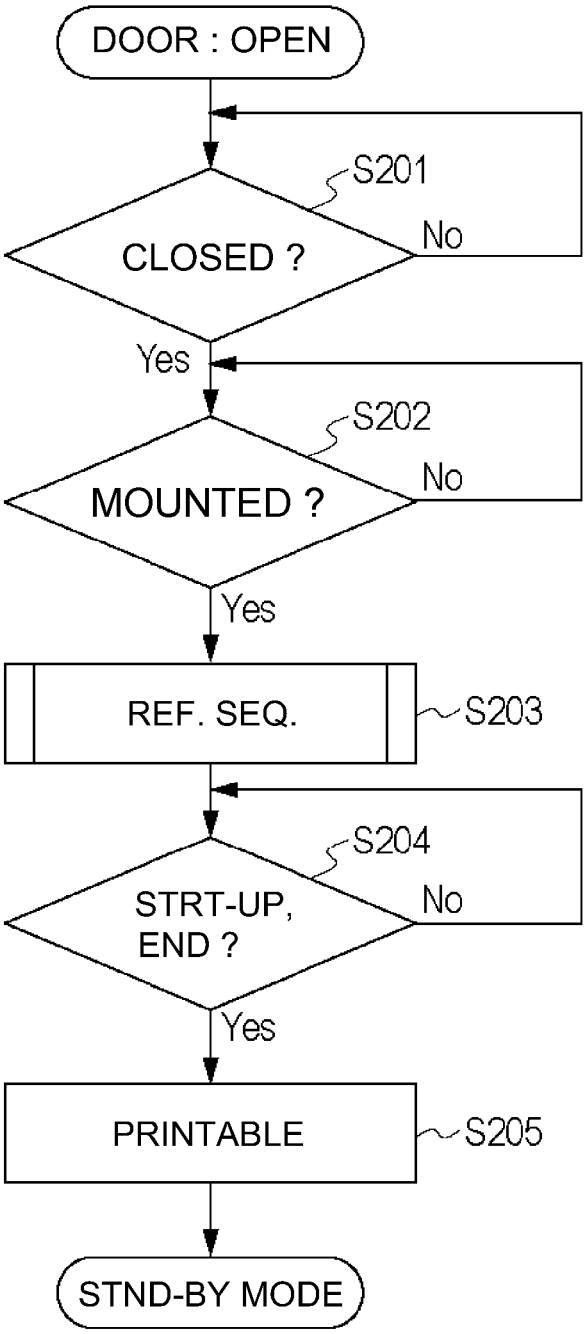
FIG. 7 is a flow chart showing the operations from the state in which a front door is open to the stand-by mode.

FIG. 7 is a flow chart showing the operations from the state in which a front door 140 is open to the stand-by mode.

The opened and closed states of the front door 140 are detected by the CPU 301 on the basis of the signal from the opening and closing sensor 305 of the front door 140. When the front door 140 is open, the CPU 301 waits for the closing of the front door 140 (S201). When the front door 140 is open, the CPU 301 may display information to prompt to close the front door 140. When the CPU 301 detects the closing of the front door 140 (S201), the operation proceeds to step S202.

Steps S202-S205 are the same as the steps S101-S104 of FIG. 6, and therefore, the description thereof is omitted. After step S205, the operation proceeds to the stand-by mode.

(11.2. Refreshing Sequence)

FIG. 8 is a flow chart of a refreshing sequence. The flow chart of FIG. 8 shows steps S102, S203, and the details of the refreshing sequence which will be described hereinafter.

First, the CPU 301 reads out the data stored in the memory 154 of the first fixing device 150 mounted in the image forming apparatus 100 (S301). The memory 154 stores the information indicative of the feeding number for each 5 mm of the length in the widthwise direction (i.e., each of the main scan direction lengths) of the recording material as shown in FIG. 10, for example.

When the information of the feeding numbers for the respective main scan direction lengths stored in the memory 154 is less than the predetermined number (predetermined value, 500 in this example) for any of the feeding numbers (counts in the memory 154) for all of the main scan direction lengths of the recording material, the CPU 301 proceeds to step S303 (S302).

The CPU 301 sets, as the value of the counter, the value for each of the main scan direction lengths read out of the memory 154 on the RAM 302 for each main scan direction length (S303).

On the other hand, in step S302, the CPU 301 proceeds to S304 if the feeding numbers (count) for any one of the feeding number for the main scan direction length of all of the feeding numbers for the main scan direction lengths exceeds the predetermined value (500 in this example).

In the step S304, the CPU 301 executes the above-described fixing element refreshing operation. By this, the surface of the fixing roller 151 is rubbed, so that the surface state is made even.

After the completion of the fixing element refreshing operation, the CPU 301 sets the counts for the respective main scan direction lengths to zero. That is, the value on the RAM 302 is reset (S305).

The CPU 301 (recording portion, writing portion) resets all of the feeding numbers for the main scan direction lengths to zero as the feeding number information stored in the memory 154 (S306). More particularly, the values on the RAM 302 set in the step S305 are copied into the memory 154 in combination with the main scan direction length information. By this, the CPU 301 is capable of executing the fixing element refreshing operation when the feeding number for any of the main scan direction lengths exceeds the predetermined value (500 in this example) after the execution of the fixing element refreshing operation again. That is, by setting the feeding numbers for all the main scan direction lengths to zero in the memory 154 after the execution of the fixing element refreshing operation, the CPU 301 records in effect the information indicative of the actual execution of the fixing element refreshing operation, in the memory 154. In this manner, the fixing element refreshing operation can be carried out repeatedly, for each exceeding of the feeding number for any one of the main scan direction lengths of the recording materials 102. The information of the feeding number may be written in the memory 154 in step S306 with the CPU 301 detecting the opening of the front door 140 on the basis of the signal from the opening and closing sensor 305 in the stand-by mode state. In addition, the information of the feeding number may be written in the memory 154 in step S306 with the deactuation of the main switch 101. This is because the exchange of the first fixing device 150 necessitates the opening of the front door 140.

(11.3. Sequence for Recording Material Counting)

Figure 9:
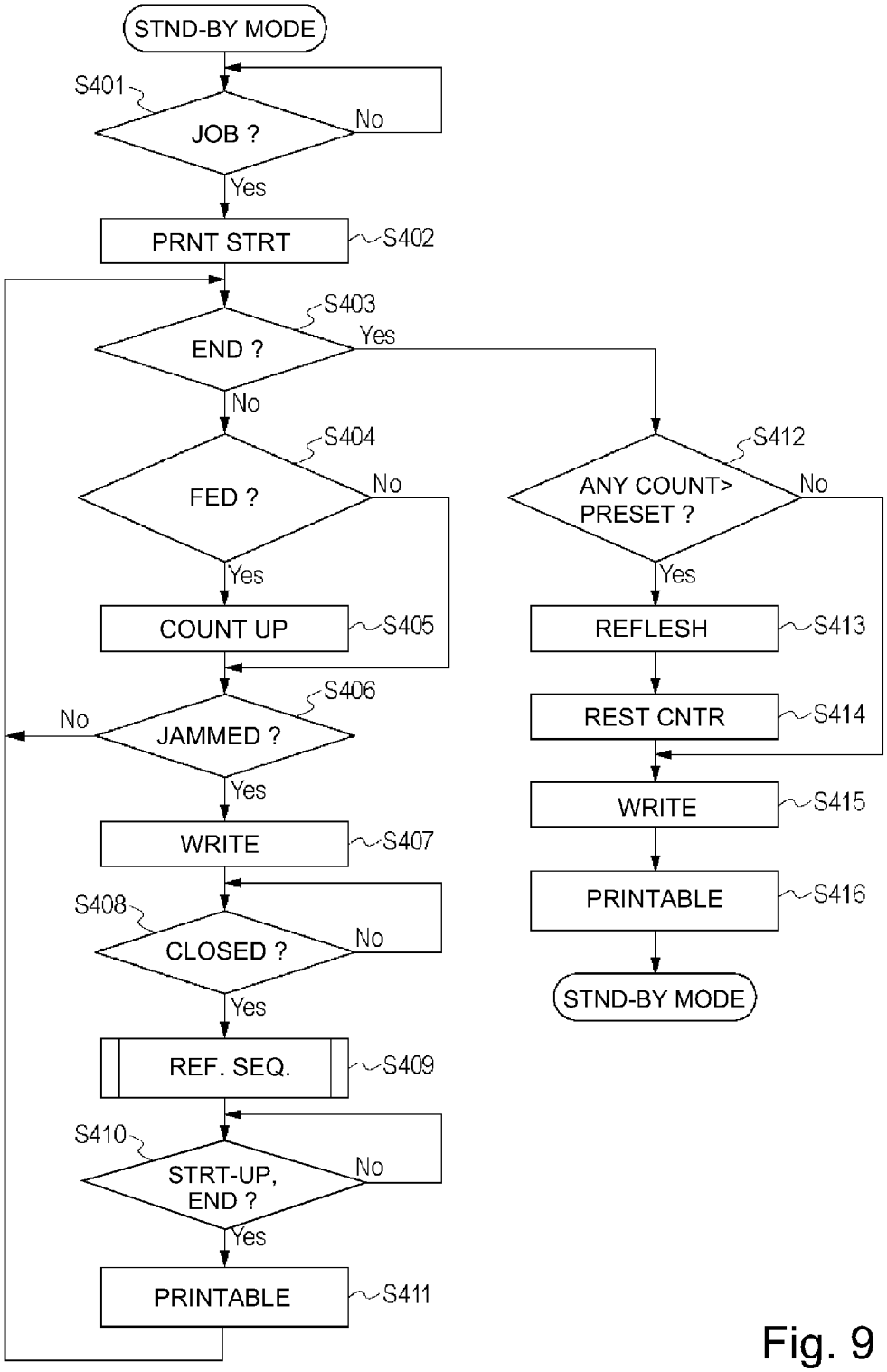
FIG. 9 is a flow chart of counting of the recording materials.

FIG. 9 is a flow chart of counting of the recording materials. More particularly, it is a flow chart of printing job execution by the image forming apparatus 100.

In the stand-by mode in which the image forming apparatus 100 is capable of carrying out the printing operation, the image forming apparatus 100 waits for the printing job from the operating portion 180 or an external PC or the like through the outside I/F portion 304 (S401). At this time, the image forming apparatus 100 displays a selection screen for selecting the kind of the recording material 102 on the operating portion 180 or on a display screen of the external PC, and receives the kind of the recording material 102 to be used for the printing by the operator as a content of the printing job.

When the printing job is received (Yes, S401), the CPU 301 controls the mechanisms such as the image forming stations 120-123, the first fixing device 150, the second fixing device 170, or the like, of the image forming apparatus 100, and starts the image forming process operation of the image forming apparatus 100. In other words, the printing job is started (S402).

If the CPU (counter) 301 detects the feeding of the recording material 102 to the first fixing device 150 (S404, Yes) in the stage in which the printing job is not completed (in S403, No), the CPU 301 increments the count on the RAM 302. The CPU 301 increments the count corresponding to the main scan direction length of the fed recording material 102, of the counts on the RAM 302. The information of the main scan direction length of the fed recording material 102 is acquired by the CPU 301 on the basis of the content of the printing job in step S401. The CPU 301 detects the feeding of the recording material 102 to the first fixing device 150 depending on the signal from the sensor 155.

On the other hand, if the feeding of the recording material 102 to the first fixing device 150 is not detected in step S404, the CPU 301 does not increment the count, and proceeds to S406. This occurs, for example, in the case that after the detection of the passage of the recording material 102, the passage of the next recording material 102 is not detected after elapse of a predetermined time, despite the non-completion of the printing job. The predetermined time period is counted by the timer 307.

When no sheet jamming in the image forming apparatus 100 is detected (S406, No), the CPU 301 continues the operation for the printing job until the completion of the printing job, while repeating the operations of steps S404 and S405.

When the CPU 301 detects the jamming in the image forming apparatus 100 (S406), the CPU 301 records the count on the RAM 302 for the main scan direction length in the memory 154 as the information of the feeding number (S407). The CPU 301 detects the jamming in the image forming apparatus 100 on the basis of the signals from the sensor group 306. For example, in the case that upon elapse of a predetermined time from the detection of the recording material 102 by the sensor disposed in the upstream side with respect to the feeding direction of the recording material 102, the sensor disposed in the downstream side does not detect the passage of the recording material 102, the CPU 301 discriminates that the recording material 102 stagnates in the portion between the two sensors. The predetermined time is counted by the timer 307. when the jamming occurs in the image forming apparatus 100, the CPU 301 interrupts the printing job. At this time, the jammed recording material stagnating in the feeding path of the image forming apparatus 100 is cleared by the operator, and therefore, the front door 140 or the like is opened.

The CPU 301 waits for the front door 140 to close (S408). When the CPU 301 detects the closing of the front door 140 on the basis of the signal from the opening and closing sensor 305 (S408), the refreshing sequence is carried out (S409).

The refreshing sequence in step S409 corresponds to the flow shown in FIG. 8. In the refreshing sequence, the memory 154 in the first fixing device 150 is read out as described in the foregoing step S301. The memory 154 is read out because there is a possibility that the first fixing device 150 is exchanged when the front door 140 is opened for the jam clearance.

In step S410, the CPU 301 waits for the image forming apparatus 100 to become capable of carrying out the image forming operation. The CPU 301 carries out the preparing operation (starting-up operations) for resuming the image forming operation for various mechanisms such as the first fixing device 150, the image forming station 309, and the like, of the image forming apparatus 100 after the clearance of the jammed recording material. The temperature control for the fixing roller 151 is one of them, for example.

When the image forming apparatus 100 becomes capable of resuming the image forming operation after the completion of the starting-up operations (Yes, S410), the CPU 301 displays "printable" or the like on the operating portion 180 (S411). By this, the operator is notified of the fact that the image forming apparatus 100 becomes capable of carrying out the image forming operation. Thereafter, the operation returns to S403, and the CPU 301 resumes the operations for the remaining printing job and continues up to the completion of the printing job.

When the printing job is completed (S403, Yes), the CPU 301 discriminates whether or not any one of the feeding numbers for all the main scan direction lengths on RAM 302 exceeds the predetermined value (500 in this example) (S412).

If the result of the discrimination is negative, that is, if the values of the feeding numbers for all of the main scan direction lengths stored in the RAM 302 are less than the predetermined value (500 in this example), the CPU 301 proceeds to step S415.

If the result of the discrimination is affirmative, that is, if the values of the feeding number for any one of the main scan direction lengths exceeds the predetermined value (500 in this example), the CPU 301 executes the fixing element refreshing operation (S413). After the completion of the fixing element refreshing operation, the CPU 301 resets the values for all of the main scan direction lengths on the RAM 302 to zero. That is, the values of the counter are reset (S414).

In step S415, the CPU 301 records the count of the RAM 302 in the memory 154 for each main scan direction length as the information of the feeding number. As the operation has proceeded through the flow of the S414, the feeding numbers for all the main scan direction lengths as the information of the feeding number become zero.

The CPU 301 displays "printable" on the operating portion 180 to notify of the operativity of the image forming apparatus 100 (S416). Then, the image forming apparatus 100 is shifted into the stand-by mode.

By storing the information of the feeding number in the memory 154 before entering the stand-by mode, a correct feeding number can be stored in the memory 154 even when the first fixing device 150 is removed from the image forming apparatus 100 during the stand-by mode.

The writing in the memory 154 in step S407 may be effected only when the jamming occurs in first fixing device 150 and/or the second fixing device 170 in S406. It is expected for the front door 140 to be opened by the operator after the occurrence of the jamming, because the jamming occurs in the fixing portion. This is because in the case of the jamming in the fixing portion, the operator clears the recording material 102 stagnating in the first fixing device 150 and/or the second fixing device 170. The liability that the first fixing device 150 is exchanged by the operator arises when the front door 140 is opened.

In such a case, the sensors 153, 155 function as the jam detecting portion. Each of the sensors may be an optical sensor, for example. The CPU 301 receives the signals from the sensors 153 and/or 155 to detect the stagnation of the recording material 102 in the first fixing device 150 (jamming in the fixing portion). For example, in the case that after the elapse of the predetermined period after the passage of the recording material 102 by the sensor 155 disposed at an upstream side with respect to the feeding direction of the recording material 102, and the downstream side sensor 153 does not detect the passage of the recording material 102, the CPU 301 discriminates that the recording material 102 stagnates between the sensors 155 and 153. The predetermined time is counted by the timer 307.

In the fixing element refreshing operation in steps S304 and S413, the duration of the rubbing treatment by the refreshing roller 156 may not be constant. That is, the CPU 301 carries out the rubbing treatment for a time period corresponding to an amount, beyond the predetermined count (500 in this example), of the count of the feeding number for the main scan direction length.

For example, for the predetermined value in steps S412 and S413, when the count is 500, the rubbing treatment duration is 30 sec, and when the count is 600, the rubbing treatment duration is 40 sec.

In this case, the duration of the rubbing treatment may be gradually or stepwisely increased with the increase of the exceeding amount of the count of the feeding number. The data (table, function, or the like) for providing the correspondence between the exceeding amount of the count relative to the predetermined value and the rubbing treatment duration is stored in the ROM 303 beforehand.

As described hereinbefore, the exchange of the first fixing device 150 by the operator necessitates the opening and closing of the front door 140 of the image forming apparatus 100. When the front door 140 of the image forming apparatus 100 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU 301 reads the information out of the memory 154 of the first fixing device 150 to acquire the information of the feeding number in the memory 154. By this, the CPU 301 can execute the fixing element refreshing operation for the first fixing device 150 on the basis of the more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

Embodiment 2

In Embodiment 1, when the count of the feeding number for any one of the main-scan direction lengths exceeds the predetermined value during the printing operation, the CPU 301 carries out the fixing element refreshing operation after the completion of the printing job, and then the image forming apparatus 100 shifts to the stand-by mode.

In Embodiment 2, when the total count of the feeding numbers for the main-scan direction lengths exceeds the predetermined value, the CPU 301 executes the fixing element refreshing operation in the period of the printing job.

In Embodiment 1, the CPU 301 counts the feeding number for the main scan direction length on the RAM 302, and stores the count in memory 154.

In Embodiment 2, the CPU 301 counts the feeding number on the memory 154 of the first fixing device 150. The CPU 301 renews and records the count of the feeding number in the memory 154 for each detection of the feeding of the recording material 102 into the first fixing device 150 on the basis of the signal from the sensor 155, thus functioning as the counter.

The same applies to the second fixing device 170.

In the description of this embodiment, the same reference numerals as in Embodiment 1 are assigned to the elements having the corresponding functions in this embodiment, and the detailed description thereof is omitted for simplicity.

In the following, the description will be made with respect to the first fixing device 150. The same applies to the second fixing device 170.

In the memory 154, the number of the recording materials 102 fed into the first fixing device 150 is stored for each 5 mm of the main scan direction length of the recording material 102. After the total of the feeding numbers for the respective main scan direction lengths exceeds the predetermined value (500 in this example), the fixing element refreshing operation is executed by the CPU 301. Thereafter, the feeding numbers for all of the main scan direction lengths are reset (zero). When the total count exceeds the predetermined value (500 in this example), again, the CPU 301 executes the fixing element refreshing operation.

In place of counting the recording materials for each main scan direction length on the memory 154, all the recording materials fed into the first fixing device 150 may be counted irrespective of the main scan direction length.

The fixing element refreshing operation in this embodiment (in the period of the execution of the printing job) may be carried out after the interruption of the printing job (that is, by expanding the interval between the adjacent recording materials 102 fed into the first fixing device 150), or while printing is continuously carried out (that is, while executing the fixing process operation). However, the former is preferable. In such a case, the likelihood of the production of the disturbance of the toner image during the fixing process operation attributable to the vibration or the like caused by the contact of the refreshing roller 156 to the fixing roller 151 for the execution of the fixing element refreshing operation can be reduced.

(12. Control Flow)

Referring to flow charts of FIGS. 6 and 7 of Embodiment 1, and the flow charts of FIGS. 11 and 12, the description will be made. The operations in each flow chart are carried out by the CPU 301 as the executing portion (recording portion, writing portion) controlling the operation of the various mechanisms of the image forming apparatus 100 on the basis of control programs stored in the ROM 303. The description will be made as to the first fixing device 150, but the same applies to the second fixing device 170.

(12.1. Sequence Upon Actuation of the Main Switch and Upon Closing the Front Door)

The sequence upon actuation of the main switch 101 and upon closing the front door 140 will be described referring to the flowchart of FIGS. 6 and 7.

Figure 11:
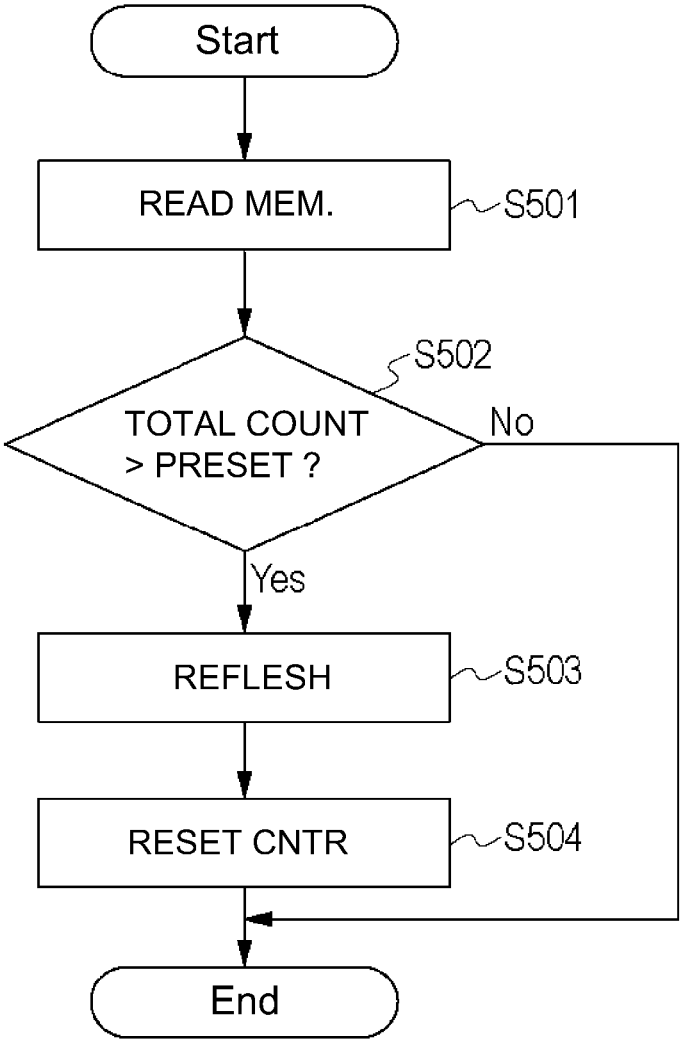
FIG. 11 is a flow chart of a refreshing sequence.

In this embodiment, in the steps S102 (FIG. 6) and S203 (FIG. 7), the operation proceeds to the refreshing sequence of FIG. 11.

As to the other structures, they are the same as those of Embodiment 1, and the description thereof are omitted for the sake of simplicity.

(12.2. Refreshing Sequence)

FIG. 8 is a flow chart of a refreshing sequence. The flow chart of FIG. 11 shows the details of the step S102 (FIG. 6), and the step S203 (FIG. 7) and the refreshing sequence in step S608, which will be described hereinafter.

A step S501 is the same as the step S301 of FIG. 8, and therefore, the description thereof is omitted.

In step S502, the CPU 301 sums the feeding numbers for all of the main scan direction lengths stored in the memory 154, and discriminates whether or not the sum (total count) exceeds the predetermined value.

If the result of the discrimination is affirmative, that is, the total count exceeds the predetermined value (500 in this example), the CPU 301 proceeds to a step S503 (S502).

The step S503 is the same as the step S304 of FIG. 8, and therefore, the description thereof is omitted.

After the completion of the fixing element refreshing operation (S503), the CPU 301 sets the counts for all of the main scan direction lengths to zero on the memory 154. That is, the value on the memory 154 is reset (S504).

On the other hand, if the discrimination in the step S502 is negative, that is, the total count is not more than the predetermined value (500 in this example), the CPU 301 completes the refreshing sequence without executing the fixing element refreshing operation.

(12.3. Sequence for Recording Material Counting)

Figure 12:
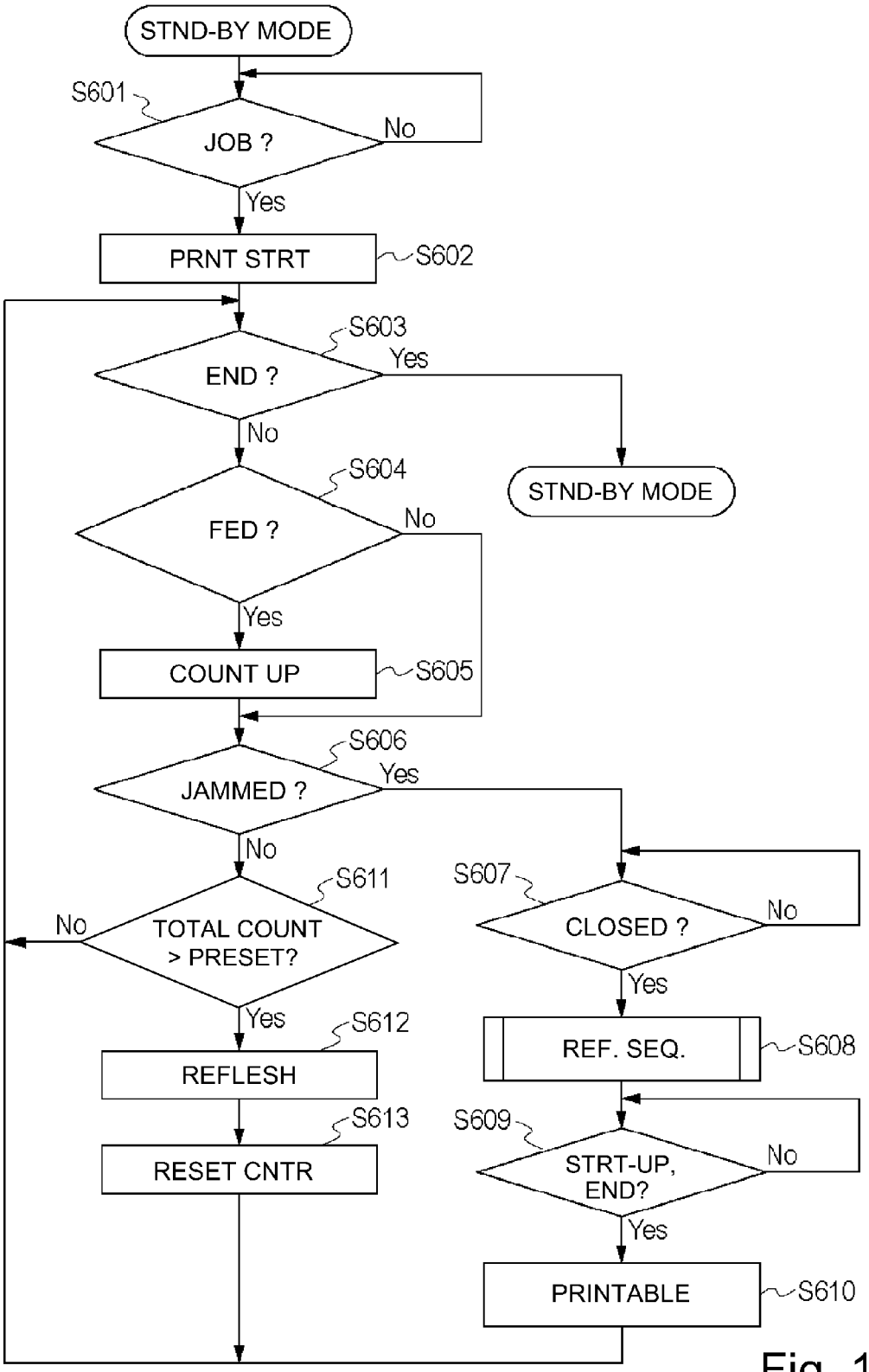
FIG. 12 is a flow chart of counting of the recording materials.

FIG. 12 is a flow chart of counting of the recording materials. More particularly, it is a flow chart of printing job execution by the image forming apparatus 100.

Steps S601 and S602 are the same as S401 and S402 (FIG. 9), and therefore, the description is omitted.

If the CPU 301 detects that the recording material 102 is fed to the first fixing device 150 (S604, Yes) before the printing job is finished (S603, No), the CPU 301 increments the count of the memory 154. The CPU 301 increments the count for the main scan direction length of the fed recording material 102 of the counts stored in the memory 154. The information of the main scan direction length of the fed recording material 102 is acquired by the CPU 301 on the basis of the content of the printing job in step S601. The CPU 301 detects the feeding of the recording material 102 to the first fixing device 150 depending on the signal from the sensor 155.

On the other hand, if the feeding of the recording material 102 to the first fixing device 150 is not detected in step S404, the CPU 301 does not increment the count, and proceeds to S606. This occurs, for example, in the case that after the detection of the passage of the recording material 102, the passage of the next recording material 102 is not detected after elapse of predetermined time, despite the non-completion of the printing job. The predetermined time period is counted by the timer 307.

When the jamming occurs in the image forming apparatus 100 (S606, Yes), the CPU 301 interrupts the printing job. At this time, the jammed recording material stagnating in the feeding path of the image forming apparatus 100 is cleared by the operator, and therefore, the front door 140 or the like is opened.

The CPU 301 waits for the front door 140 to close (S607). When the CPU 301 detects the closing of the front door 140 on the basis of the signal from the opening and closing sensor 305 (S607), the refreshing sequence is carried out (S608).

The refreshing sequence in step S4608 corresponds to the flow shown in FIG. 11. In the refreshing sequence, the memory 154 in the first fixing device 150 is read out as described in the foregoing (S501). The memory 154 is read out because there is a possibility that the first fixing device 150 is exchanged when the front door 140 is opened for the jam clearance.

The step S609 is the same as the step S410, and therefore, the description thereof is omitted.

When the image forming apparatus 100 becomes capable of resuming the image forming operation after the completion of the starting-up operations (Yes, S609), the CPU 301 displays "printable" or the like on the operating portion 180 (S610). By this, the operator is notified of the fact that the image forming apparatus 100 becomes capable of carrying out the image forming operation (S610).

Thereafter, the operation returns to step S603, and the CPU 301 resumes the operations for the remaining printing job and continues up to the completion of the printing job.

If the CPU 301 does not detect occurrence of jamming in the image forming apparatus 100 (S606, No), the CPU 301 discriminates whether or not the total count of the feeding numbers for all of the main scan direction lengths in the memory 154 exceeds the predetermined value (500 in this example) (S611).

In step S611, if the total count exceeds the predetermined value (500 in this example), the CPU 301 proceeds to a step S603, and the printing operation is continued until the printing job is finished.

In step S611, if the total count exceeds the predetermined value (500 in this example), the above-described fixing element refreshing operation is carried out (S612).

When the fixing element refreshing operation is completed, the CPU 301 sets the values for all the main scan direction lengths to zero. That is, the counter values are reset (S613).

Thereafter, the operation returns to step S603, where the CPU 301 continues the printing job until the printing job is finished.

After the printing job is completed (S603, Yes), the CPU 301 shifts to the stand-by mode.

In this embodiment, the counts of the feeding numbers of the recording materials 102 are managed on the memory 154, and the CPU 301 records the counts of the feeding numbers in the memory 154 for each feeding of the recording material 102 to the first fixing device 150. By this, more accurate information of the feeding number can be stored in the memory 154 even when the first fixing device 150 is taken out of the image forming apparatus 100.

As described hereinbefore, the exchange of the first fixing device 150 by the operator necessitates the opening and closing of the front door 140 of the image forming apparatus 100. When the front door 140 of the image forming apparatus 100 is opened by the operator, the first fixing device 150 may be exchanged. In addition, when the main switch 101 is off, the first fixing device 150 may have been exchanged. Therefore, whenever the actuation of the main switch 101 of the image forming apparatus 100 and/or the closure of the front door 140 occurs, the CPU 301 reads the information out of the memory 154 of the first fixing device 150 to acquire the information of the feeding number in the memory 154. The CPU 301 counts the feeding number on the basis of the count stored in the memory 154. By this, the CPU 301 can execute the fixing element refreshing operation for the first fixing device 150 on the basis of more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

Embodiment 3

The image forming apparatus 100 may be set at a mode not executing the above-described fixing element refreshing operation, by the setting of the user. In such a case, the operating portion 180 is provided with a selector which displays for the selection between the mode in which the fixing element refreshing operation is executed and in the mode in which it is not executed. The user is capable of selecting one of the modes through the operating portion 180. The information of the selected mode is stored in the main assembly memory 312 as the set information of the image forming apparatus 100. The operation program to be executed when the fixing element refreshing operation non-executing mode is selected is stored in the ROM 303. When such a mode is selected, the CPU 301 executes the program.

The fixing element refreshing operation is necessary in order to suppress the glossiness non-uniformity due to the difference in the surface roughness between the (I) non-passing portion, the (II) passing portion, and the (III) boundary area of the fixing roller 151, as described hereinbefore. The difference in the surface roughness of the fixing roller 151 appears as the glossiness unevenness when the recording material 102 passes through the nip in contact with the (I) non-passing portion, the (II) passing portion, and the (III) boundary area of the fixing roller 151. Therefore, the glossiness unevenness can be suppressed by using the different fixing device having the same structure, for the respective main scan direction length of the recording material 102 as the first fixing device 150. In view of this, some user who is concerned with the glossiness property evenness prepares the fixing devices for respective main scan direction lengths of the recording materials 102 in order to avoid the deterioration of the print quality.

In such a case, that is, to avoid the glossiness unevenness caused by the edge portions of the recording materials 102, it is desirable not to execute the fixing element refreshing operation to avoid the fine scores provided by the refreshing roller 156, which influences the glossiness property of the image.

By making the modes (execution and non-execution of the fixing element refreshing operation) selectable by the user, the apparatus can meet wider needs of the users.

Embodiment 4

With respect to the Embodiments 1-3, the contact of the end portions of the recording materials 102 with the fixing roller 151 is taken as the cause of the difference in glossiness on the fixed image, but the causes are not limited to that. For example, a separation claw contacting the fixing roller 151 may be provided to prevent the recording material 102 from wrapping around the fixing roller 151.

In such a case, with the cumulation of the fixing process, there is a likelihood that the contact damage may occur by the contact of the separation claw to the surface of the fixing roller 151. In the case that a plurality of separation claws are provided at intervals in the longitudinal direction (axial direction) of the fixing roller 151, the surface of the fixing roller 151 is roughened adjacent to the contact position with separation claw, with the result of unevenness of the surface state over the length of the fixing roller 151. As a result, the glossiness difference may arise on the fixed image.

Even in such a case, the influence to the image quality by the contact damage can be reduced by providing the refreshing roller 156 and executing the fixing element refreshing operation.

Embodiment 5

In Embodiments 1-4, the refreshing roller 156 is provided for the fixing roller 151, and the surface of the fixing member is rubbed, but a rubbing rotatable member may be provided for a surface of a pressing belt 152 and/or a pressing roller 172 to rub the surface of the pressing member.

Embodiment 6

In the exchangeable fixing device system, the user exchanges the fixing devices depending on the kind of the recording material 102 or the user's preference. In such a case, there is a possibility that a better quality print can be provided if the fixing device not selected by the operator is used. That is, there is a likelihood that the advantage of the exchanging system is not enjoyed. In this embodiment, the image forming apparatus 100 notifies the operator of the matching between the selected recording material 102 and the selected fixing device.

In the following, the description will be made referring to an Embodiment 1 (FIGS. 8 and 9). The other structures are the same as in Embodiment 1, and therefore, the detailed description thereof is omitted for simplicity. The description will be made as to the first fixing device 150, but the same applies to the second fixing device 170.

In the memory 154, identifying information indicative of the kind and/or usage (for envelopes, for example) is stored as the identifying information of the first fixing device 150. On the other hand, the main assembly memory 312 stores information (limitation information) indicative of the kinds of the recording material 102 to limit the kinds of the recording material to be processed by the fixing device, in combination (correlation) with the identifying information.

In step S301 of FIG. 8, the CPU 301 reads out the identifying information of the memory 154 of the first fixing device 150 together with reading the data stored in the memory 154 of the first fixing device 150 mounted to the image forming apparatus 100. The CPU 301 determines the kinds of the recording material 102 to be limited for the first fixing device 150, on the basis of the identifying information and the kinds of the recording material 102 stored in the main assembly memory 312.

In step S401 of FIG. 9, when the CPU 301 receives the printing job from the operator, the CPU 301 makes non-selectable the kinds of the recording material 102 not suitable for the first fixing device 150 on the selection screen.

Thus, the printing operation using improper first fixing device 150 can be prevented, thus assuring high quality prints.

The information corresponding to the kinds of the recording material 102 to be limited may be stored in the memory 154 of the first fixing device 150 not that of the main assembly memory 312. In such a case, the CPU 301 reads the kinds of the recording material 102 to be limited out of the memory 154 of the first fixing device 150 together with reading the data out of the memory 154 at step S301. On the basis of the kinds of the recording material 102 to be limited, the CPU 301 acquires the kinds of the recording material 102 to be limited by the first fixing device 150.

In addition, this embodiment may be incorporated in Embodiment 2, although the description is made with respect to the case in which this embodiment is incorporated in Embodiment 1. The description as to the case in which this embodiment is incorporated in Embodiment 2 is omitted, because the foregoing description applies to such a case.

Embodiment 7

In Embodiments 1-6, the CPU 301 makes the memory 154 of the first fixing device 150 and the memory 174 of the second fixing device 170 store the information of the number of the recording materials 102 fed to the first fixing device 150 and the second fixing device 170. The CPU 301 may store the same information also in the main assembly memory 312 in parallel with the writing of the information in the memory 154 and 174.

Embodiment 8

In the foregoing description of Embodiments 1-7, the operating portion 180 is provided with a display screen and a selection key, but the display screen may be a touch panel which also functions as a selector.

Embodiment 9

In the foregoing embodiments, the image forming apparatus 100 comprises both of the first fixing device 150 and the second fixing device 170 (tandem fixing). However, the present invention is applicable to an image forming apparatus 100 comprising only one fixing device 150.

Embodiment 10

In the Embodiments 1-9, the image forming apparatus 100 comprises the image forming stations (120-123) for forming yellow, magenta, cyan and black toner images (color image forming apparatus), but the present invention is applicable to a monochromatic image forming apparatus. For example, there is a monochromatic image forming station for forming the toner images in black only.

Embodiment 11

In the Embodiments 1-10, the image forming apparatus 100 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 100 feeds the recording material 102 from a recording material accommodating portion 103 to the transfer feeding belt. The transfer feeding belt electrostatically attracts the recording material 102 and carries it to a position where the recording material 102 is facing the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

Embodiment 12

(13. General Arrangement of Image Forming Apparatus)

Figure 13:
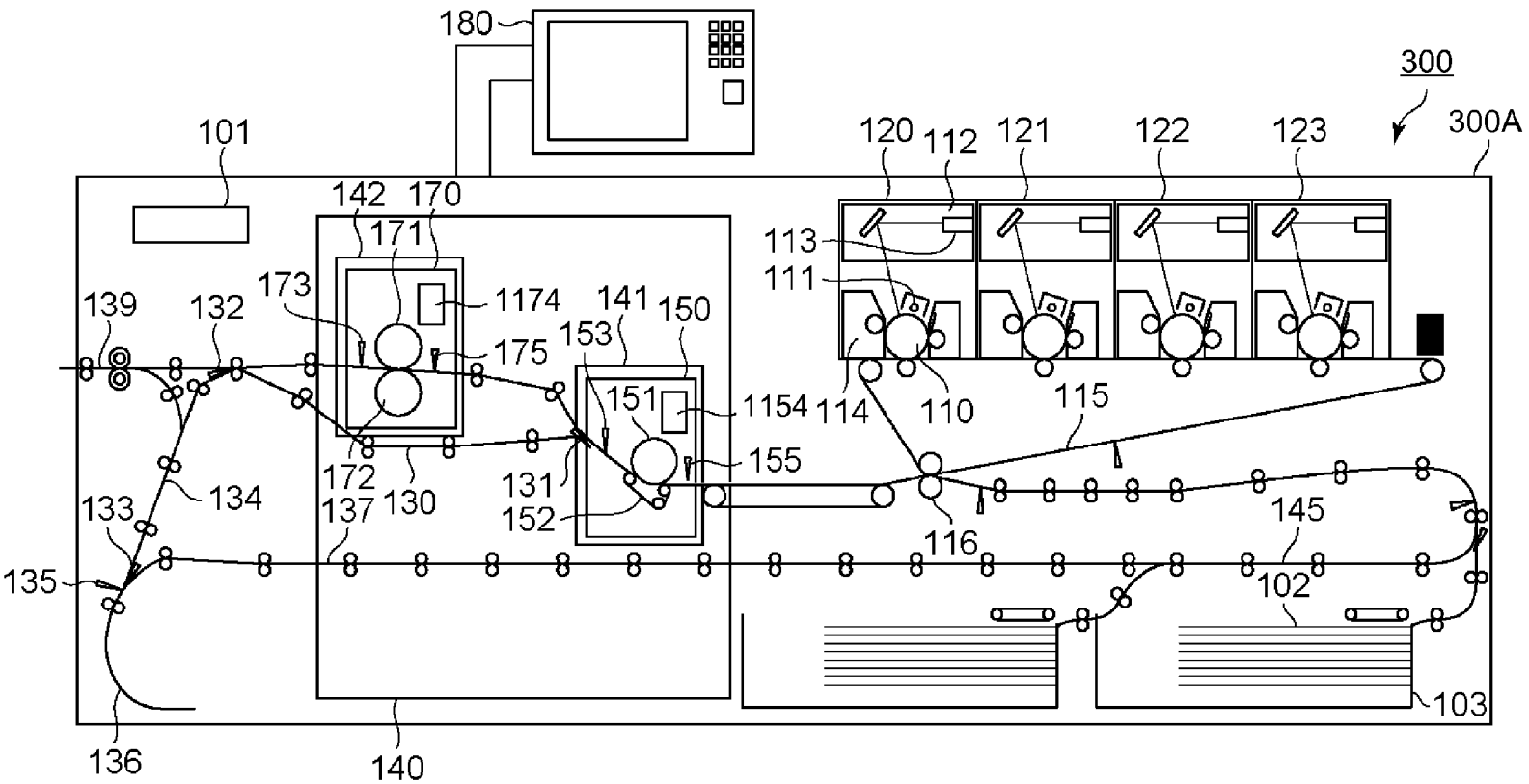
FIG. 13 is a sectional view of an example of an image forming apparatus.

FIG. 13 is a sectional view of an example of an image forming apparatus according to Embodiments 12-23.

In the description of this embodiment, the same reference numerals as in the foregoing embodiments are assigned to the elements having the corresponding functions in this embodiment, and the detailed description thereof is omitted for simplicity. That is, for the description of the image forming apparatus 300, the image forming apparatus 100 of the foregoing embodiments should also read as the image forming apparatus 300.

The front door 140 as an opening and closing portion is provided for the opening of the main assembly 300A of the image forming apparatus 300 for mounting a fixing device (first fixing device 150, second fixing device 170) to a mounting portion (first mounting portion 141, second mounting portion 142).

The image forming apparatus 100 is provided with an opening and closing sensor (optical sensor) 305 (FIG. 14) as a sensor for sensing a closed state of the front door 140. The front door 140 is provided with a projection (unshown), which is inserted into a receiving portion (unshown) of the main assembly 300A of the image forming apparatus 300 by the closing of the front door 140. The CPU 301 detects the closing of the front door 140 on the basis of a signal produced by the opening and closing sensor 305 upon the insertion of the projection into the receiving portion. On the other hand, when no output signal is produced by the opening and closing sensor 305, the CPU 301 detects that the front door 140 is open. In an alternative structure, the CPU 301 detects the opening of the front door 140 on the basis of the signal produced by the opening and closing sensor 305 upon the opening of the front door 140, and the CPU 301 that the front door 140 is closed when the signal from the sensor 305 is not produced.

(14. Structure of Control System)

Figure 14:
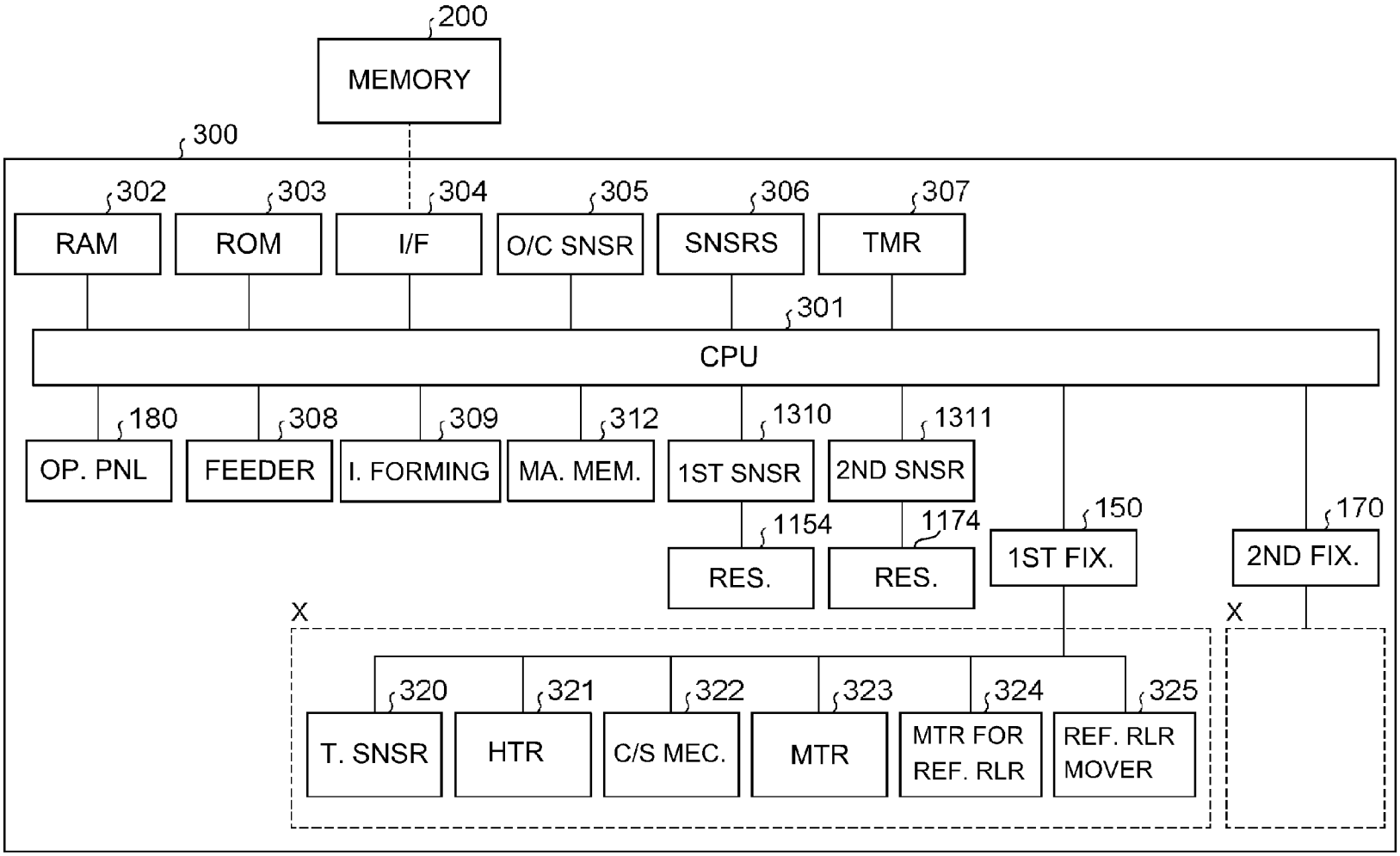
FIG. 14 is a block diagram of a control system.

FIG. 14 is a block diagram of a control system according to Embodiments 12-23. In the description of this embodiment, the same reference numerals as in the foregoing embodiments are assigned to the elements having the corresponding functions in this embodiment, and the detailed description thereof is omitted for simplicity.

The image forming apparatus 300 (FIG. 13) is provided with a CPU 301, a RAM 302, and a ROM 303 for controlling the operation of the image forming apparatus 100.

The CPU 301, functioning as a controller, carries out a basic control of the image forming apparatus 300 by executing control programs stored in the ROM 303. The CPU 301 uses the RAM 302 as a work area for executing the processing of the control program.

The CPU 301 is electrically connected with the RAM 302 and the ROM 303, and various mechanisms to be controlled.

In addition, the CPU 301 functions also as a counter for counting the recording materials 102 fed into the first fixing device 150 or second fixing device 170. The specific structure will be described hereinafter.

An external I/F portion 304 is a communication circuit for communication with an external device connected through a network (LAN and/or WAN). The external device may include a personal computer (PC) or another image forming apparatus or the like.

A storing device 200 is an example of an external device connected with the outside I/F portion 304 through the network. The details will be described with respect to Embodiment 14.

The CPU 301 is connected with the opening and closing sensor 305 to detect whether or not the front door 140 is closed.

A sensor group 306, including sensors 153, 155, 173, and 175, shown in FIG. 13, is disposed along the feeding path, by which the CPU 301 detects the presence, absence, and passing of the recording material 102.

The CPU 301 is connected with the operating portion 180. The CPU 301 receives the instructions of switching of the display content on the display screen and other operations, given by the operator at the selection keys of the operating portion 180. The CPU 301 displays, on the display screen of the operating portion 180, the status of operation of the image forming apparatus 300, an operation mode selected by the selection key, and so on.

In addition, the CPU 301 is connected with a timer 307. The timer 307 function as a clock portion for measuring a time period. As will be described hereinafter, it counts the time for detection of a jammed sheet, and/or for a fixing element refreshing operation.

The CPU 301 is connected with a feeding portion 308 to control feeding of the recording material 102. The feeding portion 308 includes a supply portion for feeding the recording material 102 from the recording material accommodating portion 103 to the feeding path, feeding rollers for feeding the recording material 102 on the feeding path and flappers for the feeding paths.

In addition, the CPU 301 is connected with the image forming station 309, which will be described hereinafter, to control the image forming station 309.

The CPU 301 is connected with a first resistance detecting portion 1310, which will be described hereinafter, to identify the first fixing device 150 mounted in the image forming apparatus 300. When the first fixing device 150 is mounted in the image forming apparatus 300, the first resistance detecting portion 1310 is electrically connected with a resistor 1154 of the first fixing device 150.

The CPU 301 is connected with a second resistance detecting portion 1311 to identify the second fixing device 170 mounted in the image forming apparatus 300. When the second fixing device 170 is mounted in the image forming apparatus 300, the second resistance detecting portion 1311 is electrically connectable with a resistor 1174 of the second fixing device 170.

The CPU 301 is connected with a main assembly memory 312. The main assembly memory 312 is rewritable non-volatile memory and may be integral with the RAM 302.

The CPU 301 is connected with a mechanism group X of the first fixing device 150 mounted in the image forming apparatus 100 to effect a temperature adjustment control and fixing element refreshing operation. The mechanism group X includes a temperature sensor 320, a heater 321, a moving mechanism 322, a motor 323, and a refreshing roller moving mechanism 325.

The temperature sensor 320 includes a plurality of temperature sensors provided in the first fixing device 150, including a thermister 159 (FIG. 3), and a thermister (unshown) for the pressing belt 152.

The heater 321 includes a plurality of heaters provided in the first fixing device 150, including a halogen heater 161 (FIG. 3), and a halogen heater (unshown) provided in the heating roller 163.

The CPU 301 is connected with a mechanism group X of the second fixing device 170 mounted in the image forming apparatus 300 to effect temperature adjustment control and the fixing element refreshing operation. The mechanism group X for the second fixing device 170 is substantially the same as the mechanism group X of the first fixing device 150, and therefore, the detailed description thereof is omitted by applying the same reference numerals to the corresponding elements. (In the description of the mechanism group X for the first fixing device 150, the first fixing device 150, the pressing belt 152, and the heating roller 163 correspond to the second fixing device 170, the pressing roller 172, and the pressing roller 172, respectively).

In this embodiment, the mechanisms are controlled by the CPU 301. Alternatively, however, the use can be made with CPU circuit portions for controlling the respective mechanisms, and a main CPU circuit portion connected with the respective CPU circuit portions to effect the overall control.

(15. Image Forming Station)

The image forming apparatus 300 comprises stations 120, 121, 122 and 123 as the image forming station 309 (FIG. 13), an intermediary transfer belt 115 as an intermediary transfer member, and a transfer roller 116 as a transfer portion. The image forming stations are the same as those of Embodiment 1, and therefore, in the description of this embodiment, the same reference numerals as in Embodiment 1 are assigned to the elements having the corresponding functions in this embodiment, and the detailed description thereof is omitted for simplicity.

(16. Fixing Portion)

(16.1. Tandem Fixing)

The first fixing device 150 and the second fixing device 170 as the fixing portion fix the toner image transferred onto the recording material 102 by applying heat and pressure to the recording material 102 (FIG. 13).

The second fixing device 170 is disposed downstream of the first fixing device 150 with respect to the feeding direction of the recording material 102. The second fixing device 170 functions to provide the toner image fixed on the recording material 102 by the first fixing device 150 with glossiness and/or to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130 bypassing the second fixing device 170, for the purpose of reducing the energy consumption. For example, this occurs in the case that the recording material 102 is plain paper or thin sheet, and high glossiness is not desired. As to whether to feed the recording material 102 into the second fixing device 170 or to feed the recording material 102 bypassing the second fixing device 170 (bypass route), the CPU 301 controls such an operation by switching the flapper 131.

(16.2. Structure of Fixing Device)

The first fixing device 150 and the second fixing device 170 are detachably mountable to the first mounting portion 141 and the second mounting portion 142 (collectively, the mounting portion) of the image forming apparatus 300, respectively. The first fixing device 150 and a second fixing device 170 can be replaced with the fixing devices having the following structures, respectively.

The first fixing device 150 is provided with a resistor 1154 as a discrimination portion. The second fixing device 170 is provided with a resistor 1174 as a discrimination portion. The details will be described hereinafter.

The first fixing device 150 is provided with sensors 153 and 155 as a jam detecting portion, and the second fixing device 170 is provided with sensors 173 and 175 as a jam detecting portion. The details will be described hereinafter. For the respective fixing devices, the upstream sensors 155, 175 with respect to the feeding direction of the recording material 102 functions also as detecting portions for detecting the feeding of the recording material 102 to the respective fixing devices. The details will be described hereinafter.

FIG. 3 is a sectional view of an example of a fixing portion. In the description of this embodiment, the same reference numerals as in the foregoing embodiments are assigned to the elements having the corresponding functions in this embodiment, and the detailed description thereof is omitted for simplicity.

The following description will be made with respect to the first fixing device 150, but the same applies to the second fixing device 170 unless otherwise described (i.e., the structures of the first fixing device 150 apply to the structures of the second fixing device 170).

In this embodiment, the structures of the pressing sides of the first fixing device 150 and the second fixing device 170 are different, but they may be the same. More particularly, the pressing side structures of the first fixing device 150 and the second fixing device 170 may use pressing belts or pressing rollers. The pressing side of the first fixing device 150 may be a pressing roller, and the pressing side of the second fixing device 170 may be a pressing belt.

(16.3. Refreshing Roller)

As to the refreshing roller 156 as the rubbing rotatable member for rubbing the surface of the rotatable member, the description with respect to Embodiment 1 applies, and therefore, the detailed description thereof is omitted for simplicity (see 4.3 Refreshing roller).

(17. Glossiness Unevenness at the Widthwise End Portion of the Recording Material)

The reason for the necessity of the fixing element refreshing operation has been described with respect to Embodiment 1, and therefore, the description thereof is omitted (see 5. Glossiness unevenness produced by end portions of the recording material).

(18. Fixing Roller Refreshing Operation)

As described in the foregoing, when the recording materials 102 pass through the nip repeatedly, the unevenness of the surface state is produced in the longitudinal direction of the fixing roller 151 (the direction of the rotational axis).

In view of this, in the image forming apparatus 300, after a predetermined number of recording materials 102 are fed into the first fixing device 150, the fixing element refreshing operation for improving the surface state of the fixing roller 151 is carried out. The fixing element refreshing operation is the same as that of Embodiment 1, and therefore, the description thereof is omitted (see 6. Fixing roller refreshing operation; 6. 1. Recording material counting method; 6. 2. Fixing roller refreshing operation).

(19. Effects of the Fixing Element Refreshing Operation)

As to the effects of the fixing element refreshing operation, the description in Embodiment 1 applies, and therefore, the description thereof is omitted for simplicity (see 7. Effects of fixing element refreshing operation).

(20. Stand-by Mode)

The stand-by mode is a state in which the image forming apparatus 300 is in the state capable of starting of the image forming operation and waits for the printing instructions (printing job) by the operator. The operating portion 180 receives the printing job, including information regarding the kind of recording material 102 (surface property, basis weight, size or the like) on which the image is to be formed, the number of prints, and one-side printing/both side printing. The details thereof are the same as with Embodiment 1, and therefore, the description thereof is omitted (see 8. Stand-by mode) (the image forming apparatus 100 of the foregoing embodiments should read as the image forming apparatus 300).

(21. Fixing Device Exchanging System)

The fixing device is exchangeable system of this embodiment is the same as that of Embodiment 1, and therefore, the description thereof is omitted for simplicity (see 9. Fixing device exchanging system).

(22. Discrimination Portion of Fixing Device and Main Assembly Memory)

In this embodiment, the first fixing device 150 is provided with a resistor 1154 as a discrimination portion, and the second fixing device 170 is provided with a resistor 1174 as a discrimination portion.

The fixing device prepared outside the image forming apparatus 300 as a replacement fixing device is also provided with a resistor as a discrimination portion.

These resistors (provided on the first fixing device 150, the second fixing device 170, and the replacement fixing device) have resistances which are different from each other for identifying the respective developing devices, and function as discrimination portions.

In addition, the image forming apparatus 300 is provided with a main assembly memory 312 as a storing portion. The main assembly memory 312 is a rewritable non-volatile memory, a typical example of which is EEPROM, flash memory, or the like. However, it may be integral with RAM 302 if it is rewritable and non-volatile.

In the following, the description will be made as to the first fixing device 150, but it applies to the second fixing device 170.

(22.1. Discriminating Method for Fixing Device)

In the state that the first fixing device 150 is mounted in the image forming apparatus 300, the CPU 301 detects the current flowing through the resistor 1154 when the regular voltage is applied to the resistor 1154. More particularly, the image forming apparatus 300 is provided with an ammeter as a first resistance detecting portion 1310, the ammeter being effective to detect the current flowing between the resistor 1154 and the voltage application portion at which the regular voltage is applied to the resistor 1154. The CPU 301 monitors the output of the ammeter.

When the regular voltage is applied, the current corresponds to the resistance value one by one because of the Ohm's law. The CPU 301 acquires an output of the ammeter predetermined resistance of the resistor 1154. The first fixing device 150 and the replacement fixing device have resistors having different resistance values, and therefore, the CPU 301 is capable of discriminating the fixing device depending on the difference of the output of the ammeter. Thus, the resistance value is the identifying information.

The discrimination of the first fixing device 150 on the basis of the resistance of the resistor 1154 by the CPU 301 is called "discrimination (acquirement) of ID of the first fixing device 150 (fixing device)" in the following description.

The structure of the second resistance detecting portion 1311 is the same as that of the first resistance detecting portion 1310, and therefore, the description thereof is omitted. In addition, the same applies to the second fixing device 170, and therefore, the description is omitted.

The CPU 301 may use the output of the ammeter as the identifying information without acquiring the resistance value of the resistor 1154. That is, the CPU 301 may record the output of the ammeter in the main assembly memory 312 as in the ID of the fixing device.

In this embodiment, the discrimination portion includes a resistor, but the discrimination method is not limited to the above-described examples. For example, DIP switches are usable as the discrimination portion provided on the fixing device (first fixing device 150, second fixing device 170, and replacement fixing device). In such a case, the switches different depending on whether the individual fixing devices are in an ON state beforehand (the on-off state and position of the switches are different depending on the fixing devices). The CPU 301 is connected with the DIP switch of the fixing device mounted in the image forming apparatus 300, and the switch in the ON state produces a signal to the CPU 301 in response to an input signal from the CPU 301. The CPU 301 detects the signal from the ON state switch (acquires the fixing device ID) to discriminate the fixing device. For example, when the CPU 301 supplies signals to the first and second switches, and detects the output signal from the first switch, the CPU 301 discriminates it is the fixing device A, when the CPU 301 detects the output signal from the second switch, it is the fixing device B, and when the CPU 301 detects the signals from both of the first and second switches, it is the fixing device C.

As another method for discriminating the fixing device from the replacement fixing device, the discrimination portion on the fixing device (first fixing device 150, second fixing device 170, or replacement fixing device) may be a memory storing the discrimination name (identifying information) of the fixing device. In such a case, the memory is a rewritable non-volatile memory such as EEPROM, flash memory, or the like. The CPU 301 is connected with the memory of the fixing device mounted in the image forming apparatus 300, and the CPU 301 discriminates the fixing device by reading the discrimination name of the fixing device stored in the memory (by acquiring the fixing device ID).

(22.2. Reason for the Provision of the Fixing Device Discrimination Portion)

The resistors (discrimination portions) are provided on the group of the fixing devices including the first fixing device 150 and the second fixing device 170 to provide a solution to the following problem. The problem arises when the first and/or second fixing device is once taken out of the apparatus 300, and then the fixing device is remounted in the image forming apparatus 300. The following description will be made taking the first fixing device 150 as an example, but the same applies to the second fixing device 150. The following description is applied also to the second fixing device 170.

More particularly, the following situation may occur. That is, the fixing device to be replaced is the first fixing device 150.

For example, the first fixing device 150 carries out the fixing element refreshing operation after 500 recording materials 102 are processed (after the feeding number becomes 500). That is, the predetermined number is 500. In the case that the fixing device A, which is not exclusively for envelopes, is mounted in the main assembly of the apparatus as the first fixing device 150, printing on 450 sheets of recording material 102 (on A4 size plain paper longitudinally fed, for example) is carried out. Thereafter, the operator is required to print on envelopes, and then the operator removes the fixing device A from the image forming apparatus 300 to mount the fixing device B exclusively for envelopes. The operator carries out the printing job including 50 envelopes with the fixing device B mounted as the first fixing device 150.

The CPU 301 counts the feeding number of the recording materials 102 into the first fixing device 150 by the counter provided in the main assembly 300A of the image forming apparatus 300, and the fixing element refreshing operation is executed after the feeding number exceeds the predetermined number. That is, the CPU 301 executes the fixing element refreshing operation after the feeding number exceeds in the predetermined number, irrespective of whether the fixing device mounted as the first fixing device 150 is the fixing device A or the fixing device B. Therefore, when the fixing device 150 is switched from the fixing device A to the fixing device B, the CPU 301 discriminates that the feeding number to the first fixing device exceeds 500 when the 50 sheets are processed by the fixing device B, and carries out the fixing element refreshing operation for the fixing device B only. Then, the CPU 301 discriminates that the fixing element refreshing operation after feeding of 500 sheets has been completed.

Some days later, when the operator is going to print on the recording material 102 (plain paper, for example) other than the envelope, the operator changes the fixing device 150 by remounting the fixing device A. The operator then executes a printing job of 50 sheets (on A4 size plain paper longitudinally fed, for example).

The fixing device A has already processed 450 sheets in the previous operation, and therefore, the uneven surface state of the fixing roller arises with respect to the longitudinal direction upon only 50 sheets being processed. If the next printing job is carried out (on A4 size plain paper longitudinally fed, for example), the glossiness unevenness occurs on the outputted image, that is, the image quality is significantly deteriorated.

In view of this, the resistor 1154 is provided on the first fixing device 150 in this embodiment. In the above-described situation, for example, the fixing device A is provided with a resistor having a resistance R1, and the fixing device B is provided with a resistor having a resistance R2 which is different from R1.

The CPU 301 stores the information indicative of the number of the recording materials 102 fed to the first fixing device 150 in correlation with the ID (fixing device identifying information) of the fixing device in the main assembly memory 312. FIG. 19 illustrates an example of information stored in the main assembly memory 312.

(22.3. Count on the Basis of the Information Stored in the Main Assembly Memory)

The CPU 301, as the counter, counts of the feeding number of the recording materials 102 fed to the first fixing device 150 in correlation with the information corresponding to the ID of the first fixing device 150 stored in the main assembly memory 312.

By doing so, the CPU 301 can execute the fixing element refreshing operation for the first fixing device 150 on the basis of the more accurate feeding number. Therefore, the deterioration of the image quality on the output recording material 102 can be suppressed.

The structure of this embodiment will be described in more detail.

Upon the operator remounting the first fixing device 150, the CPU 301 acquires the ID of the fixing device from the first fixing device 150. The mounting of the first fixing device 150 will be described hereinafter. The CPU 301 acquires, from the main assembly memory 312, the information of the feeding number corresponding to the ID of the fixing device acquired from the first fixing device 150.

If the information acquired from the main assembly memory 312 exceeds the predetermined number, the CPU 301 executes the refresh operation. If not, the CPU 301 increases the count of the feeding number of the recording materials 102 to the first fixing device 150, continuing from the feeding number stored in the main assembly memory 312, on the RAM 302. For example, when the information acquired from the main assembly memory 312 is 30, the CPU 301 increases the count to 31, 32, 33, and so on, for each feeding of the recording material 102 to the first fixing device 150, and stores the count in the RAM 302. When the count on the RAM 302 exceeds the predetermined number, the CPU 301 executes the fixing element refreshing operation. In this embodiment, the feeding of the recording material 102 into the first fixing device 150 is detected by the sensor 155. After executing the fixing element refreshing operation, the CPU 301 resets the count on the RAM 302.

The count per one sheet may be weighted depending on the length of the recording material 102 measured in the feeding direction. That is, the count value incremented on the RAM 302 or stored in the main assembly memory 312 as the reference for executing the fixing element refreshing operation may be any data that corresponds to the recording material feeding number into the first fixing device 150. In this case, similarly to the information relating to the length of the recording material 102 in the main-scanning direction, the information of the length of the recording material 102 in the feeding direction is acquired from the content of the printing job received by the CPU 301. The degree of the weighting is prestored in the ROM 303 and is acquired by the CPU 301.

The method for counting the feeding number on the basis of the information of the main assembly memory 312 is not limited to that described above. For example, the CPU 301 may count the number of the recording materials 102 fed into the first fixing device 150, by renewing and recording the information of the feeding number of the main assembly memory 312 of the first fixing device 150 for each feeding of the recording material 102 into the first fixing device 150. Here, the information of the feeding number in the main assembly memory 312 renewed by the CPU 301 is correlated with the ID of the first fixing device 150 mounted in the image forming apparatus 300. The CPU 301 counts the information of the feeding number stored in the main assembly memory 312. Also in this case, therefore, the CPU 301, as the counter, counts the feeding number of the recording materials 102 into the first fixing device 150 on the basis of the information in the main assembly memory 312 correlated with the ID of the first fixing device 150 mounted in the main assembly 300A.

The CPU 301 may count the feeding number plus the feeding number acquired from the main assembly memory 312 up to the predetermined number. More particularly, when the information acquired from the main assembly memory 312 is 30, the CPU 301 increments the count by one on the RAM 302 for each feeding of the recording material 102 into the first fixing device 150. Assuming that the predetermined number is 500, the CPU 301 discriminates exceeding of the predetermined number, when the count on the RAM 302 reaches 470.

The reference on which the fixing element refreshing operation is executed may not be the number of the sheets of the recording material 102 fed into the first fixing device 150. For example, it may be a total of the lengths of the recording materials 102 in the feeding direction fed into the first fixing device 150. In this case, the main assembly memory 312 stores the total length of the recording materials 102 fed into the first fixing device 150 in correlation with the ID of the first fixing device 150. The CPU 301 adds the length of the recording material 102 in the feeding direction fed into the first fixing device 150 to the value acquired from the main assembly memory 312. When the value exceeds the predetermined length, the CPU 301 executes the fixing element refreshing operation.

In addition, for example, as the reference on which the fixing element refreshing operation is executed, the time period in which the fixing roller 151 is fixing the image may be counted and stored in the main assembly memory 312 in correlation with the ID of the first fixing device 150. In this case, the reference on which the fixing element refreshing operation is executed is also time period (4000 sec, for example). The time period in which the fixing roller 151 is in contact with the pressing belt 152 is counted by the timer (clock) 307. More particularly, the CPU 301 sets the timer 307 at an initial value acquired from the main assembly memory 312 as the initial fixing period. The timer 307 counts the time period in which the fixing roller 151 is in contact with the pressing belt 152, continuing from the set initial value. When the value of the timer 307 exceeds the predetermined time period, the CPU 301 executes the fixing element refreshing operation. Alternatively, the initial value of the timer 307 may be zero, in which the CPU 301 adds the time counted by the timer 307 to the time stored in the main assembly memory 312, so that the total image fixing period of the fixing roller 151 is obtained.

Also when no information of the feeding number is stored in the main assembly memory 312 (zero), the CPU 301 deems the information of the feeding number stored.

The main assembly memory 312 may store the information other than the feeding number information. For example, the information indicative of the usage of a kind of the recording material processed by the first fixing device 150, such as an envelope or an A4 size sheet, may be stored. In addition, in the case that the fixing device mountable to the first mounting portion 141 and the fixing device mountable to the second mounting portion 142 are different from each other, the information indicative of whether the fixing device is mountable to the first mounting portion 141 or to the second mounting portion 142 may be stored.

Furthermore, the main assembly memory 312 may store the information for a plurality of fixing devices.

(22.4. Mounting of Fixing Device)

The mounting of the first fixing device 150 will be described.

When the first fixing device 150 is to be exchanged, the operator opens the front door 140, and draws the first fixing device 150 out of the image forming apparatus 300. Then, the first fixing device 150 is moved in the opposite direction to set it in the image forming apparatus 300, and the front door 140 is closed.

The CPU 301 detects that the front door 140 is closed, on the basis of the signal from the opening and closing sensor 305. The CPU 301 confirms the electrical conduction state between the image forming apparatus 300 and the first fixing device 150, with the detection of the closure of the front door 140, by which the mounting of the first fixing device 150 in the image forming apparatus 300 is confirmed.

If the fixing device is exchanged in the OFF-state of the main switch 101, the opening and closing sensor 305 is unable to detect in the closure of the front door. Therefore, the CPU 301 confirms the electric conduction state between the image forming apparatus 300 and the first fixing device 150 with the actuation of the main switch 101, by which the mounting of the first fixing device 150 in the image forming apparatus 300 is confirmed.

More particularly, the image forming apparatus 300 is provided with an ammeter, and the CPU 301 monitors an output of the ammeter, so that it can detect that the electric current flows. When the first fixing device 150 is mounted in the image forming apparatus 300, the ammeter and the first fixing device 150 are electrically connected with each other. By this, the ammeter is capable of detecting the current flowing to the first fixing device 150 when the first fixing device 150 is supplied with a predetermined voltage. If the ammeter detects the electric current upon the application of the predetermined voltages to the first fixing device 150, it means that the image forming apparatus 300 and the first fixing device 150 are electrically connected with each other, and therefore, the CPU 301 discriminates that the first fixing device 150 is mounted. On the other hand, if the ammeter does not detect the electric current upon the application of the predetermined voltage to the first fixing device 150, the first fixing device 150 is not electrically connected with the image forming apparatus 300, and therefore, the CPU 301 discriminates that the first fixing device 150 is not mounted. The measurement of the current by the ammeter may also detect the resistance value of the resistor 1154, which will be described hereinafter.

The method for discriminating whether or not the first fixing device 150 is mounted is not limited to the above-described method.

For example, the first fixing device 150 is provided with a signal output portion (memory and/or CPU, for example) for outputting a signal in response to an input signal from the CPU 301. The CPU 301 supplies the signal to the signal output portion, upon the detection of the closure of the front door 140. The CPU 301 may confirm the mounting of the first fixing device 150 by detecting the signal outputted in response to the input of the signal to the signal output portion. The CPU 301 discriminates that the first fixing device 150 is not mounted if the signal to be outputted upon the input of the signal to the signal output portion is not detected.

(22.5. Count for Each Width Size)

Furthermore, in this embodiment, the feeding number is stored for each widthwise size of the recording material 102. FIG. 19 shows an example in which the feeding numbers are stored for each 5 mm main scan direction length of the recording material 102. The widthwise size measured in the direction perpendicular to the feeding direction of the recording material 102 is called the main scan direction length (or width size).

As described hereinbefore, the roughened area in the (III) boundary area is produced by the edge portions of the recording materials 102 repeatedly contacting the same position of the fixing roller 151 with respect to the direction of the rotational axis of the fixing roller 151. That is, the roughened area is produced with the increase of the feeding number of the recording materials 102.

By the fixing element refreshing operation, the surface state of the fixing roller 151 is uniformized in the entirety of the longitudinal range (i.e., the (I) non-passing portion, the (II) passing portion, and the (III) boundary area). Therefore, the unevennesses of the surface state of the fixing roller 151 produced by the edge portions of the recording materials 102 having different main scan direction lengths are also eliminated.

Therefore, in this embodiment, the number of the recording materials 102 fed into the first fixing device 150 is stored for each 5 mm of the main scan direction length of the recording material 102 in the main assembly memory 312. When the feeding number for any one of the main scan direction lengths exceeds the predetermined number (500, in this example), the CPU 301 executes the fixing element refreshing operation. Thereafter, the feeding numbers for all of the main scan direction lengths are reset (zero). When the feeding number for any one of the main-scanning lengths exceeds the predetermined number, the CPU 301 executes the fixing element refreshing operation.

The information of the main scan direction length of the recording material 102 is acquired from the content of the printing job received by the CPU 301. When the operating portion 180 receives the printing job from the operator, it also receives the size of the recording material 102 (A3, for example) on which the image is to be formed, as one of the contents of the printing job.

By this, the glossiness unevenness on the output images can be suppressed, and also, the frequency of the fixing element refreshing operations is made lower than when the fixing element refreshing operation is carried out irrespective of the main scan direction length of the recording material 102.

(23. Control Flow)

In this embodiment, the CPU 301 counts on the RAM 302 and stores in the main assembly memory 312 the feeding number of the recording materials 102 fed into the first fixing device 150 for each main scan direction length (for each widths). When the count of the recording material 102 for any one of the main scan direction lengths exceeds the predetermined value during the printing operation, the fixing element refreshing operation is carried out after completion of the currently executed printing job, and then the apparatus shifts into the stand-by mode. That is, if the count at the time of the completion of the image forming operation exceeds the predetermined value, the fixing element refreshing operation is executed after the completion of the current printing job. In addition, the CPU 301 acquires the ID of the first fixing device 150 from the resistor 1154 when the main switch is actuated or when the front door 140 is closed. The CPU 301 executes the fixing element refreshing operation, when the count of the feeding number corresponding to the ID of the first fixing device 150 for any one of the main scan direction lengths in the feeding number information stored in the main assembly memory 312 exceeds the predetermined value. Thereafter, the apparatus shifts to the stand-by mode.

The description will be made in conjunction with the flow charts of FIGS. 15-18.

The operations of the flow charts are carried out by the CPU 301 functioning as the executing portion (recording portion) controlling the related mechanisms of the image forming apparatus 300 in accordance with the control program stored in the ROM 303. The description will be made as to the first fixing device 150, but the same applies to the second fixing device 170.

(23.1. Sequence Upon Actuation of the Main Switch and Upon Closing the Front Door)

Figure 15:
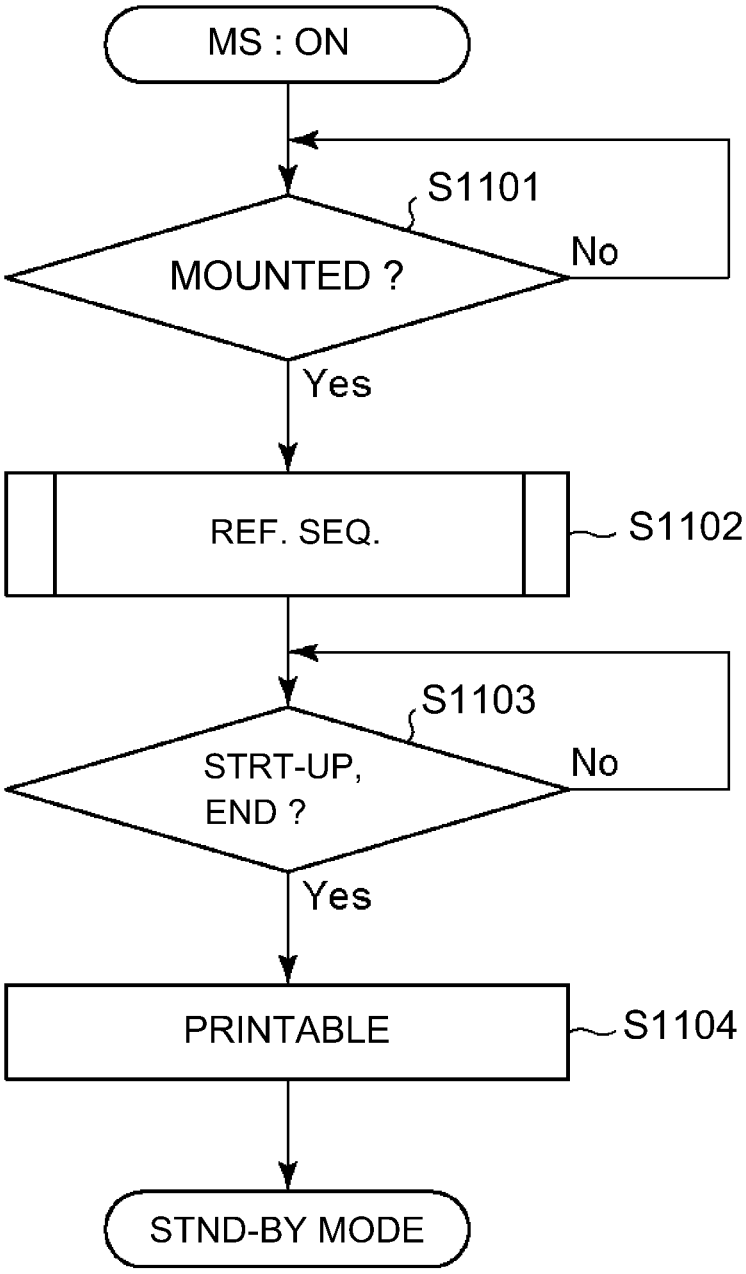
FIG. 15 is a flow chart showing the operations from the actuation of a main switch to a stand-by mode.

FIG. 15 is a flow chart showing the operations from the actuation of a main switch to a stand-by mode.

With the actuation of the main switch 101, the CPU 301 starts. The CPU 301 discriminates whether or not the first fixing device 150 is mounted in the image forming apparatus 300 (S101). If the first fixing device 150 is mounted on the apparatus, the CPU 301 can detect the ID of the fixing device. If the first fixing device 150 is not mounted, the operation returns to step S1101. In such a case, the CPU 301 may display a message, prompting the insertion of the first fixing device 150, on the operating portion 180. If the first fixing device 150 is mounted in the image forming apparatus 300, the operation proceeds to step S1102.

Figure 17:
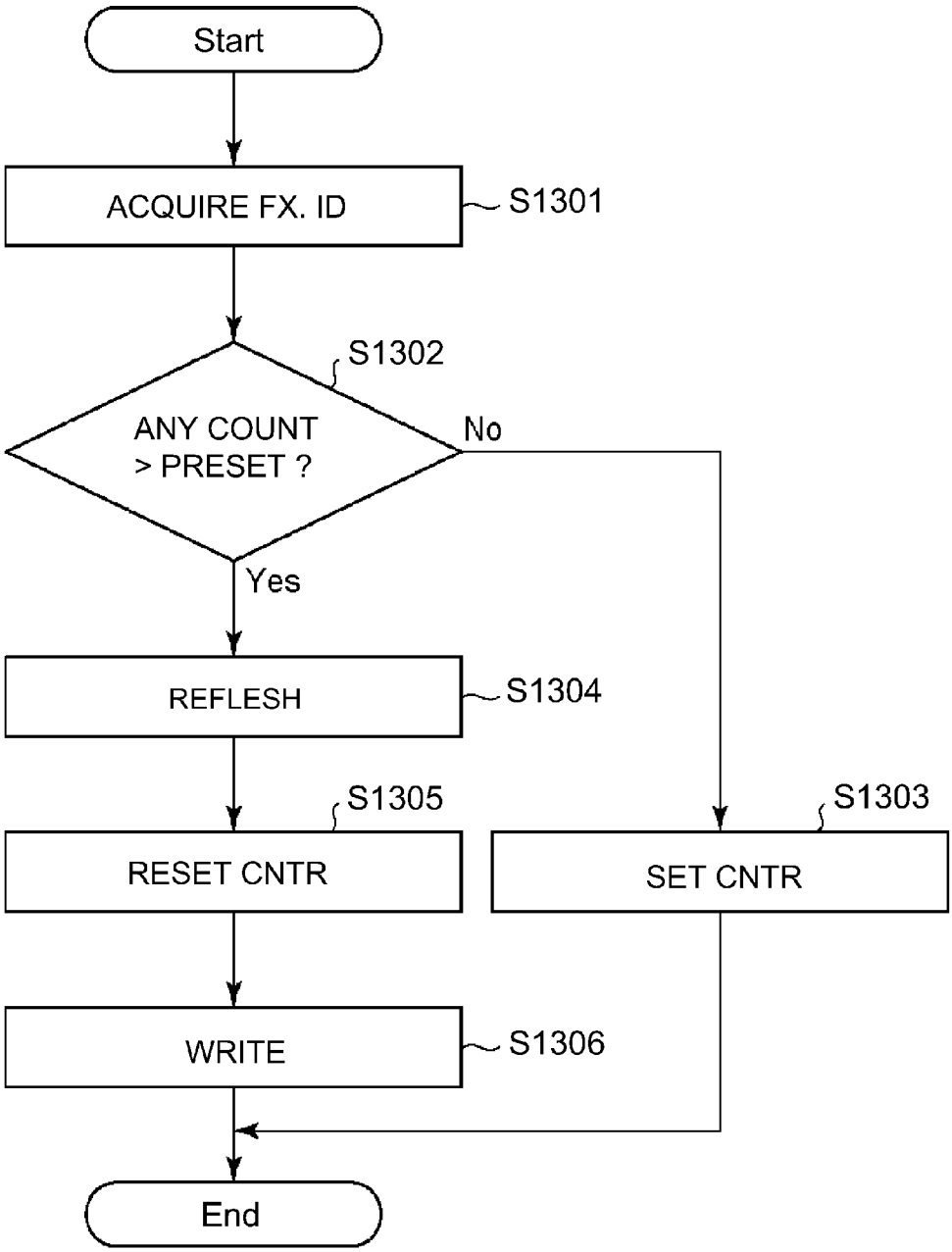
FIG. 17 is a flow chart of a refreshing sequence.

The CPU 301 carries out the refreshing sequence shown in FIG. 17 for the first fixing device 150. The details of the operation will be described hereinafter.

In step S1103, the CPU 301 waits for the image forming apparatus 300 to become capable of carrying out the image forming operation. The CPU 301 carries out the preparing operation (starting-up operation) for the start of the image forming operation for various mechanisms, such as the first fixing device 150 and the image forming stations 309, after the actuation of the main switch 101. The temperature control for the fixing roller 151 is one of them, for example.

When the image forming apparatus 300 becomes capable of carrying out the image forming operation after the completion of the starting-up operations (Yes, S1103), the CPU 301 displays "printable" or the like on the operating portion 180 (S1104). By this, the operator is notified of the fact that the image forming apparatus 300 has become capable of carrying out the image forming operation. The apparatus is shifted into the stand-by mode.

Figure 16:
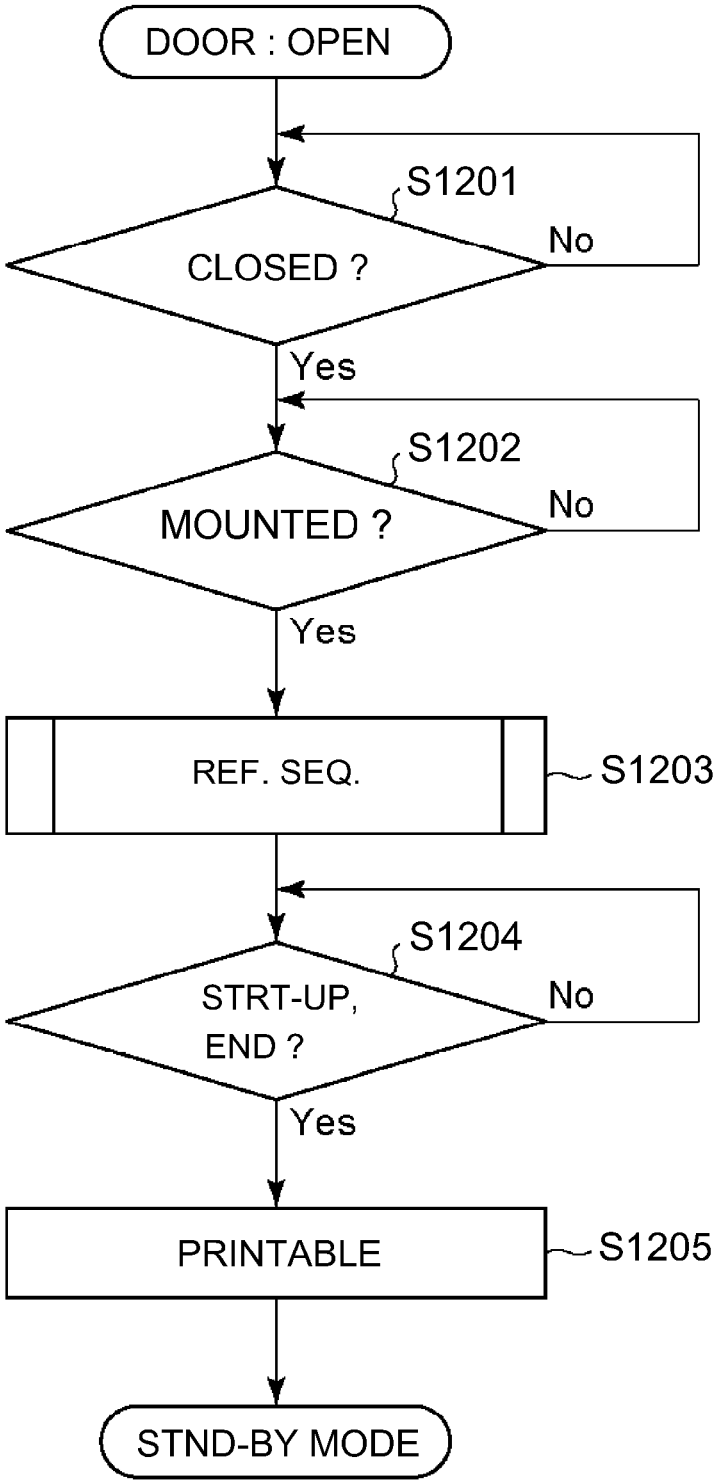
FIG. 16 is a flow chart showing the operations from the state in which a front door is open to the stand-by mode.

FIG. 16 is a flow chart showing the operations from the state in which a front door is open to the stand-by mode.

The opened and closed states of the front door 140 are detected by the CPU 301 on the basis of the signal from the opening and closing sensor 305 of the front door 140. When the front door 140 is open, the CPU 301 waits for the closing of the front door 140 (S1201). When the front door 140 is open, the CPU 301 may display information to prompt the operator to close the front door 140. When the CPU 301 detects the closing of the front door 140 (S1201), the operation proceeds to step S1202. Steps S1202-S1205 are the same as steps S1101-S1104 of FIG. 15, and therefore, the description thereof is omitted. After step S1205, the operation proceeds to the stand-by mode.

(23.2. Refreshing Sequence)

FIG. 17 is a flow chart of a refreshing sequence. The flow chart of FIG. 17 shows steps S1102 and S1203, and the details of the refreshing sequence, which will be described hereinafter.

First, the CPU 301 acquires the ID of the first fixing device 150 mounted in the image forming apparatus 300 to identify the fixing device (S1301). The details of the method for acquiring the ID have been described in the foregoing, and therefore, the description thereof is omitted.

The CPU 301 makes the discrimination in step S1302 on the basis of the feeding number information corresponding to the ID of the fixing device acquired in step S1301 in the information stored in the main assembly memory 312. In the main assembly memory 312, the information indicative of the feeding numbers for each 5 mm of the main scanning direction length of the as shown in FIG. 19 is stored, for example.

If the feeding number information (counts in the main assembly memory 312) corresponding to the ID of the fixing device is less than the predetermined number (predetermined value) (500 in this example) for all of the main scan direction lengths of the recording materials 102, the operation proceeds to step S1303 (S1302).

The CPU 301 sets the value of the feeding number (value stored in the main assembly memory 312) for each of the main scan direction lengths for the ID of the fixing device as the value of the counter, in the RAM 302 for each of the main scan direction lengths (S1303).

On the other hand, in step S1302, the CPU 301 proceeds to step S1304, if a value (count) of the feeding number of the recording materials 102 for any one of main scan direction lengths corresponding to the ID of the fixing device exceeds the predetermined value (500 in this example).

In step S1304, the CPU 301 executes the above-described fixing element refreshing operation. By this, the surface of the fixing roller 151 is rubbed, so that the surface state is made even.

After the completion of the fixing element refreshing operation, the CPU 301 sets the counts for the respective main scan direction lengths to zero. That is, the value on the RAM 302 is reset (S1305).

The CPU (recording portion, writing portion) 301 records in the main assembly memory 312 that the feeding numbers for all of the main scan direction lengths are zero as the information of the feeding number, in correlation with the ID of the fixing device (S1306). More particularly, the values on the RAM 302 set in step S1305 are copied in the main assembly memory 312 in correlation with the main scan direction lengths and the ID of the fixing device. By this, the CPU 301 is capable of executing the fixing element refreshing operation when the feeding number for any of the main scan direction lengths exceeds the predetermined value (500 in this example) after the execution of the fixing element refreshing operation again. After the execution of the fixing element refreshing operation, the CPU 301 sets the feeding numbers for all of the main scan direction lengths corresponding to the ID of the first fixing device 150 in the main assembly memory 312, to zero. By this, the information indicative of the execution of the fixing element refreshing operation is recorded in the main assembly memory 312 in correlation with the ID of the first fixing device 150. In this manner, the fixing element refreshing operation can be carried out repeatedly, for each exceeding of the feeding number for any one of the main scan direction lengths of the recording materials 102. The information of the number may be written in the main assembly memory 312 in step S1306 with the CPU 301 detecting the opening of the front door 140 on the basis of the signal from the opening and closing sensor 305 in the stand-by mode state. In addition, the information of the feeding number may be written in the main assembly memory 312 in step S1306 with the deactuation of the main switch 101. This is because the exchange of the first fixing device 150 necessitates the opening of the front door 140.

(23.3. Sequence for Recording Material Counting)

Figure 18:
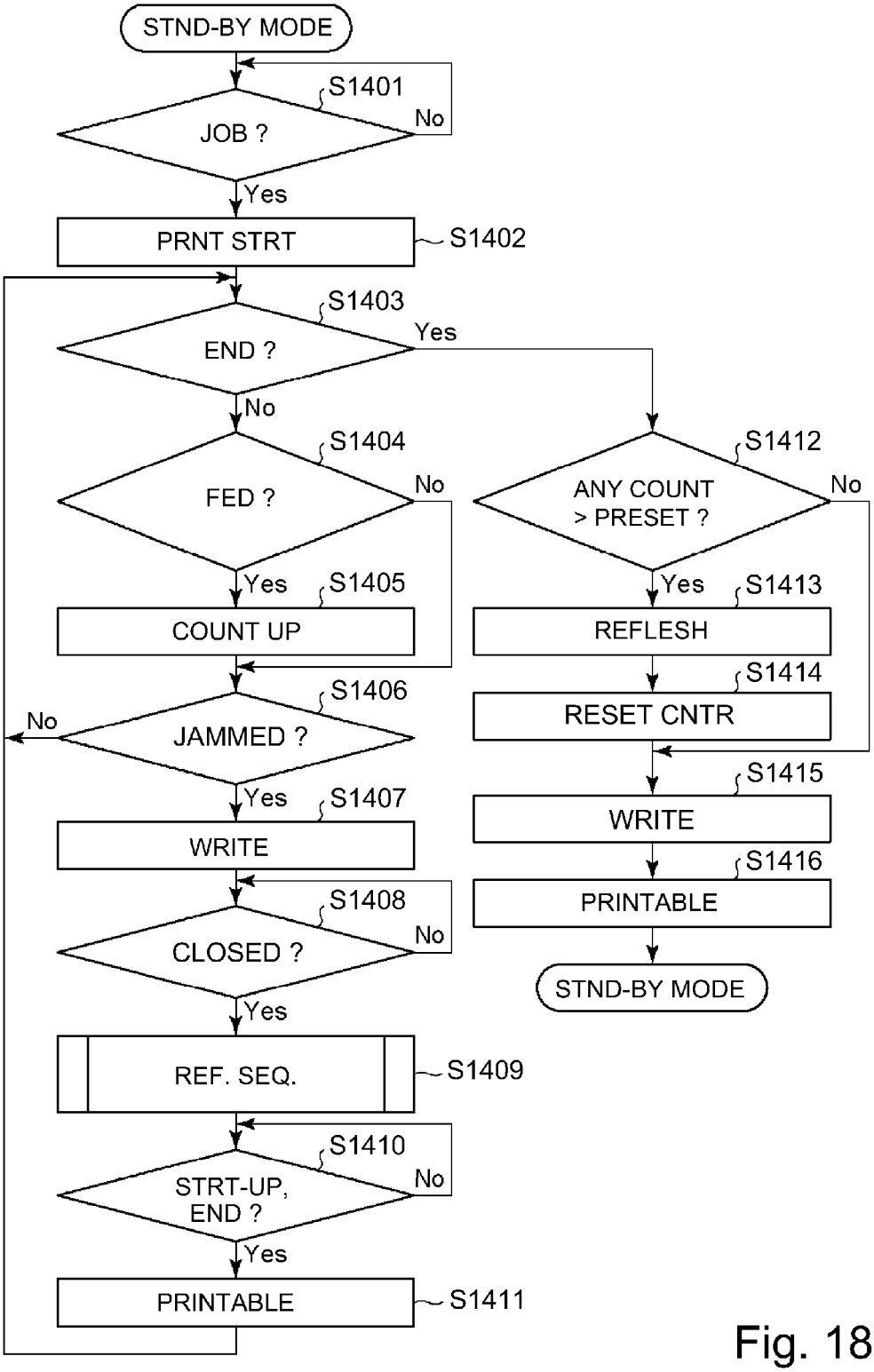
FIG. 18 is a flow chart of counting of the recording materials.

FIG. 18 is a flow chart of counting of the recording materials. More particularly, it is a flow chart of printing job execution by the image forming apparatus 300.

In the stand-by mode in which the image forming apparatus 300 is capable of carrying out the printing operation, the image forming apparatus 300 waits for the printing job from the operating portion 180 or an external PC or the like through the outside I/F portion 304 (S1401). At this time, the image forming apparatus 300 displays a selection screen for selecting the kind of the recording material 102 on the operating portion 180 or a display screen of the external PC, and receives the kind of the recording material 102 to be used for the printing by the operator as a content of the printing job.

When the printing job is received (Yes, S1401), the CPU 301 controls the mechanisms, such as the image forming stations 120-123, the first fixing device 150, the second fixing device 170, or the like, of the image forming apparatus 300, and starts the image forming process operation of the image forming apparatus 300. In other words, the printing job is started (S1402).

If the CPU (counter) 301 detects the feeding of the recording material 102 to the first fixing device 150 (S1404, Yes) in the stage in which the printing job is not completed (in S1403, No), the CPU 301 increments the count on the RAM 302. The CPU 301 increments the count corresponding to the main scan direction length of the fed recording material 102, of the counts on the RAM 302. The information of the main scan direction length of the fed recording material 102 is acquired by the CPU 301 on the basis of the content of the printing job in step S1401. The CPU 301 detects the feeding of the recording material 102 to the first fixing device 150 depending on the signal from the sensor 155.

On the other hand, if the feeding of the recording material 102 to the first fixing device 150 is not detected in step S1404, the CPU 301 does not increment the count, and proceeds to step S1406. This occurs, for example, in the case that after the detection of the passage of the recording material 102, the passage of the next recording material 102 is not detected after elapse of predetermined time, despite the non-completion of the printing job. The predetermined time period is counted by the timer 307.

When no sheet jamming in the image forming apparatus 300 is detected (S1406, No), the CPU 301 continues the operation for the printing job until the completion of the printing job, while repeating the operations of steps S1404 and S1405.

When the CPU 301 detects the jamming in the image forming apparatus 300 (S1406), the CPU 301 records the count on the RAM 302 for the main scan direction length in correlation with the ID of the first fixing device 150, as the information of the feeding number (S1407) The ID of the first fixing device 150 has already been acquired in step S1301 of the refreshing sequence of FIG. 17, which is executed in response to the actuation of the main switch 101 or the closure of the front door 140. The CPU 301 detects the jamming in the image forming apparatus 300 on the basis of the signals from the sensor group 306. For example, in the case that, upon elapse of a predetermined time from the detection of the recording material 102 by the sensor 155 disposed in the upstream side with respect to the feeding direction of the recording material 102, the sensor 153 disposed in the downstream side does not detect the passage of the recording material 102, the CPU 301 discriminates that the recording material 102 stagnates in the portion between the two sensors. The predetermined time is counted by the timer 307.

When the jamming occurs in the image forming apparatus 300, the CPU 301 interrupts the printing job. At this time, the jammed recording material stagnating in the feeding path of the image forming apparatus 300 is cleared by the operator, and therefore, the front door 140 or the like is opened.

The CPU 301 waits for the front door 140 to close (S1408). When the CPU 301 detects the closing of the front door 140 on the basis of the signal from the opening and closing sensor 305 (S1408), the refreshing sequence is carried out (S1409).

The refreshing sequence in step S1409 corresponds to the flow shown in FIG. 17. In this refreshing sequence, the ID of the first fixing device 150 is read out (S1301) as described above. The ID of the first fixing device 150 is read out because there is a possibility that the first fixing device 150 is exchanged when the front door 140 is opened for the jam clearance.

In step S1410, the CPU 301 waits for the image forming apparatus 300 to become capable of carrying out the image forming operation. The CPU 301 carries out the preparing operation (starting-up operations) for resuming the image forming operation for various mechanisms such as the first fixing device 150, the image forming station 309 and the like of the image forming apparatus 300 after the clearance of the jammed recording material. The temperature control for the fixing roller 151 is one of them, for example.

When the image forming apparatus 300 becomes capable of resuming the image forming operation after the completion of the starting-up operations (Yes, S1410), the CPU 301 displays "printable" or the like on the operating portion 180 (S1411). By this, the operator is notified of the fact that the image forming apparatus 300 has become capable of carrying out the image forming operation. Thereafter, the operation returns to step S1403, and the CPU 301 resumes the operations for the remaining printing job and continues up to the completion of the printing job.

When the printing job is completed (S1403, Yes), the CPU 301 discriminates whether or not any one of the feeding numbers for all the main scan direction lengths exceeds the predetermined value (500 in this example) (S1412).

If the result of the discrimination is negative, that is, if the values of the feeding numbers for all of the main scan direction lengths stored in the RAM 302 are less than the predetermined value (500 in this example), the CPU 301 proceeds to step S1415.

If the result of the discrimination is affirmative, that is, if a value of the feeding number for any one of the main scan direction lengths exceeds the predetermined value (500 in this example), the CPU 301 executes the fixing element refreshing operation (S1413). After the completion of the fixing element refreshing operation, the CPU 301 resets the values for all of the main scan direction lengths on the RAM 302 to zero. That is, the counter values are reset (S1414).

In step S1415, the CPU 301 records the count of the RAM 302 in the memory 154 for each main scan direction lengths in correlation with the ID of the first fixing device 150, as the information of the feeding number. As the operation goes through the process of step S1414, the feeding numbers for all the main scan direction lengths as the information of the feeding number become zero.

The CPU 301 displays "printable" on the operating portion 180 to notify the operator of the operativity of the image forming apparatus 300 (S1416). The apparatus is shifted into the stand-by mode.

By storing the information of the feeding number in the main assembly memory 312 in correlation with the ID of the first fixing device 150 before entering the stand-by mode, a correct feeding number can be stored in the memory 154 even when the first fixing device 150 is removed from the image forming apparatus 300 during the stand-by mode. Thus, even when the first fixing device 150 is taken out of the image forming apparatus 300 during the stand-by mode, more accurate feeding number information can be stored in the main assembly memory 312.

The writing in the main assembly memory 312 in step S1407 may be effected only when the jamming occurs in first fixing device 150 and/or the second fixing device 170 in step S1406. It is expected for the front door 140 to be opened by the operator after the occurrence of the jamming, because the jamming occurs in the fixing portion. This is because, in the case of the jamming in the fixing portion, the operator clears the recording material 102 stagnating in the first fixing device 150 and/or the second fixing device 170. The liability that the first fixing device 150 is exchanged by the operator arises when the front door 140 is opened.

In such a case, the sensors 153 and 155 function as the jam detecting portion. The sensors may be an optical sensor, for example. The CPU 301 receives the signals from the sensors 153 and/or 155 to detect the stagnation of the recording material 102 in the first fixing device 150 (jamming in the fixing portion). For example, in the case that, after the elapse of the predetermined period after the passage of the recording material 102 by the sensor 155 disposed at an upstream side with respect to the feeding direction of the recording material 102, the downstream side sensor 153 does not detect the passage of the recording material 102, the CPU 301 discriminates that the recording material 102 stagnates between the sensors 155 and 153. The predetermined time is counted by the timer 307.

In the fixing element refreshing operation in steps S1304 and S1413, the duration of the rubbing treatment by the refreshing roller 156 may not be constant. That is, the CPU 301 carries out the rubbing treatment for a time period corresponding to the amount, beyond the predetermined count (500 in this example), of the count (excess amount) of the feeding number for the main scan direction length.

For example, when the predetermined value in steps S1412 and S1413 is set to 500, and when the count is 500, the rubbing treatment duration is 30 sec, and when the count is 600, the rubbing treatment duration is 40 sec.

In this case, the duration of the rubbing treatment may be gradually or stepwisely increased with the increase of the excess amount of the count. The data (table, function or the like) for providing the correspondence between the excess amount of the count relative to the predetermined value and the rubbing treatment duration is stored in the ROM 303 beforehand.

As described hereinbefore, the exchange of the first fixing device 150 by the operator necessitates the opening and closing of the front door 140 of the image forming apparatus 300. When the front door 140 of the image forming apparatus 300 is opened by the operator, the first fixing device 150 may be exchanged. In addition, when the main switch 101 is off, the first fixing device 150 may have been exchanged. Therefore, whenever the actuation of the main switch 101 of the image forming apparatus 100 and/or the closure of the front door 140 occurs, the CPU 301 acquires the ID of the first fixing device 150. Then, the discrimination is made in step S1302 on the basis of the information of the feeding number corresponding to the ID of the feeding number information stored in the main assembly memory 312. By this, the CPU 301 can execute the fixing element refreshing operation for the first fixing device 150 on the basis of the more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

Embodiment 13

In Embodiment 12, when the count of the feeding number for any one of the main-scan direction lengths exceeds the predetermined value during the printing operation, the CPU 301 carries out the fixing element refreshing operation after the completion of the printing job, and then, the apparatus shifts to the stand-by mode.

In Embodiment 13, when the total count of the feeding numbers for the main-scan direction lengths exceeds the predetermined value, the CPU 301 executes the fixing element refreshing operation in the period of the printing job.

In Embodiment 12, the CPU 301 counts the feeding number for the main scan direction length on the RAM 302, and stores the count in main assembly memory 312.

In this Embodiment 13, the CPU 301 counts the feeding number on the main assembly memory 312 for the first fixing device 150. The CPU (recording portion, writing portion) 301 renews and records the count of the feeding number corresponding to the ID of the writing portion on the main assembly memory 312, for each feeding of the recording material 102 to the first fixing device 150 on the basis of the signal from the sensor 155. In this manner, the CPU 301 functions as a counter.

The same applies to the second fixing device 170.

In the description of this embodiment, the same reference numerals as in Embodiment 12 are assigned to the elements having the corresponding functions in this embodiment, and the detailed description thereof is omitted for simplicity.

In the following, the description will be made with respect to the first fixing device 150. The same applies to the second fixing device 170.

In the main assembly memory 312, the number of the recording materials 102 fed into the first fixing device 150 is stored for each 5 mm of the main scan direction length of the recording material 102 in correlation with the ID of the first fixing device 150. After the total of the feeding numbers for the respective main scan direction lengths exceeds the predetermined value (500 in this example), the fixing element refreshing operation is executed for the first fixing device 150, by the CPU 301. Thereafter, the feeding numbers for all of the main scan direction lengths correlated with the ID of the first fixing device 150 are reset (zero). When the total count exceeds the predetermined value (500 in this example), again, the CPU 301 executes the fixing element refreshing operation.

In place of counting the recording materials for each main scan direction length on the main assembly memory 312, all the recording materials fed into the first fixing device 150 may be counted irrespective of the main scan direction length.

The fixing element refreshing operation in this embodiment (in the period of the execution of the printing job) may be carried out after the interruption of the printing job (that is, by expanding the interval between the adjacent recording materials 102 fed into the first fixing device 150), or while printing is continuously carried out (that is, while executing the fixing process operation). However, the former is preferable. In such a case, the likelihood of the production of the disturbance of the toner image during the fixing process operation attributable to the vibration or the like caused by the contact of the refreshing roller 156 to the fixing roller 151 for the execution of the fixing element refreshing operation can be reduced.

(24. Control Flow)

Referring to flow charts of FIGS. 15 and 16 of Embodiment 1 and the flow charts of FIGS. 20 and 21, the description will be made. The operations in flow chart are carried out by the CPU 301 as the executing portion controlling the operation of the various mechanisms of the image forming apparatus 300 on the basis of control programs stored in the ROM 303. The description will be made as to the first fixing device 150, but the same applies to the second fixing device 170.

(24.1. Sequence Upon Actuation of the Main Switch and Upon Closing the Front Door)

The sequence upon actuation of the main switch 101 and upon closing the front door 140 will be described referring to the flowchart of FIGS. 15 and 16.

Figure 20:
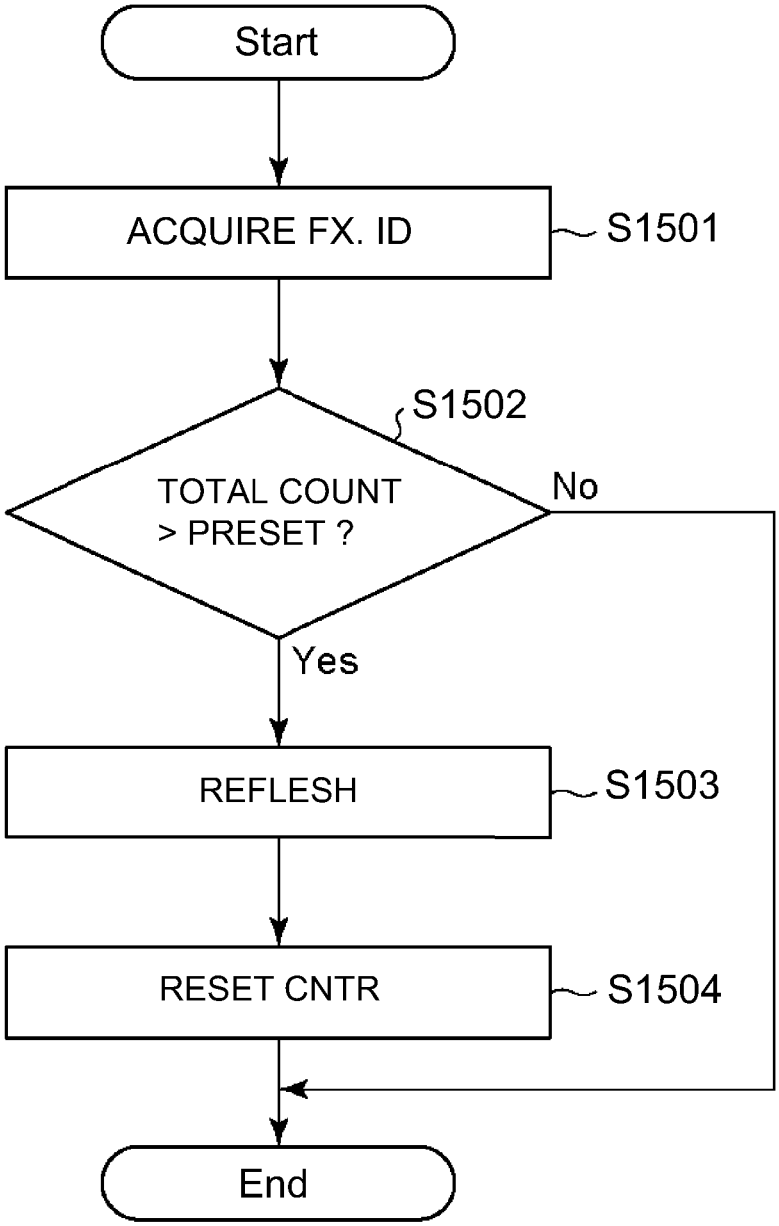
FIG. 20 is a flow chart of a refreshing sequence.

In this embodiment, in steps S1102 (FIG. 15) and S1203 (FIG. 16), the operation proceeds to the refreshing sequence of FIG. 20.

As to the other structures, they are the same as those of Embodiment 1, and the descriptions thereof are omitted for the sake of simplicity.

(24.2. Refreshing Sequence)

FIG. 20 is a flow chart of a refreshing sequence. The flow chart of FIG. 20 shows the details of step S1102 (FIG. 15), and step S1203 (FIG. 16), and the refreshing sequence in step S1608, which will be described hereinafter.

A step S1501 is the same as step S1301 of FIG. 17, and therefore, the description thereof is omitted.

The CPU 301 makes the discrimination in step S1502 on the basis of the feeding number information corresponding to the ID of the fixing device acquired in step S1501 in the information stored in the main assembly memory 312.

If the total (total count) of the feeding numbers for all of the main scan direction lengths in correlation with the ID of the first fixing device 150 exceeds a predetermined number (500 in this embodiment) (S1502), the CPU 301 proceeds to a step S1503.

Step S1503 is the same as step S1304 of FIG. 17, and therefore, the description thereof is omitted.

After the completion of the fixing element refreshing operation, the CPU 301 sets the counts for all of the main scan direction lengths to zero on the main assembly memory 312. That is, the counter values are reset (S1504).

On the other hand, if the discrimination in the step S1502 is negative, that is, the total count of the feeding number information for all of the main scan direction lengths stored in the main assembly memory 312 is not more than the predetermined value (500 in this example), the CPU 301 completes the refreshing sequence without executing the fixing element refreshing operation.

(24.3. Sequence for Recording Material Counting)

Figure 21:
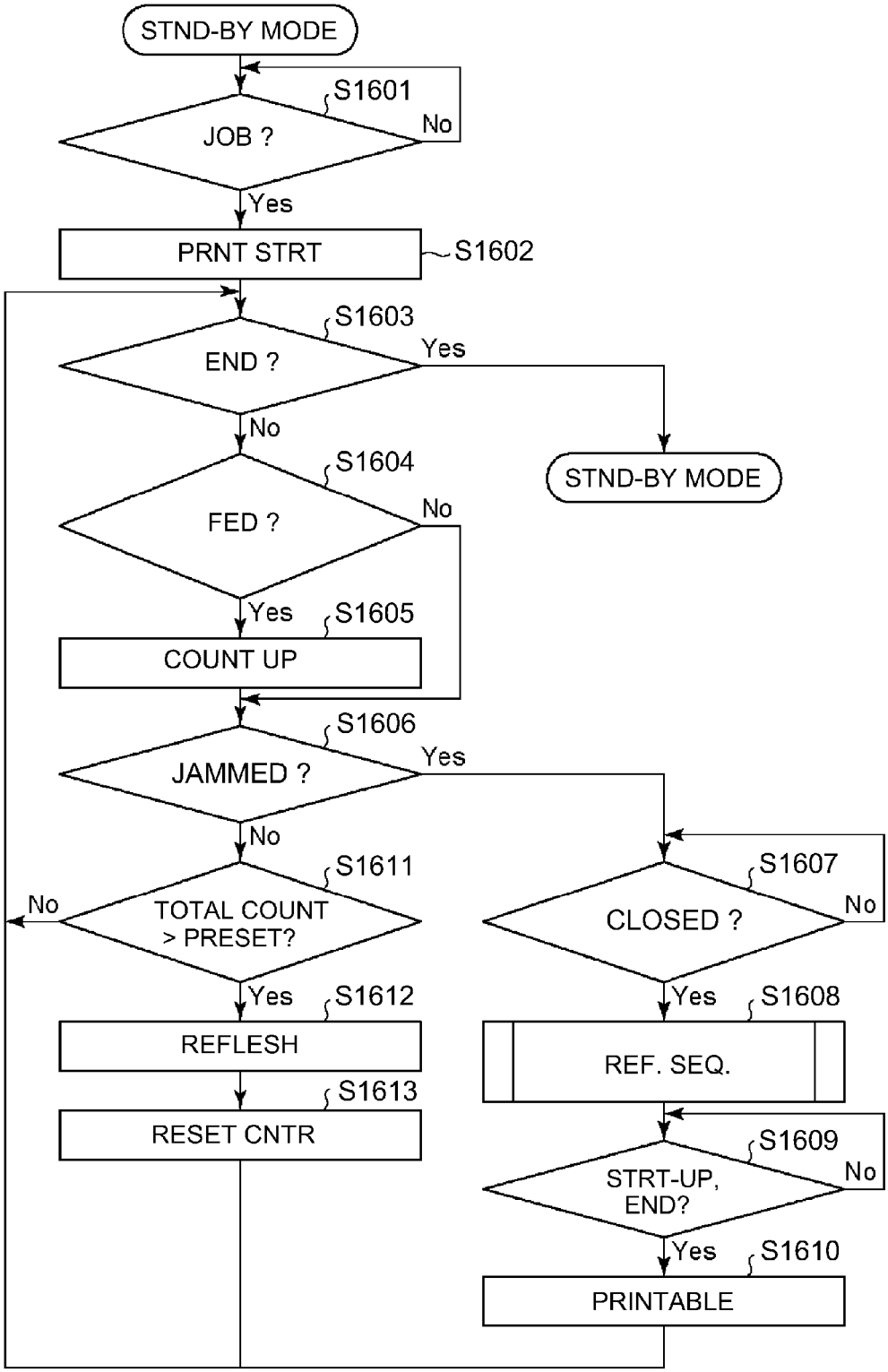
FIG. 21 is a flow chart of counting of the recording materials.

FIG. 21 is a flow chart of counting of the recording materials. More particularly, it is a flow chart of printing job execution by the image forming apparatus 300.

Steps S1601 and S1602 are the same as steps S1401 and S1402 (FIG. 18), and therefore, the description is omitted.

If the CPU 301 detects that the recording material 102 is fed to the first fixing device 150 (S1604, Yes) before the printing job is finished (S1603, No), the CPU 301 increments the count of the main assembly memory 312. The CPU 301 increments the count for the ID of the first fixing device 150. The ID of the first fixing device 150 has already been acquired in step S1501 of the refreshing sequence of FIG. 20, which is executed in response to the actuation of the main switch 101 or the closure of the front door 140. The CPU 301 increments the count for the main scan direction length of the recording material 102 fed to the fixing device, of the counts stored in the main assembly memory 312. The information of the main scan direction length of the fed recording material 102 is acquired by the CPU 301 on the basis of the content of the printing job in step S1601. The CPU 301 detects the feeding of the recording material 102 to the first fixing device 150 depending on the signal from the sensor 155.

On the other hand, if the feeding of the recording material 102 to the first fixing device 150 is not detected in step S1604, the CPU 301 does not increment the count, and proceeds to step S1606. This occurs, for example, in the case that after the detection of the passage of the recording material 102, the passage of the next recording material 102 is not detected after elapse of predetermined time, despite the non-completion of the printing job. The predetermined time period is counted by the timer 307.

When the jamming occurs in the image forming apparatus 300 (S1606, Yes), the CPU 301 interrupts the printing job. At this time, the jammed recording material stagnating in the feeding path of the image forming apparatus 300 is cleared by the operator, and therefore, the front door 140 or the like is opened.

The CPU 301 waits for the front door 140 to close (S1607). When the CPU 301 detects the closing of the front door 140 on the basis of the signal from the opening and closing sensor 305 (S1607), the refreshing sequence is carried out (S1608).

The refreshing sequence in step S1608 corresponds to the flow shown in FIG. 20. In the refreshing sequence, the ID of the first fixing device 150 is acquired (S1501), as described in the foregoing. The ID of the first fixing device 150 is acquired because there is a possibility that the first fixing device 150 is exchanged when the front door 140 is opened for the jam clearance.

Step S1609 is the same as step S1410, and therefore, the description thereof is omitted.

When the image forming apparatus 300 becomes capable of resuming the image forming operation after the completion of the starting-up operations (Yes, S1609), the CPU 301 displays "printable" or the like on the operating portion 180 (S411). By this, the operator is notified of the fact the image forming apparatus 300 has become capable of carrying out the image forming operation.

Thereafter, the operation returns to step S1603, and the CPU 301 resumes the operations for the remaining printing job and continues up to the completion of the printing job.

If the CPU 301 does not detect occurrence of jamming in the image forming apparatus 300 (S1606, No), the CPU 301 discriminates whether or not the total count of the feeding numbers for all of the main scan direction lengths correlated with the first fixing device 150 in the main assembly memory 312 exceeds the predetermined value (500 in this example) (S1611).

In step S1611, if the total count exceeds the predetermined value (500 in this example), the CPU 301 proceeds to a step S1603, and the printing operation is continued until the printing job is finished.

When the total count of the main assembly memory 312 exceeds the predetermined value (500 in this example) in S1611, the CPU 301 executes the fixing element refreshing operation (S1612).

When the fixing element refreshing operation is completed, the CPU 301 sets the counts of the feeding number corresponding to the first fixing device 150 on the main assembly memory 312 to zero for all main scan direction lengths. That is, the counter values are reset (S1613).

Thereafter, the operation returns to step S1603, where the CPU 301 continues the printing job until the printing job is finished.

After the printing job is completed (S1603, Yes), the CPU 301 shifts to the stand-by mode.

In this embodiment, the counts of the feeding numbers of the recording materials 102 are managed on the main assembly memory 312. The CPU 301 records the counts of the feeding numbers in the memory 154 for each feeding of the recording material 102 to the first fixing device 150. By this, even when the first fixing device 150 is taken out of the image forming apparatus 300, more accurate feeding number information can be stored in the main assembly memory 312.

As described hereinbefore, the exchange of the first fixing device 150 by the operator necessitates the opening and closing of the front door 140 of the image forming apparatus 300. When the front door 140 of the image forming apparatus 300 is opened by the operator, the first fixing device 150 may be exchanged. In addition, when the main switch 101 is off, the first fixing device 150 may have been exchanged. Therefore, whenever the actuation of the main switch 101 of the image forming apparatus 300 and/or the closure of the front door 140 occurs, the CPU 301 acquires the ID of the first fixing device 150. The CPU 301 counts the feeding number on the basis of the count in the main assembly memory 312. By this, the CPU 301 can execute the fixing element refreshing operation for the first fixing device 150 on the basis of the more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

Embodiment 14

In Embodiment 12, the CPU 301 stores the feeding number information in the main assembly memory 312 in correlation with the ID of a fixing device.

In this embodiment, the CPU 301 stores the feeding number information in a storing device 200 in correlation with the ID of the fixing device (image forming system).

The storing device 200, shown in FIG. 14, is connected communicatably with the image forming apparatus 300 through a network cable. The storing device 200 is a server-computer comprising a rewritable non-volatile memory, an external I/F portion 304, and a communication circuit connected with the network, and functions as a storing server for storing information of the image forming apparatus 300. The storing device 200 comprises a CPU 301 for controlling the storing device 200 and a ROM for storing control programs to be executed by the CPU 301. The CPU 301 of the storing device 200 records the information of the image forming apparatus 300 received by the communication circuit through the network, supplying to the image forming apparatus 300 the information of the memory in accordance with the instructions of the image forming apparatus 300 received by the communication circuit through the network.

The communication is described as being made between the storing device 200 and the image forming apparatus 300 through the network cable, but it can be made by wireless communication.

In this embodiment, the CPU 301 functions as a recording portion (writing portion).

The CPU 301 stores the feeding number information in combination with the ID of the first fixing device 150 in the memory of the storing device 200 connected with the external I/F portion 304, through the network, and acquires the information stored in the memory of the storing device 200.

This embodiment is used with Embodiment 12.

When the main switch 101 is actuated or when the front door 140 is closed, the CPU 301 acquires the ID of the first fixing device 150 from the discrimination portion (resistor 1154) of the first fixing device 150.

The CPU 301 stores the number (feeding number) of the recording materials 102 fed to the first fixing device 150 in correlation with the main-scanning direction length, as the information of the feeding number to be stored in the memory of the storing device 200. The CPU 301 stores the feeding number for the main scan direction length in correlation with the ID of the first fixing device 150 in the storing device 200.

When anyone of the counts of the feeding number for the main scan direction lengths correlated with the ID of the first fixing device 150, or the feeding number information stored in the storing device 200 exceeds a predetermined value, the CPU 301 executes the fixing element refreshing operation. Thereafter, the apparatus shifts to the stand-by mode.

When the feeding number information corresponding to the ID of the first fixing device 150 mounted in the storing device 200 is less than the predetermined value, with respect to the feeding number counts for all of the main scan direction lengths, the CPU 301, as the counter, counts up on the basis of the information in the storing device 200. That is, the CPU 301, as the counter, counts the recording material 102 (feeding number) fed to the first fixing device 150 on the basis of the information corresponding to the ID of the first fixing device 150 stored in the storing device 200.

The specific operation flow is the same as with above-described Embodiment 12, and therefore, the detailed description thereof is omitted for the sake of simplicity. For this embodiment, the main assembly memory 312 in Embodiment 12 should read storing device 200. As regards the flow chart of FIGS. 15-18, the description above the regarding the memory (S1306 of FIG. 17, for example) should be read as that of the storing device 200.

With the structure of this embodiment, too, the CPU 301 can count the feeding number on the basis of information corresponding to the ID of the first fixing device 150 stored in the storing device 200. In other words, the fixing element refreshing operation for the first fixing device 150 can be carried out on the basis of more accurate number information, and the deterioration of the output image quality on the recording material 102 can be suppressed.

(25. The Case in which the User Uses a Plurality of Image Forming Apparatuses)

The storing device 200 may be connected with a plurality of image forming apparatuses into which the first fixing device 150 is mountable, through a network. The structures of the image forming apparatuses are the same as that of the image forming apparatus 300, and the detailed description is omitted.

In this case, the CPU 301 of the image forming apparatus 300 can execute the fixing element refreshing operation on the basis of the feeding number, taking into account the number of the recording materials fed to the first fixing device 150 in another image forming apparatus. By this, the fixing element refreshing operation can be executed for the first fixing device 150 on the basis of more accurate number of information and at a more appropriate timing.

The description will be made taking a specific situation. That is, the fixing device to be replaced is the first fixing device 150.

For example, the user uses two image forming apparatuses 300 (image forming apparatus P and image forming apparatus Q). The fixing device A is usable with either of the image forming apparatuses P, Q as the first fixing device 150. The predetermined value is 500. That is, the CPUs of the image forming apparatuses P, Q execute the fixing element refreshing operation for the first fixing device 150 when the number of the recording materials 102 fed to the first fixing device 150 exceeds 500.

The fixing device A is mounted in the image forming apparatus P. It is assumed that when the printing job of the image forming apparatus P is completed, the feeding number to the fixing device A is 450.

Suppose the operator then uses this fixing device A in the other image forming apparatus Q, as the first fixing device 150. The operator takes the fixing device A out of the image forming apparatus P and mounts it in the image forming apparatus Q. Then, a printing job including 100 prints is carried out in the image forming apparatus Q.

With the structure in which the feeding number information is stored in the main assembly memory 312 as in Embodiment 12, the CPU 301 of the image forming apparatus Q executes the fixing element refreshing operation on the basis of the information of the main assembly memory 312 of the image forming apparatus Q. Therefore, if the feeding number information for the fixing device A stored in the main assembly memory 312 upon the mounting of the fixing device in the image forming apparatus Q is zero, the fixing element refreshing operation is not executed even if the printing job of 100 sheets is completed.

However, the fixing device A has already processed 450 recording materials 102 in the image forming apparatus P, and therefore, when the printing job of 100 sheets is completed in the image forming apparatus Q, the feeding number through the fixing device A exceeds the predetermined value (500) at the time of the completion of the printing job in the image forming apparatus Q. If the fixing process is carried out using the fixing device A after the completion of the 100 sheets printing job, the output image is likely to have a glossiness unevenness. It is desirable that the fixing element refreshing operation is carried out for the fixing device A in such a case, too.

In this embodiment, the image forming apparatuses P, Q are connected with a storing device 200 through the network, and the feeding number information is stored in the storing device 200, and the fixing element refreshing operation can be properly executed in the above-described case. By this, the production of the glossiness unevenness can be assuredly suppressed.

Specific operations will be described referring to FIG. 17 of Embodiment 12.

The count of the feeding number to the fixing device A is stored in a memory of the storing device 200 by the image forming apparatus P (S1306 of FIG. 17 and S1407, S1415 of FIG. 18).

The operator takes the fixing device A out of the image forming apparatus P and mounts it in the image forming apparatus Q. Thereafter, the main switch 101 of the image forming apparatus Q is actuated, and the CPU 301 of the image forming apparatus Q checks the mounting of the first fixing device 150 (S1101 of FIG. 15) and proceeds to the refreshing sequence of FIG. 17 (S1102 of FIG. 15).

The CPU 301 of the image forming apparatus Q makes the discrimination for the fixing device A on the basis of the feeding number information acquired from the storing device 200. In addition, in step S1303 of FIG. 17, the CPU 301 of the image forming apparatus Q sets the feeding number of the fixing device A acquired from the storing device 200 in a counter 314 of the image forming apparatus Q.

By doing so, the CPU 301 of the image forming apparatus Q can properly count the feeding number of the recording materials 102 to the fixing device A. Therefore, the fixing element refreshing operation can be properly executed for the fixing device A, and therefore, the deterioration of the image quality can be suppressed.

In the foregoing description, the first fixing device 150 is taken as an example, but the same applies to the second fixing device 170.

In this embodiment, the structure (image forming system) of storing the feeding number information in the storing device 200 is applied to Embodiment 12, but the same may be applied to Embodiment 13. The specific structures and operations are similar to those of Embodiment 13, and therefore, the description thereof is omitted. For such an example, the main assembly memory 312 in Embodiment 12 should read as the storing device 200.

Embodiment 15

In Embodiments 12 and 13, the CPU 301 stores the number information of the recording materials 102 fed to the first fixing device 150 and the second fixing device 170 in the main assembly memory 312. In Embodiment 14, the CPU 301 stores the number information of the recording materials 102 fed to the first fixing device 150 and the second fixing device 170 in the storing device 200. Concurrently with the writing of the information in main assembly memory 312 by the CPU 301, the same information may be stored in the storing device 200 by the CPU 301.

Embodiment 16

The image forming apparatus 300 may be set at a mode not executing the above-described fixing element refreshing operation, by the setting of the user. In such a case, the operating portion 180 is provided with a selector which displays a display for the selection between the mode in which the fixing element refreshing operation is executed and the mode in which it is not executed. The user is capable of selecting one of the modes through the operating portion 180. The information of the selected mode is stored in the main assembly memory 312 as the set information of the image forming apparatus 300. The operation program to be executed when the fixing element refreshing operation non-executing mode is selected is stored in the ROM 303. When such a mode is selected, the CPU 301 executes the program.

The fixing element refreshing operation is necessary in order to suppress the glossiness non-uniformity due to the difference in the surface roughness between the (I) non-passing portion, the (II) passing portion, and the (III) boundary area of the fixing roller 151, as described hereinbefore. The difference in the surface roughness of the fixing roller 151 appears as the glossiness unevenness when the recording material 102 passes through the nip in contact with the (I) non-passing portion, the (II) passing portion, and the (III) boundary area of the fixing roller 151. Therefore, the glossiness unevenness can be suppressed by using the different fixing device having the same structure, for the respective main scan direction length of the recording material 102 as the first fixing device 150. In view of this, some user who is concerned with the glossiness property evenness prepares the fixing devices for respective main scan direction lengths of the recording material 102 in order to avoid the deterioration of the print quality.

In such a case, that is, due to the glossiness unevenness caused by the edge portions of the recording materials 102, it is desirable not to execute the fixing element refreshing operation to avoid the fine scores provided by the refreshing roller 156, which influence the glossiness property of the image.

By making the modes (execution and non-execution of the fixing element refreshing operation) selectable by the user, the apparatus can meet wider needs of the users.

Embodiment 17

With respect to the Embodiments 12-16, the contact of the end portions of the recording materials 102 with the fixing roller 151 is taken as the cause of the difference in glossiness on the fixed image, but the causes are not limited to that. For example, a separation claw contacting the fixing roller 151 may be provided to prevent the recording material 102 from wrapping around the fixing roller 151.

In such a case, with the cumulation of the fixing process, there is a likelihood that contact damage may occur by the contact of the separation claw to the surface of the fixing roller 151. In the case that a plurality of separation claws are provided at intervals in the longitudinal direction (axial direction) of the fixing roller 151, the surface of the fixing roller 151 is roughened adjacent to the contact position with the separation claw, with the result of unevenness of the surface state over the length of the fixing roller 151. As a result, the glossiness difference may arise on the fixed image.

Even in such a case, the influence to the image quality by the contact damage can be reduced by providing the refreshing roller 156 and executing the fixing element refreshing operation.

Embodiment 18

In Embodiments 12-17, the refreshing roller 156 is provided for the fixing roller 151 to effect the rubbing treatment to the surface of the fixing member, but the rubbing rotatable member is provided for the surface of the pressing belt 152 and/or the pressing roller 172 to effect the rubbing treatment thereto.

Embodiment 19

In the exchangeable fixing device system, the user exchanges the fixing devices depending on the kind of the recording material 102 or the preference. In such a case, there is a possibility that a better quality print can be provided if the fixing device not selected by the operator is used, that is, there is a likelihood that the advantage of the exchanging system is not enjoyed. In this embodiment, the image forming apparatus 300 notifies the operator of the matching between the selected recording material 102 and the selected fixing device.

In the following, the description will be made referring to an Embodiment 1 (FIGS. 17 and 18). The other structures are the same as in Embodiment 1, and therefore, the detailed description thereof is omitted for simplicity. The description will be made as to the first fixing device 150, but the same applies to the second fixing device 170.

The first fixing device 150 is provided with a resistor functioning as a limiting information portion. For the description of this case, the resistor 1154 of FIG. 14 should read as the resistor functioning as the limiting information portion. The fixing device prepared outside the image forming apparatus 300 as a replacement fixing device is also provided with a resistor as the limiting information portion. The resistance value is different depending on the kind of the recording material 102 for which the fixing process of the first fixing device 150 is limited, and functions as the information for limiting the kind of the recording material 102 for use in the fixing process of the first fixing device 150. The method for acquiring the limiting information is the same as the method for acquiring the ID of the above-described fixing device, and the description thereof is omitted.

In the main assembly memory 312, the information indicative of the kind of the recording material 102 to be limited in the fixing process corresponding to the resistance value (limiting information) of the memory (limiting information portion) is stored beforehand. For example, when the resistance value is R4, the fixing on an envelope is prevented, and when the resistance value is R5, the fixing on a thick sheet is prevented.

In a step S10301 of FIG. 17, the CPU 301 acquires the resistance value (limiting information) of the resistor (limiting information portion) of the first fixing device 150 together with acquiring the ID of the first fixing device 150 mounted in the image forming apparatus 300. On the basis of the limiting information and the kind of the limited recording material information stored in the main assembly memory 312, the CPU 301 determines the kind of the recording material 102 which is to be prevented in the fixing operation of the first fixing device 150.

In step S401 of FIG. 9, when the CPU 301 receives the printing job from the operator, the CPU 301 makes the kinds of the recording material 102 not suitable for the first fixing device 150 non-selectable on the selection screen.

Thus, the printing operation using improper first fixing device 150 can be prevented, thus assuring high quality prints.

The information corresponding to the kinds of the recording material 102 to be prevented may not be stored in the main assembly memory 312 in combination with the limiting information. For example, the program executed by the CPU 301 may prevent the fixing process on the recording material 102 depending on the resistance value of the resistor (limiting information portion). In such a case, the program is stored in the ROM 303.

The foregoing description has been made with respect to the first fixing device 150, but it is applicable to the second fixing device 170, and therefore, the description as to the second fixing device 170 will be omitted.

In this embodiment, a resistor is used as the limiting information portion, but this is not limiting to the present invention and the following is an alternative structure.

For example, the limiting information portion provided on the fixing device (first fixing device 150, second fixing device 170, and replacement fixing device) may be DIP switch including a plurality of switches. In such a case, the switches different depending on the fixing devices are in ON state beforehand as the limiting information, and the CPU 301 determines the kind of the recording material 102 to be prevented on the basis of the signal from the ON state switches. The other structures are the same as those of the DIP switch as the discrimination portion described hereinbefore.

The limiting information portion provided on the fixing device (first fixing device 150, second fixing device 170, and replacement fixing device) may indicate the usage, for example, "for envelope", or the kind and/or usage of the fixing device (limitation information). In such a case, the memory is a rewritable non-volatile memory such as EEPROM, flash memory or the like. The CPU 301 reads out the limiting information from the memory to determine the kind of the recording material 102 to be prevented. In this case, the information corresponding to the limited recording material 102 may be stored in the memory as the limiting information portion provided on the fixing device not in the main assembly memory 312.

In this embodiment, the limiting information portion and the discrimination portion are separate members on the fixing device, but one resistor or memory may include the limiting information portion and the discrimination portion.

In addition, this embodiment has been described as being incorporated in Embodiment 12, but may be incorporated in Embodiment 13 or 14. The description is omitted because it also applies to the case where Embodiment 13 or Embodiment 14 is modified.

Embodiment 20

In Embodiments 12-19, the operating portion 180 is provided with a display screen and a selection key, but the display screen may be a touch panel which also functions as a selector.

Embodiment 21

In the foregoing embodiments, the image forming apparatus 300 comprises both of the first fixing device 150 and the second fixing device 170 (tandem fixing). However, the present invention is applicable to an image forming apparatus 300 comprising only one fixing device 150.

Embodiment 22

In the Embodiments 12-21, the image forming apparatus 100 comprises the image forming stations (120-123) for forming yellow, magenta, cyan and black toner images (color image forming apparatus), but the present invention is applicable to a monochromatic image forming apparatus. For example, there is a monochromatic for forming the toner images in black only.

Embodiment 23

In the Embodiments 12-22, the image forming apparatus 300 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 300 feeds the recording material 102 from a recording material accommodating portion 103 to the transfer feeding belt. The transfer feeding belt electrostatically attracts the recording material 102 and carries it to a position where the recording material 102 faces the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

Embodiment 24

(26. General Arrangement of Image Forming Apparatus)

Figure 22:
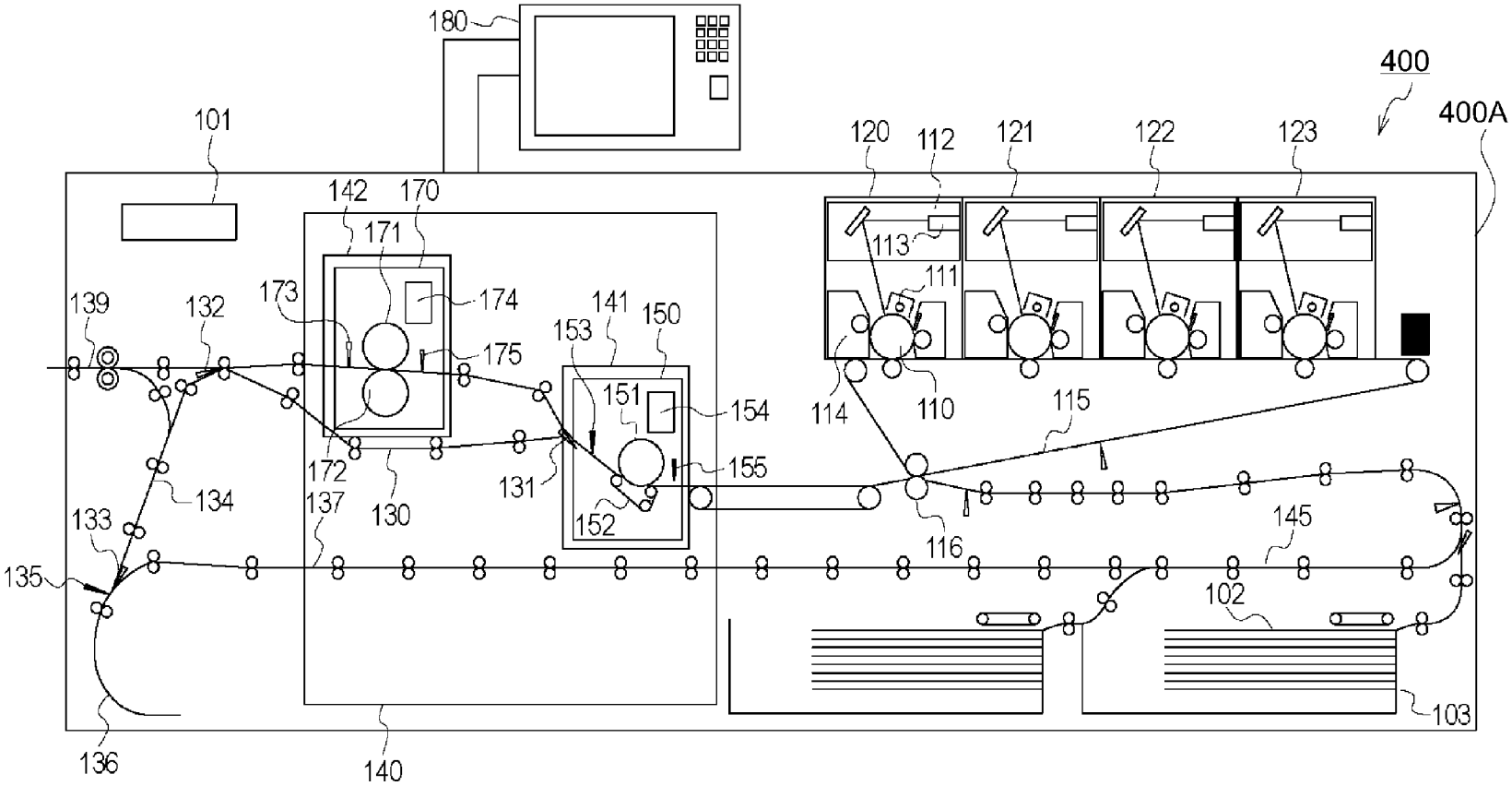
FIG. 22 is a sectional view of an example of an image forming apparatus.

FIG. 22 is a sectional view of an example of an image forming apparatus according to Embodiments 24-37.

In the description of these embodiments, the same reference numerals as in Embodiment 1 are assigned to the elements having the corresponding functions, and the detailed description thereof is omitted for simplicity. That is, the description of the image forming apparatus 300, and of the image forming apparatus 100 of the foregoing embodiments should read as the image forming apparatus 400.

The front door 140 as an opening and closing portion is provided for the opening of the main assembly 400A of the image forming apparatus 400 for mounting a fixing device (first fixing device 150, second fixing device 170) to a mounting portion (first mounting portion 141, second mounting portion 142).

The image forming apparatus 400 is provided with an opening and closing sensor (optical sensor) 305 (FIG. 23) as a sensor for sensing a closed state of the front door 140. The opening and closing sensor 305 and the CPU 301 (FIG. 23) function as an opening and closing detecting portion. The front door 140 is provided with a projection (unshown), which is inserted into a receiving portion (unshown) of the main assembly 400A of the image forming apparatus 400 by the closing of the front door 140. The CPU 301 detects the closing of the front door 140 on the basis of a signal produced by the opening and closing sensor 305 upon the insertion of the projection into the receiving portion. On the other hand, when no output signal is produced by the opening and closing sensor 305, the CPU 301 detects that the front door 140 is open. In an alternative structure, the CPU 301 detects the opening of the front door 140 on the basis of the signal produced by the opening and closing sensor 305 upon the opening of the front door 140, and the CPU 301 detects that the front door 140 is closed when the signal from the sensor 305 is not detected.

(27. Structure of Control System)

Figure 23:
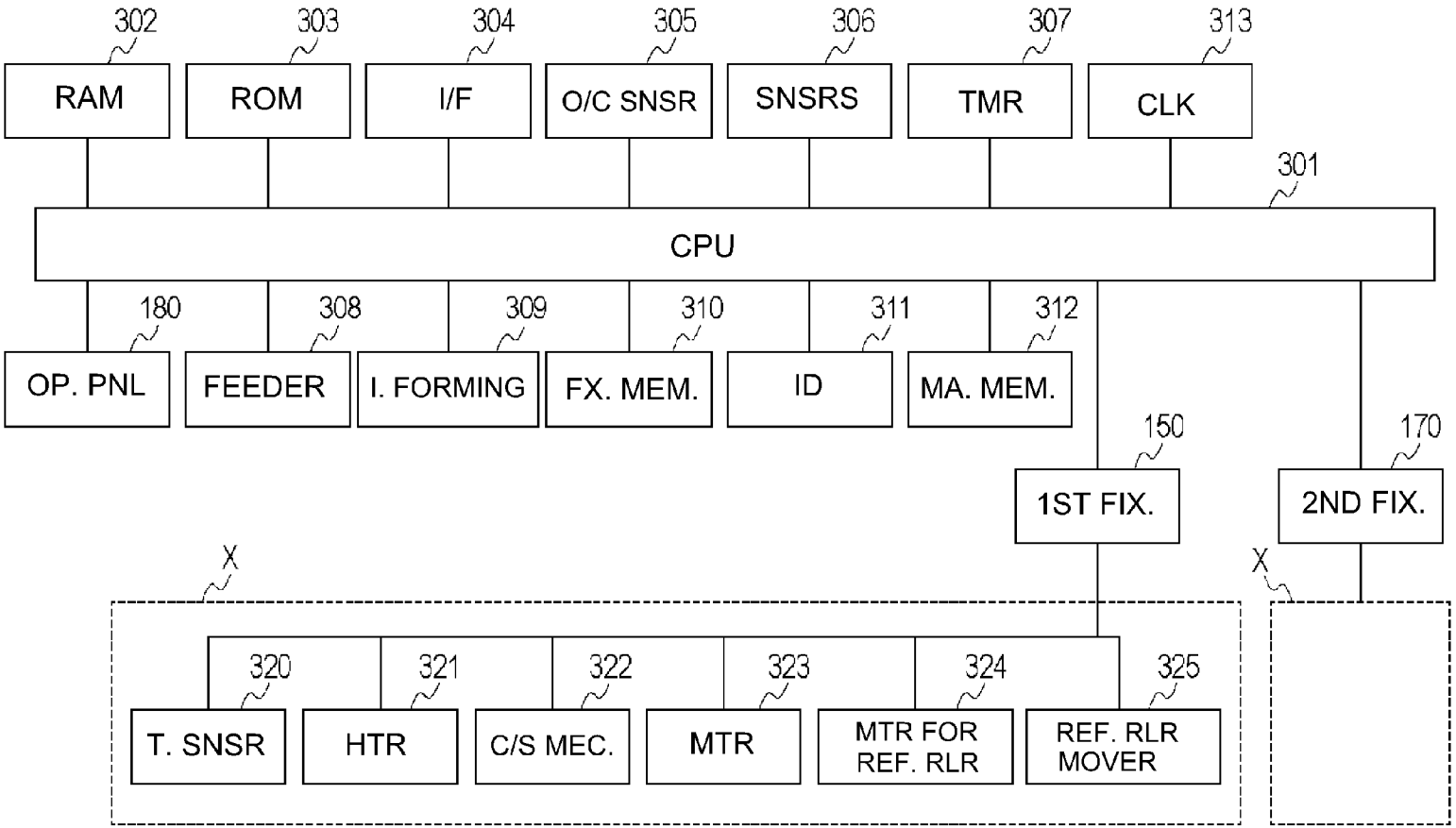
FIG. 23 is a block diagram of a control system.

FIG. 23 is a block diagram of an example of a structure of the control system in Embodiments 24-37. In the description of this embodiment, the same reference numerals as in the foregoing embodiments are assigned to the elements having the corresponding functions in this embodiment, and the detailed description thereof is omitted for simplicity.

The image forming apparatus 400 (FIG. 22) is provided with a CPU 301, a RAM 302, and a ROM 303 for controlling the operation of the image forming apparatus 400.

The CPU 301, functioning as a controller, carries out a basic control of the image forming apparatus 400 by executing control programs stored in the ROM 303. The CPU 301 uses the RAM 302 as a work area for executing the processing of the control program.

The CPU 301 is electrically connected with the RAM 302 and the ROM 303, and various mechanisms to be controlled.

In addition, the CPU 301 functions also as a counter for counting the recording materials 102 fed into the first fixing device 150 or second fixing device 170. The specific structure will be described hereinafter.

An external I/F portion 304 is a communication circuit for communication with an external device connected through a network (LAN and/or WAN). The examples of the external device include a personal computer (PC) and another image forming apparatus or the like.

The CPU 301 is connected with the opening and closing sensor 305 to detect whether or not the front door 140 is closed.

The sensor group 306 including sensors 153, 155, 173, and 175, shown in FIG. 22, is disposed along the feeding path, by which the CPU 301 detects the presence, absence and passing of the recording material.

In addition, the CPU 301 is connected with a timer 307. The timer 307 functions as a clock portion for measuring a time period. As will be described hereinafter, it counts the time for detection of a jammed sheet, and/or for a fixing element refreshing operation.

The CPU 301 is connected with the clock 313. The clock 313 functions as an output portion for outputting time information. The CPU 301 acquires the time information indicated by the clock 313.

The CPU 301 is connected with a counter 314. The CPU 301 receives the instructions of switching of the display content on the display screen and other operations, given by the operator at the selection keys of the operating portion 180. The CPU 301 displays, on the display screen of the operating portion 180, the status of operation of the image forming apparatus 400, an operation mode selected by the selection key, and so on.

The CPU 301 is connected with a feeding portion 308 to control feeding of the recording material 102. The feeding portion 308 includes a supply portion for feeding the recording material 102 from the recording material accommodating portion 103 to the feeding path, feeding rollers for feeding the recording material 102 on the feeding path, and flappers (flappers 131, 132, 133, in FIG. 22) for the feeding paths.

In addition, the CPU 301 is connected with the image forming station 309 which will be described hereinafter to control the image forming station 309.

The memory 310 of the fixing device includes a memory 154 of the first fixing device 150 mounted in the image forming apparatus 400, and a memory 174 of the second fixing device 170 mounted to the image forming apparatus 400. The CPU 301 is connected with the memories 154, 174 of the first fixing device 150 and the second fixing device 170 mounted in the image forming apparatus 400 and writes in and reads out of the memories 154, 174.

The CPU 301 is connected with a discrimination member 311. The discrimination member 311 will be described in the description of the embodiment which will be described hereinafter.

The CPU 301 is connected with a main assembly memory 312. The main assembly memory 312 is rewritable non-volatile memory and may be integral with the RAM 302.

The CPU 301 is connected with a mechanism group X of the first fixing device 150 mounted in the image forming apparatus 400 to effect a temperature adjustment control and fixing element refreshing operation. The mechanism group X includes a temperature sensor 320, a heater 321, a moving mechanism 322, a motor 323, and a refreshing roller moving mechanism 325.

The temperature sensor 320 includes a plurality of temperature sensors provided in the first fixing device 150, including a thermister 159 (FIG. 3), and a thermister (unshown) for the pressing belt 152.

The heater 321 includes a plurality of heaters provided in the first fixing device 150, including a halogen heater 161 (FIG. 3), and a halogen heater (unshown) provided in the heating roller 163.

The CPU 301 is connected with a mechanism group X of the second fixing device 170 mounted in the image forming apparatus 400 to effect temperature adjustment control and the fixing element refreshing operation. The mechanism group X for the second fixing device 170 is substantially the same as the mechanism group X of the first fixing device 150, and therefore, the detailed description thereof is omitted by applying the same reference numerals to the corresponding elements. (In the description of the mechanism group X for the first fixing device 150, the first fixing device 150, the pressing belt 152, and the heating roller 163 correspond to the second fixing device 170, the pressing roller 172, and the pressing roller 172, respectively).

In this embodiment, the mechanisms are controlled by the CPU 301. Alternatively, however, the use can be made with CPU circuit portions for controlling the respective mechanisms and a main CPU circuit portion connected with the respective CPU circuit portions to effect the overall control.

(28. Image Forming Station)

The image forming apparatus 400 comprises stations 120, 121, 122 and 123 as the image forming station 309 (FIG. 23), an intermediary transfer belt 115 as an intermediary transfer member, and a transfer roller 116 as a transfer portion. The image forming stations are the same as those of Embodiment 1, and therefore, in the description of this embodiment, the same reference numerals as in Embodiment 1 are assigned to the elements having the corresponding functions in this embodiment, and the detailed description thereof is omitted for simplicity.

(29. Fixing Portion)

(29.1. Tandem Fixing)

The first fixing device 150 and the second fixing device 170 as the fixing portion fix the toner image transferred onto the recording material 102 by applying heat and pressure to the recording material 102.

The second fixing device 170 is disposed downstream of the first fixing device 150 with respect to the feeding direction of the recording material 102. The second fixing device 170 functions to provide the toner image fixed on the recording material 102 by the first fixing device 150 with glossiness and/or to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130, bypassing the second fixing device 170, for the purpose of saving the energy consumption. For example, this occurs in the case that the recording material 102 is plain paper or thin sheet, and high glossiness is not desired. As to whether to feed the recording material 102 into the second fixing device 170 or to feed the recording material 102 so as to bypass the second fixing device 170 (bypass route), the CPU 301 controls such an operation by switching the flapper 131.

(29.2. Structure of Fixing Device)

The first fixing device 150 and the second fixing device 170 are detachably mountable to the first mounting portion 141 and the second mounting portion 142 (collectively, mounting portion) of the image forming apparatus 400, respectively. The first fixing device 150 and a second fixing device 170 can be replaced with the fixing devices having the following structures, respectively.

The first fixing device 150 is provided with a memory 154 as a storing portion of the fixing device (fixing device storing portion). The second fixing device 170 is provided with a memory 174 as a storing portion of the fixing device (fixing device storing portion). The details will be described hereinafter.

The first fixing device 150 is provided with sensors 153 and 155 as a jam detecting portion, and the second fixing device 170 is provided with sensors 173 and 175 as a jam detecting portion. The details will be described hereinafter. For the respective fixing devices, the upstream sensors 155, 175 with respect to the feeding direction of the recording material 102 also function as detecting portions for detecting the feeding of the recording material 102 to the respective fixing devices. The details will be described hereinafter.

FIG. 3 is a sectional view of an example of a fixing portion.

In the description of this embodiment, the same reference numerals as in the foregoing embodiments are assigned to the elements having the corresponding functions in this embodiment, and the detailed description thereof is omitted for simplicity.

The following description will be made with respect to the first fixing device 150, but the same applies to the second fixing device 170 unless otherwise described (i.e., the structures of the first fixing device 150 apply to the structures of the second fixing device 170).

In this embodiment, the structures of the pressing sides of the first fixing device 150 and the second fixing device 170 are different, but they may be the same More particularly, the pressing side structures of the first fixing device 150 and the second fixing device 170 may use pressing belts or pressing rollers Alternatively, the pressing side may comprise the pressing roller in the first fixing device 150, and the pressing side may comprise a pressing belt in the second fixing device 170.

(29.3. Refreshing Roller)

As to the refreshing roller 156 as the rubbing rotatable member for effecting the rubbing treatment to the surface of the rotatable member, the description thereof in Embodiment 1 applies, and therefore, the detailed description is omitted for simplicity (see 4. 3. Refreshing roller).

(30. Glossiness Unevenness at the Widthwise End Portion of the Recording Material)

The reason for the necessity of the fixing element refreshing operation has been described with respect to Embodiment 1, and therefore, the description thereof is omitted (see 5. Glossiness unevenness produced by end portions of the recording material).

(31. Fixing Roller Refreshing Operation)

As described in the foregoing, when the recording materials 102 pass through the nip repeatedly, the unevenness of the surface state is produced in the longitudinal direction of the fixing roller 151 (the direction of the rotational axis).

In view of this, in the image forming apparatus 400, after a predetermined number of recording materials 102 are fed into the first fixing device 150, the fixing element refreshing operation for improving the surface state of the fixing roller 151 is carried out. The fixing element refreshing operation is the same as that of Embodiment 1, and therefore, the description thereof is omitted (see 6. Fixing roller refreshing operation; 6. 1. Recording material counting method; 6. 2. Fixing roller refreshing operation). In the fixing element refreshing operation, the time period (30 sec in this embodiment) of the rubbing treatment of the refreshing roller 156 is counted by the timer 307 provided in the image forming apparatus 400. The time counting may be accomplished by a clock provided in the image forming apparatus 400 counting the time on the basis of the clock time outputted by the CPU 301.

(32. Effects of the Fixing Element Refreshing Operation)

The effects of the fixing element refreshing operation has been described in conjunction with Embodiment 1, and therefore, the description is omitted (see 7. Effects of fixing element refreshing operation).

(33. Stand-by Mode)

The stand-by mode means the state in which the image forming apparatus 400 is in the state capable of starting of the image forming operation and waits for the printing instructions (printing job) by the operator. The operating portion 180 receives the printing job including the kind of the recording material 102 (surface property, basis weight, size or the like) on which the image is to be formed, the number of prints, and one-side printing/both side printing. The details thereof are the same as with Embodiment 1, and therefore, the description thereof is omitted (see 8. Stand-by mode) (the image forming apparatus 100 of the foregoing embodiments should read image forming apparatus 400).

(34. Fixing Device Exchanging System)

The fixing device is an exchangeable system of this embodiment, and is the same as that of Embodiment 1, and therefore, the description thereof is omitted for simplicity (see 9. Fixing device exchanging system).

(35. Fixing Device Memory and Main Assembly Memory)

In this embodiment, the fixing device is exchangeable, and the first fixing device 150 is provided with a storing portion (fixing storing portion) and a memory 154 as a discrimination portion. Similarly, the second fixing device 170 is provided with a storing portion (fixing storing portion) and a memory 174 as a discrimination portion. The memories 154, 174 are rewritable non-volatile memories such as a flash memory. A memory is also provided on a fixing device (not the first fixing device 150 or the second fixing device 170 already mounted in the image forming apparatus 400) kept outside of the image forming apparatus 400.

These memories (memory 154, memory 174, and the memory provided on the replacement fixing device) store identifying information for discriminating between them, and function as discrimination portions. In the following, the identifying information stored in the memory 154 of the first fixing device 150 is called an ID of first fixing device 150 (fixing device).

The fixing device group, including the first fixing device 150 and the second fixing device 170, is provided with the memory in order to solve the problem described below.

In addition, the image forming apparatus 400 is provided with a main assembly memory 312 as a storing portion. The main assembly memory 312 is a rewritable non-volatile memory, such as an EEPROM, flash memory or the like. However, it may be integral with RAM 302 if it is rewritable and non-volatile.

(35.1. Specific Situation)

The fixing device group, including the first fixing device 150 and the second fixing device 170, is provided with the memory in order to solve the problem described below. The problem arises when the first and/or second fixing device is once taken out of the apparatus 400, and then the fixing device is remounted in the image forming apparatus 400. The following description will be made taking the first fixing device 150 as an example, but the same applies to the second fixing device 150. The following description is applied also to the second fixing device 170.

More particularly, the following two situations may occur. That is, the fixing device to be replaced is the first fixing device 150.

A first situation (situation 1) will be described.

For example, the first fixing device 150 carries out the fixing element refreshing operation after 500 recording materials 102 are processed (after the feeding number becomes 500). That is, the predetermined number is 500. In the case that the fixing device A not exclusively for envelopes is mounted in the main assembly 400A of the image forming apparatus 400 as the first fixing device 150, a printing job of 450 sheets (on A4 size plain paper longitudinally fed, for example) is carried out. Thereafter, the operator is required to print on envelopes, and then the operator removes the fixing device A from the image forming apparatus 400 to mount the fixing device B exclusively for envelopes. The operator carries out the printing job including 50 envelopes with the fixing device B mounted as the first fixing device 150.

The CPU 301 counts the feeding number of the recording materials into the first fixing device by the counter provided in the main assembly of the image forming apparatus, and the fixing element refreshing operation is executed after the feeding number exceeds the predetermined number. That is, the CPU 301 executes the fixing element refreshing operation after the feeding number exceeds in the predetermined number, irrespective of whether the fixing device mounted as the first fixing device is the fixing device A or the fixing device B. Therefore, when the fixing device is switched from the fixing device A to the fixing device B, the CPU 301 discriminates that the feeding number of the first fixing device exceeds 500 when the 50 sheets are processed by the fixing device B, and carries out the fixing element refreshing operation for the fixing device B only. Then, the CPU 301 discriminates that the fixing element refreshing operation after the 500 sheets feeding has been completed.

Some days later, when the operator is going to print on the recording material 102 (plain paper, for example) other than the envelope, the operator changes the fixing device by remounting the fixing device A. The operator then executes 50 sheets printing job (on A4 size plain paper longitudinally fed, for example).

The fixing device A has already processed 450 sheets in the previous operation, and therefore, the uneven surface state of the fixing roller arises with respect to the longitudinal direction arises upon only 50 sheets being processed. If the next printing job is carried out (on A4 size plain paper longitudinally fed, for example), the glossiness unevenness occurs on the outputted image, that is, the image quality is significantly deteriorated.

As for a method for solving the problem arising in situation 1, the memory 312 provided in the main assembly 400A of the image forming apparatus 400 stores the feeding number information for each ID of the fixing device, as described in Embodiment 12, for example (this method is method 1). Using method 1 in the situation 1, the memory 312 of the main assembly 400A of the image forming apparatus 400 can store the feeding number on the fixing device A. As a result, for the fixing device A which was taken out of the apparatus 400 after 450 recording materials 102 are processed, and then was remounted in the apparatus 400, and thereafter processed 50 recording materials 102, the fixing element refreshing operation can be carried out. Therefore, the deterioration of the image quality can be suppressed even when the fixing portion is replaceable.

According to this embodiment, the deterioration of the image quality of the output portion can be suppressed even in another situation (situation 2). In the case that the user uses a plurality of image forming apparatuses, the fixing device which has been operated in one image forming apparatus 400 may be mounted in another image forming apparatus 400.

The fixing device A is usable with anyone of the image forming apparatuses 400 (image forming apparatuses P, Q) as the first fixing device 150. That is, the fixing device to be replaced is the first fixing device 150.

Suppose the fixing device A has processed 40 recording materials in the image forming apparatus P (image formation on A4 size plain paper sheets).

On the next day, the operator takes the very fixing device A from the image forming apparatus P and remounts it in the image forming apparatus Q. Then, the operator uses the fixing device A as the first fixing device 150 of the image forming apparatus Q to execute a printing job of 400 sheets (image formation on A4 size plain paper sheets). In such a case, the fixing device A has processed 440 recording materials.

Thereafter, the operator takes the fixing device A, having processed 440 recording materials, and remounts it in the image forming apparatus P, and 60 recording materials are processed by the image forming apparatus P using the first fixing device 150 which is the fixing device A (image formation on A4 size plain paper sheets).

If the above-described method 1 is used, the memory 312 of the main assembly of the image forming apparatus P stores the information indicating that the fixing device A has processed 40 recording materials. However, the fixing device A remounted in the image forming apparatus P has processed 440 recording materials, including the amount processed in the image forming apparatus Q.

When the fixing device A processes 60 recording materials after being remounted in the image forming apparatus P, the fixing roller has an uneven surface state in the longitudinal direction. However, with the above-described method 1, the memory 312 of the main assembly of the image forming apparatus P stores the information indicating that the fixing device A has processed 100 recording materials in total. If the next printing job is carried out in this state (image formation on A3 plain paper sheets, for example), the glossiness unevenness arises on the outputted image. It is desirable that the fixing element refreshing operation is carried out for the fixing device A in such a case, too.

Under the circumstances, in this embodiment, the first fixing device 150 is provided with a memory 154 as a fixing storing portion capable of storing the information. The CPU 301 stores the information indicative of the number of the recording materials 102 fed to the first fixing device 150 (number information) in both of the memory 154 and the main assembly memory 312.

The memory 154 of the first fixing device 150 stores the number information and the information (time information) indicative of the time and day at which the number information is recorded in the memory 154. The memory 154 stores the ID of the fixing device (fixing device A, for example) as the identifying information for discriminating the fixing device A from the other fixing devices, and therefore, the memory 154 functions as the discrimination portion.

On the other hand, the image forming apparatus 400 is provided with the main assembly memory 312 as the main assembly storing portion capable of storing the information. The CPU 301 stores, in the main assembly memory 312, the number information which is the same as in the recording in the memory 154, the information indicative of the time and day at which the number information is recorded in the memory 154, the ID of the fixing device mounted as the first fixing device 150.

Part (a) of FIG. 28 shows an example of the information stored in the main assembly memory 312, and (b) shows a example of the information stored in the memory 154 of the fixing device.

The information of the time and day is used to discriminate which of the number information stored in the memory 154 and the number information stored in the main assembly memory 312 is it to be used. The CPU 301, as the counter, counts the number of the recording materials 102 (feeding number) fed to the first fixing device 150 on the basis of later number information of the information stored in the main assembly memory 312 and the information stored in the memory 154.

(35.2. Count on the Basis of the Information Stored in the Main Assembly Memory)

The CPU 301 counts the recording materials on the basis of the later pieces of the information stored in the main assembly memory 312 and the memory 154. By this, the fixing element refreshing operation can be executed for the first fixing device 150 on the basis of the more accurate number information. Therefore, the deterioration of the image quality on the output recording material 102 can be deteriorated.

The structure of this embodiment will be described in more detail.

In response to the remounting of the first fixing device 150 by the operator, the CPU 301 acquires the ID of the fixing device and the time and day information from the first fixing device 150. The mounting of the first fixing device 150 will be described hereinafter. The CPU 301 acquires from the main assembly memory 312 the time and day information corresponding to the ID of the fixing device acquired from the first fixing device 150. The CPU 301 compares the day and time stored in the memory 154 of the first fixing device 150 mounted in the image forming apparatus 400 and the time and day stored in the main assembly memory 312, and discriminates which is later.

The CPU 301 counts the recording materials 102 fed to the first fixing device 150 on the basis of the number information acquired from the later information.

Then, if the number information of the later information exceeds the predetermined number, the CPU 301 executes the refresh operation. If, on the other hand, the later number information does not exceed the predetermined number, the CPU 301 increases the count of the recording materials from the later number on the main assembly memory 312. For example, if the later one of the numbers in the main assembly memory 312 and the memory 154 is 30, the CPU 301 counts the recording materials 102 fed to the first fixing device 150, increasing the count to 31, 32, 33, and so on, on the main assembly memory 312. If the count on the main assembly memory 312 exceeds the predetermined number, the CPU 301 executes the fixing element refreshing operation. In this embodiment, the feeding of the recording material 102 into the first fixing device 150 is detected by the sensor 155. After the execution of the fixing element refreshing operation, the CPU 301 resets the count on the main assembly memory 312.

The count per one sheet may be weighted depending on the length of the recording material 102 measured in the feeding direction. That is, the values stored in the main assembly memory 312 and/or the memory 154 and counted on the main assembly memory 312 as the reference for the execution of the fixing element refreshing operation may be the ones corresponding to the feeding number of the recording materials 102 fed to the first fixing device 150. In this case, similarly to the main scan direction length information of the recording material 102, the length of the recording materials 102 in the feeding direction is acquired from the content of the printing job received by the CPU 301. The degree of the weighting is prestored in the ROM 303 and is acquired by the CPU 301.

The method for counting the feeding number on the basis of the information in the main assembly memory 312 and/or the memory 154 is not limited to that described above.

For example, the CPU 301 may count up the recording materials 102 fed into the first fixing device 150 on the memory 154 for each feeding thereof into the first fixing device 150. The CPU 301 counts the recording materials on the basis of the later one of the information of the information stored in the main assembly memory 312 and the information stored in the memory 154. Therefore, also in this case, the CPU 301, as the counter, counts the recording materials 102 fed to the first fixing device 150 on the basis of the main assembly memory 312 and the information in the memory 154 of the first fixing device 150 mounted in the main assembly.

The CPU 301 may count the recording materials 102 fed into the first fixing device 150 on the RAM 302 for each feeding into the first fixing device 150. The CPU 301 counts the recording materials on the basis of the later one of the information stored in the main assembly memory 312 and the information stored in the memory 154.

The CPU 301 may count the later feeding number plus the feeding number acquired from the memory 154 up to the predetermined number. More particularly, when the acquired later information is 30, the CPU 301 increments by one on the RAM 302 for each feeding of the recording material 102 into the first fixing device 150 on the main assembly memory 312. Assuming that the predetermined number is 500, the CPU 301 discriminates exceeding of the predetermined number when the count on the main assembly memory 312 reaches 470.

The reference on which the fixing element refreshing operation is executed may not be the number of the sheets of the recording material 102 fed into the first fixing device 150. For example, it may be a total of the lengths of the recording materials 102 in the feeding direction fed into the first fixing device 150. In this case, the memory 154 of the first fixing device 150 stores in the length information indicative of the length of the recording materials 102 fed to the first fixing device 150 in the feeding direction, the time and day information at which the length information is stored in the memory 154, and the identifying information in the discrimination portion. On the other hand, the main assembly memory 312 stores the length information which is the same as in the information stored in the memory 154, and the time and day information at which the length information is recorded in the memory 154 in correlation with the ID of the fixing device as the first fixing device 150. The CPU 301 adds (counts) the lengths of the recording materials 102 fed to the first fixing device 150 in feeding direction to the later length information. When the value exceeds the predetermined length, the CPU 301 executes the fixing element refreshing operation.

As the reference for executing the fixing element refreshing operation, the time period in which the fixing roller 151 carries out the fixing process may be used, for example. In such a case, the memory 154 of the first fixing device 150 stores the time period information in which the fixing roller 151 carries out the fixing process, the time and day information at which the time and day is recorded in the memory 154, and the identifying information in the discrimination portion. On the other hand, the main assembly memory 312 stores the time period information which is the same as in the information recorded in the memory 154, and the time and day information at which the time period information is recorded in the memory 154 in correlation with the ID of the fixing device as the first fixing device 150. The reference for the execution of the fixing element refreshing operation is a period of time (4000 sec, for example). More particularly, the timer (clock portion) 307 counts the time period in which the fixing roller 151 and the pressing belt 152 contact with each other. The CPU 301 sets the time of the time period information corresponding to the later time and day as the initial value of the timer 307. The timer 307 counts the time period in which the fixing roller 151 is in contact with the pressing belt 152, continuing from the set initial value. When the value of the timer 307 exceeds the predetermined time period, the CPU 301 executes the fixing element refreshing operation. Alternatively, the initial value of the timer 307 may be zero, in which the CPU 301 adds the time counted by the timer 307 to the time discriminated as later data, so that the total image fixing period of the fixing roller 151 is obtained.

Also when no information of the feeding number is stored in the main assembly memory 312 and/or the memory 154 (zero), the CPU 301 deems the information of the feeding number stored.

The main assembly memory 312 and/or the memory 154 may store the information other than the feeding number information. For example, the information indicative of the usage of a kind of the recording material processed by the first fixing device 150, such as an envelope or an A4 the size may be stored. In addition, in the case that the fixing device mountable to the first mounting portion 141 and the fixing device mountable to the second mounting portion 142 are different from each other, the information indicative of whether the fixing device is mountable to the first mounting portion 141 or to the second mounting portion 142 may be stored.

Furthermore, the main assembly memory 312 may store the information for a plurality of fixing devices.

(35.3. Mounting of Fixing Device)

The mounting of the first fixing device 150 will be described.

When the first fixing device 150 is to be exchanged, the operator opens the front door 140, and draws the first fixing device 150 out of the image forming apparatus 100 and then exchanges the fixing device. Then, the first fixing device 150 is moved in the opposite direction to set it in the image forming apparatus 400, and the front door 140 is closed.

The CPU 301 detects that the front door 140 is closed, on the basis of the signal from the opening and closing sensor 305. Upon the detection of the closure of the front door 140, the CPU 301 accesses the memory 154 of the first fixing device 150. By this, it is confirmed that the first fixing device 150 is mounted. If the CPU 301 is unable to access the memory 154, the CPU 301 discriminates that the first fixing device 150 is not mounted.

If the fixing device is exchanged in the OFF-state of the main switch 101, the opening and closing sensor 305 is unable to detect in the closure of the front door 140. Therefore, the CPU 301 accesses the memory 154 of the first fixing device 150 in response to the actuation of the main switch 101. By this, it is confirmed that the first fixing device 150 is mounted. If the CPU 301 is unable to access the memory 154, the CPU 301 discriminates that the first fixing device 150 is not mounted.

The method for discriminating whether or not the first fixing device 150 is mounted is not limited to that described above, and may be discriminated by electrical conduction or non-conduction state between the image forming apparatus 100 and the first fixing device 150, for example.

More particularly, the image forming apparatus 400 is provided with an ammeter, and the CPU 301 monitors an output of the ammeter, so that it can detect that the electric current flows. When the first fixing device 150 is mounted in the image forming apparatus 400, the ammeter and the first fixing device 150 are electrically connected with each other. By this, the ammeter is capable of detecting the current flowing to the first fixing device 150 when the first fixing device 150 is supplied with a predetermined voltage. If the ammeter detects the electric current upon the application of the predetermined voltages to the first fixing device 150, it means that the image forming apparatus 400 and the first fixing device 150 are electrically connected with each other, and therefore, the CPU 301 discriminates that the first fixing device 150 is mounted. On the hand, if the ammeter does not detect the current application of the predetermined voltage to the first fixing device 150, the first fixing device 150 is not electrically connected with the image forming apparatus 400, and therefore, the CPU 301 discriminates that the first fixing device 150 is not mounted.

(35.4. Count for Each Width Size)

Furthermore, in this embodiment, the feeding number is stored for each widthwise size of the recording material 102, and the feeding numbers for the respective widthwise sizes are stored in the main assembly memory 312 and/or the memory 154. The widthwise size measured in the direction perpendicular to the feeding direction of the recording material 102 is called the main scan direction length (or width size). FIG. 28 shows an example in which the feeding numbers are stored for each 5 mm main scan direction length of the recording material 102.

As described hereinbefore, the roughened area in the (III) boundary area is produced by the edge portions of the recording materials 102 repeatedly contacting the same position of the fixing roller 151 with respect to the direction of the rotational axis of the fixing roller 151. That is, the roughened area is produced with the increase of the feeding number of the recording materials 102.

By the fixing element refreshing operation, the surface state of the fixing roller 151 is uniformized in the entirety of the longitudinal range (i.e., the (I) non-passing portion, the (II) passing portion, and the (III) boundary area). Therefore, the unevennesses of the surface state of the fixing roller 151 produced by the edge portions of the recording materials 102 having different main scan direction lengths is also eliminated.

Therefore, in this embodiment, the number of the recording materials 102 fed into the first fixing device 150 is stored for each 5 mm of the main scan direction length of the recording material 102, in the main assembly memory 312 and the memory 154. When the feeding number for any one of the main scan direction lengths exceeds the predetermined number (500, in this example), the CPU 301 executes the fixing element refreshing operation. Thereafter, the feeding numbers for all of the main scan direction lengths are reset (zero). When the feeding number for any one of the main-scanning lengths exceeds the predetermined number, the CPU 301 executes the fixing element refreshing operation.

The information of the main scan direction length of the recording material 102 is acquired from the content of the printing job received by the CPU 301. When the operating portion 180 receives the printing job from the operator, it also receives the size of the recording material 102 (A3, for example) on which the image is to be formed, as one of the contents of the printing job. Thus, the operating portion 180 functions as the receiving portion.

By this, the glossiness unevenness on the output images can be suppressed, and also, the frequency of the fixing element refreshing operations is made lower than when the fixing element refreshing operation is carried out the irrespective of the main scan direction length of the recording material 102.

(36. Control Flow)

In Embodiment 13, the CPU 301 counts the feeding number of the recording materials 102 to the first fixing device 150, on the main assembly memory 312, for each main scan direction length (each width size). The CPU 301 renews and records the count of the feeding number corresponding to the ID of the writing portion on the main assembly memory 312, for each feeding of the recording material 102 to the first fixing device 150 on the basis of the signal from the sensor 155. In this manner, the CPU 301 functions as a counter.

When the count of the recording material 102 for any one of the main scan direction lengths exceeds the predetermined value during the printing operation, the fixing element refreshing operation is carried out after completion of the currently executing printing job, and then the apparatus shifts into the stand-by mode. That is, if the count at the time of the completion of the image forming operation exceeds the predetermined value, the fixing element refreshing operation is executed after the completion of the current printing job.

The CPU 301 stores the number information and the time and day information in the main assembly memory 312 and the memory 154.

Upon the actuation of the main switch 101 and the closure of the front door 140, the CPU 301 acquires the ID of the first fixing device 150 and the time information from the memory 154. The CPU 301 executes the fixing element refreshing operation if the later one of the pieces of the information, for any one of the main scan direction lengths, stored in the main assembly memory 312 and the memory 154 as the feeding number information for the first fixing device 150 exceeds the predetermined value. Thereafter, the apparatus shifts to the stand-by mode.

The description will be made in conjunction with the flow charts of FIGS. 24-27.

The operations of the flow charts are carried out by the CPU 301 functioning as the executing portion (recording portion) controlling the related mechanisms of the image forming apparatus 400 in accordance with the control program stored in the ROM 303. The description will be made as to the first fixing device 150, but the same applies to the second fixing device 170.

(36.1. Sequence Upon Actuation of the Main Switch and Upon Closing the Front Door)

Figure 24:
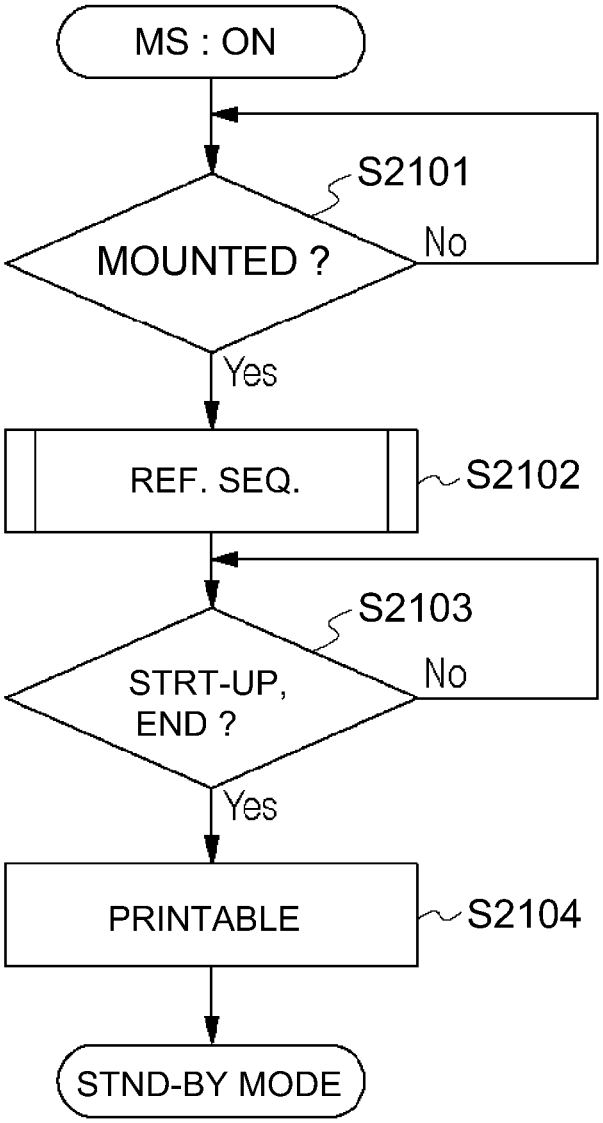
FIG. 24 is a flow chart showing the operations from the actuation of a main switch to a stand-by mode.

FIG. 24 is a flow chart showing the operations from the actuation of a main switch 101 to a stand-by mode.

With the actuation of the main switch 101, the CPU 301 starts. The CPU 301 discriminates whether or not the first fixing device 150 is mounted in the image forming apparatus 400 (S2101). If the first fixing device 150 is mounted on the apparatus 400, the CPU 301 can detect the ID of the fixing device. If the result of the discrimination at step S101 is negative, the operation returns to step S101. In such a case, the CPU 301 may display a message prompting the insertion of the first fixing device 150, on the operating portion 180. If the first fixing device 150 is mounted in the image forming apparatus 400, the operation proceeds to step S2102.

Figure 26:
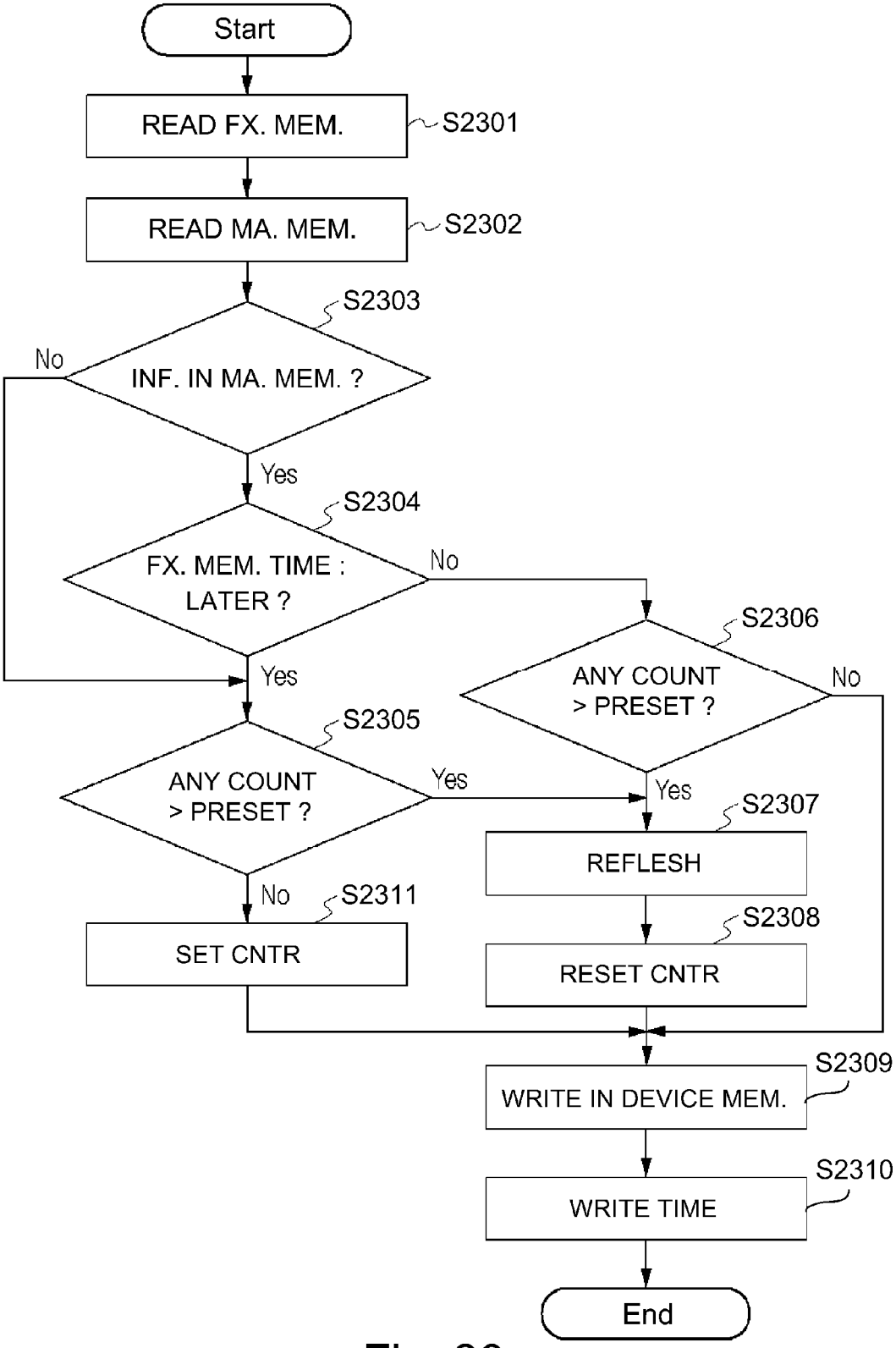
FIG. 26 is a flow chart of a refreshing sequence.

The CPU 301 carries out the refreshing sequence shown in FIG. 26 for the first fixing device 150 (S2102). The details of the operation will be described hereinafter.

In step S2103, the CPU 301 waits for the image forming apparatus 400 to become capable of carrying out the image. The CPU 301 carries out the preparing operation (starting-up operation) for the start of the image forming operation for various mechanisms such as the first fixing device 150 and the image forming stations 309, after the actuation of the main switch 101. The temperature control for the fixing roller 151 is one of them, for example.

When the image forming apparatus 400 becomes capable of carrying out the image forming operation after the completion of the starting-up operations (Yes, S2103), the CPU 301 displays "printable" or the like on the operating portion 180 (S2104). By this, the operator is notified of the fact that the image forming apparatus 400 has become capable of carrying out the image forming operation. The apparatus 400 is shifted into the stand-by mode.

Figure 25:
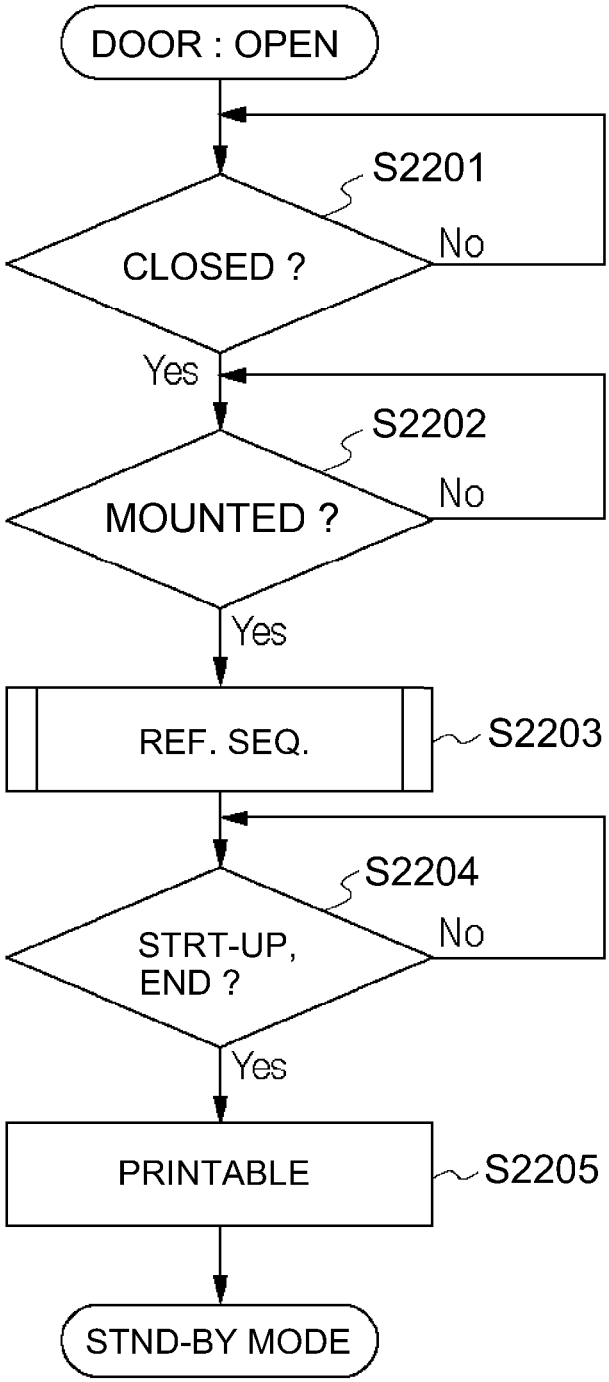
FIG. 25 is a flow chart showing the operations from the state in which a front door is open to the stand-by mode.

FIG. 25 is a flow chart showing the operations from the state in which a front door is open to the stand-by mode.

The opened and closed states of the front door 140 are detected by the CPU 301 on the basis of the signal from the opening and closing sensor 305 of the front door 140. When the front door 140 is open, the CPU 301 waits for the closing of the front door 140 (S2201). When the front door 140 is open, the CPU 301 may display information to prompt to close the front door 140. When the CPU 301 detects the closing of the front door 140 (S2201), the operation proceeds to step S2202. Steps S2202-S2205 are the same as steps S2101-S2104 of FIG. 24, and therefore, the description thereof is omitted. After step S2205, the operation proceeds to the stand-by mode.

(36.2. Refreshing Sequence)

FIG. 26 is a flow chart of a refreshing sequence. The flow chart of FIG. 26 shows steps S2102 and S2203, and the details of the refreshing sequence, which will be described hereinafter.

First, the CPU 301 reads out the data stored in the memory 154 of the first fixing device 150 mounted in the image forming apparatus 400 (S2301).

The CPU 301 reads the data out of the main assembly memory 312 (S2302).

In step S2303, the CPU 301 discriminates whether or not the main assembly memory 312 stores the information of the ID of the first fixing device 150. More particularly, the CPU 301 searches the data for the ID of the first fixing device 150 read out in step S2301 in the main assembly memory 312.

If any data for the ID of the first fixing device 150 read out in step S2301 is stored in the main assembly memory 312 (S2303, Yes), the CPU 301 proceeds to step S2304.

If, on the other hand, the main assembly memory 312 does not store the data for the ID of the first fixing device 150 read out in step S2301 (S2303, No), the CPU 301 proceeds to step S2305. In this case, the main assembly memory 312 does not store the number information for the first fixing device 150 mounted in the image forming apparatus 400.

If the result of discrimination in step S2303 is Yes, the CPU 301 discriminates which one of the number information of the memory 154 and the number information of the main assembly memory 312 is to be used (S2304). More particularly, the CPU 301 checks which one of the recording time of the information stored in the memory 154 and the information stored in the main assembly memory 312 is later.

If the time of the information record of the memory 154 is later than that of the main assembly memory 312 (S2304, Yes), the CPU 301 proceeds to step S2305.

On the other hand, if the information regarding time of the memory 154 is later than that stored in the main assembly memory 312 corresponding to the ID of the first fixing device 150 (S2304, No), the CPU 301 proceeds to step S2306. When they are the same, the CPU 301 proceeds to step S2306 (S2304, No).

If the result of discrimination in step S2304 is negative, the CPU 301 counts the recording materials on the basis of the number information of the main assembly memory 312. If, in step S2306, the number information of the main assembly memory 312 for the ID of the first fixing device 150 is not more than the predetermined number (500 in this example) for any of the feeding numbers for the main scan direction lengths, the CPU 301 proceeds to step S2309. In this case, the main assembly memory 312 already stores the feeding number to be set for the counter.

On the other hand, if, in step S2306, the number information of the main assembly memory 312 for the ID of the first fixing device 150 exceeds the predetermined number (500 in this example) for any one of the feeding numbers for the main scan direction lengths, the CPU 301 proceeds to step S2307.

In step S2307, the CPU 301 executes the above-described fixing element refreshing operation. By this, the surface of the fixing roller 151 is rubbed, so that the surface state is made even.

After the completion of the fixing element refreshing operation, the CPU 301 sets the counts for the respective main scan direction lengths to zero. That is, the counts in the main assembly memory 312 are reset (S2308). By this, when the feeding number for any one of the main-scanning lengths exceeds again the predetermined number after the execution of the fixing element refreshing operation, the CPU 301 can execute the fixing element refreshing operation. The CPU (recording portion, writing portion) 301 makes the records in correlation with the ID of the first fixing device 150. By this, the information indicative of the execution of the fixing element refreshing operation is recorded in the main assembly memory 312 in correlation with the ID of the first fixing device 150.

On the other hand, if the result of discrimination in S2303 is negative, or if the result of discrimination in S2304 is affirmative, the CPU 301 counts the recording material on the basis of the number information of the memory 154 of the first fixing device 150. If, in step S2305, the feeding number (count) for any one of the main scan direction lengths stored in the memory 154 exceeds the predetermined value, the CPU 301 proceeds to step S2307 to execute the fixing element refreshing operation. If, on the other hand, the feeding number (count) for any one of the main scan direction lengths stored in the memory 154 is not more than the predetermined value (500 in this example), the CPU 301 proceeds to step S2311.

In step S2311, the CPU 301 sets the feeding number for each main scan direction length on the memory 154 in the main assembly memory 312 as the count of the counter. That is, the counter is reset. The CPU (recording portion, writing portion) 301 makes and records the feeding number in correlation with the ID of the first fixing device 150. By this, the feeding number information can be recorded in the main assembly memory 312 in correlation with the ID of the first fixing device 150.

In step S2309, the CPU (recording portion, writing portion) 301 records the feeding number information in the memory 154. More particularly, the CPU 301 copies the counts set in the main assembly memory 312 in steps S2308 and S2311 in the memory 154, for each main scan direction length. In the case that the operation has proceeded through step S2308, for example, the feeding numbers for all the main scan direction lengths are set to zero in the memory 154.

In step S2310, the CPU 301 records the time and day information in the memory 154 and the main assembly memory 312. In the main assembly memory 312, the record is made in correlation with the ID of the first fixing device 150. In this embodiment, the time and day information is that at the completion of the process of step S2309.

The reading of the memory 154 in step S2301 and the reading of the main assembly memory 312 in step S2302 may be carried out in a plurality of steps. For example, the CPU 301 may fetch the necessary information from the memory 154 and/or main assembly memory 312 for each process of steps S2303, S2304, S2305, and S2306.

In steps S2308 and S2311, if the main assembly memory 312 does not store the information of the ID of the first fixing device 150 (No, in step S2303), the CPU 301 records the ID of the first fixing device 150. In steps S2308 and S2311, the CPU 301 stores the counts for the respective main scan direction lengths in correlation with the ID of the first fixing device 150 in the main assembly memory 312 as the count of the counter.

If the feeding number information in the memory 154 and the feeding number information to be written in the memory 154 in step S2309 are the same (No, in step S2305, for example) the CPU 301 may not change the data in step S2309.

The time and day recorded in step S2310 is not limited to that at the completion of the process of step S2309. For example, the time and day recorded in step S2310 may be the time and day of the completion of steps S2308 and/or S2311, or the time and day of the start of the process of step S2309.

The order of the operation of storing the number information, the time and day and the ID of the first fixing device 150 in the main assembly memory 312, and the operation of storing the number information and the time and day in the memory 154 is not limited to the order of steps S2308, S2309, and S2310. For example, as an alternative, the feeding number in the memory 154 is first made zero, and is stored as the time and day in the memory 154. Then, these two pieces of information may be copied from the memory 154 to the area in the main assembly memory 312 corresponding to the ID of the first fixing device 150, by which the counter is reset. In addition, steps S2308 and S2309 may be executed simultaneously, for example.

Further alternatively, the processes of steps S2309 and S2310 may be carried out in response to the detection of the opening of the front door 140 on the basis of the signal from the opening and closing sensor 305. In addition, the processes of steps S2309 and S2310 may be carried out in response to the deactuation of the main switch 101. This is because the exchange of the first fixing device 150 necessitates the opening of the front door 140.

In this embodiment, when the time and day information stored in the memory 154 and the time and day information stored in the main assembly memory 312 in correlation with the ID of the first fixing device 150 are the same, the CPU 301 effects the control on the basis of the feeding number information of the main assembly memory 312. In such a case, however, the CPU 301 may fix the control on the basis of the number information of the memory 154. In this case, when the time and day information stored in the memory 154 and the time and day information stored in the main assembly memory 312 in correlation with the ID of the first fixing device 150 are the same in step S2304, the CPU 301 proceeds to step S2305.

(36.3. Sequence for Recording Material Counting)

Figure 27:
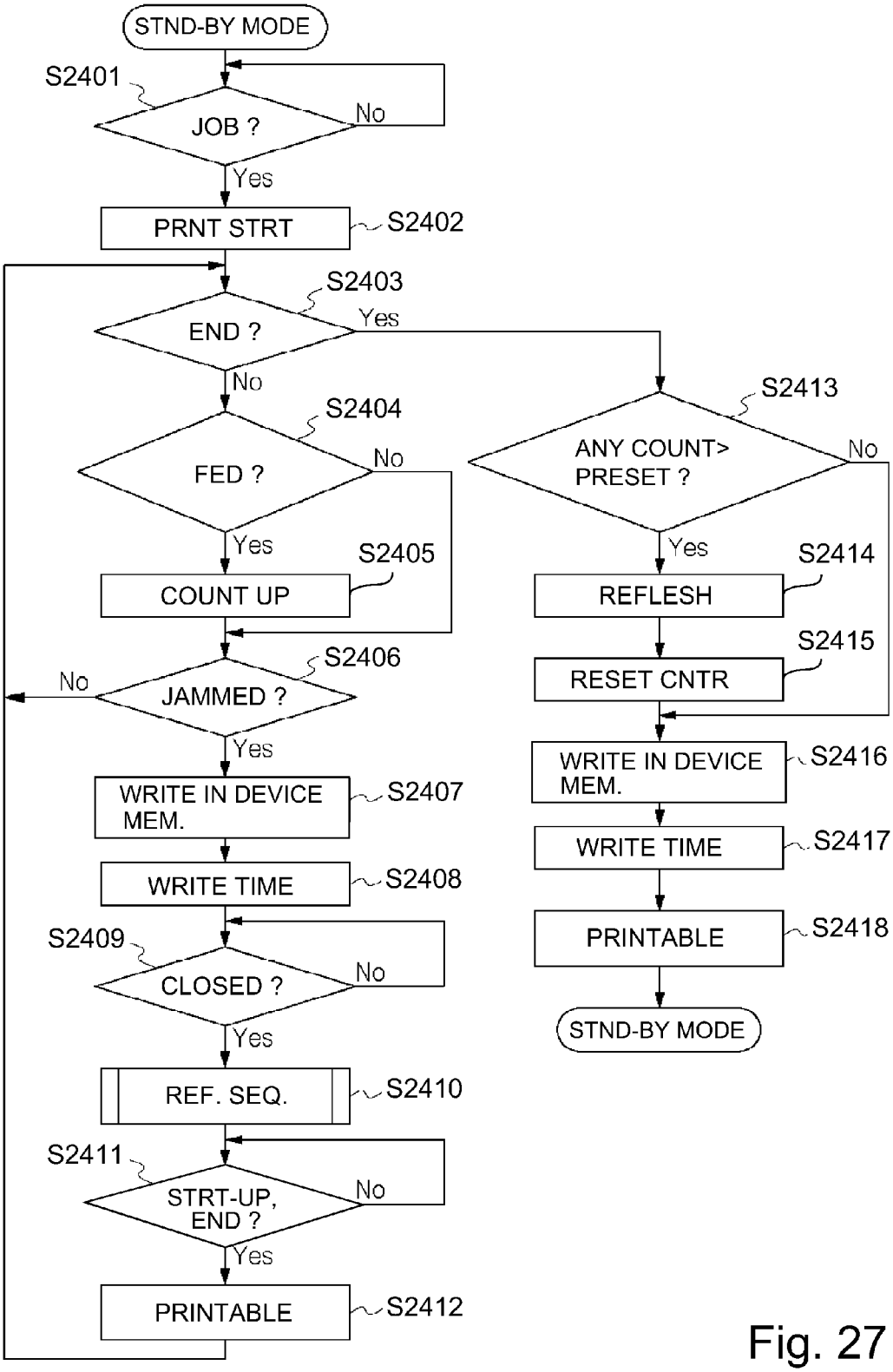
FIG. 27 is a flow chart of counting of the recording materials.

FIG. 27 is a flow chart of counting of the recording materials. More particularly, it is a flow chart of printing job execution by the image forming apparatus 400.

In the stand-by mode in which the image forming apparatus 400 is capable of carrying out the printing operation, it waits for the printing job from the operating portion 180 or an external PC or the like through the outside I/F portion 304 (S2401). At this time, the image forming apparatus 400 displays a selection screen for selecting the kind of the recording material 102 on the operating portion 180 or a display screen of the external PC and receives the kind of the recording material 102 to be used for the printing by the operator as a content of the printing job.

When the printing job is received (Yes, S2401), the CPU 301 controls the mechanisms such as the stations 120-123, the first fixing device 150, the second fixing device 170, or the like, of the image forming apparatus 400, and starts the image forming process operation of the image forming apparatus 400. In other words, the printing job is started (S2402).

If the CPU 301 detects the feeding of the recording material 102 to the first fixing device 150 (S2404, Yes) in the stage in which the printing job is not completed (in S2403, No), the CPU 301 increments the count on the main assembly memory 312. The CPU 301 increments the count corresponding to the main scan direction length of the fed recording material 102 for the ID of the first fixing device 150, of the counts on the main assembly memory 312. The information of the main scan direction length of the fed recording material 102 is acquired by the CPU 301 on the basis of the content of the printing job in step S2401. The CPU 301 detects the feeding of the recording material 102 to the first fixing device 150 depending on the signal from the sensor 155.

On the other hand, if the feeding of the recording material 102 to the first fixing device 150 is not detected in step S2404, the CPU 301 does not increment the count, and proceeds to step S2406. This occurs, for example, in the case that after the detection of the passage of the recording material 102, the passage of the next recording material 102 is not detected after elapse of predetermined time, despite the non-completion of the printing job. The predetermined time period is counted by the timer 307.

When no sheet jamming in the image forming apparatus 400 is detected (S2406, No), the CPU 301 continuous the operation for the printing job until the completion of the printing job, while repeating the operations of steps S2404 and S2405.

When the CPU 301 (recording portion, writing portion) detects the jamming in the image forming apparatus 400 (S2406), the CPU 301 records the count on the main assembly memory 312 for the main scan direction length in the memory 154 as the information of the feeding number (S2407). The CPU 301 detects the jamming in the image forming apparatus 400 on the basis of the signals from the sensor group 306. For example, in the case that, upon elapse of a predetermined time from the detection of the recording material 102 by the sensor disposed in the upstream side with respect to the feeding direction of the recording material 102, the sensor disposed in the downstream side does not detect the passage of the recording material 102, the CPU 301 discriminates that the recording material 102 stagnates in the portion between the two sensors. The predetermined time is counted by the timer 307.

In addition, the CPU (recording portion, writing portion) 301 stores the time and day information in the memory 154 and the main assembly memory 312 (S2408). In the main assembly memory 312, the record is made in correlation with the ID of the first fixing device 150. In this embodiment, the time and day information is that at the completion of the process of step S2407.

When the jamming occurs in the image forming apparatus 400, the CPU 301 interrupts the printing job. At this time, the jammed recording material stagnating in the feeding path of the image forming apparatus 400 is cleared by the operator, and therefore, the front door 140 or the like is opened.

The CPU 301 waits for the front door 140 to close (S2409). When the CPU 301 detects the closing of the front door 140 on the basis of the signal from the opening and closing sensor 305 (S2409), the refreshing sequence is carried out (S2410).

The refreshing sequence in step S2410 corresponds to the flow shown in FIG. 26. In the refreshing sequence, the data in the memory 154 in the first fixing device 150 is read out as described in the foregoing (S2301). The memory 154 is read out because there is a possibility that the first fixing device 150 is exchanged when the front door 140 is opened for the jam clearance.

In step S2411, the CPU 301 waits for the image forming apparatus 400 to become capable of carrying out the image forming operation. The CPU 301 carries out the preparing operation (starting-up operations) for resuming the image forming operation for various mechanisms such as the first fixing device 150, the image forming station 309 and the like of the image forming apparatus 400 after the clearance of the jammed recording material. The temperature control for the fixing roller 151 is one of them, for example.

When the image forming apparatus 400 becomes capable of resuming the image forming operation after the completion of the starting-up operations (Yes, S2411), the CPU 301 displays "printable" or the like on the operating portion 180

(S2412). By this, the operator is notified of the fact that the image forming apparatus 400 has become capable of carrying out the image forming operation. Thereafter, the operation returns to step S2403, and the CPU 301 resumes the operations for the remaining printing job and continues up to the completion of the printing job.

When the printing job is completed (S2403, Yes), the CPU 301 discriminates whether or not any one of the feeding numbers for all the main scan direction lengths correlated with the ID of the first fixing device 150 on the main assembly memory 312 exceeds the predetermined value (500 in this example) (S2413).

If the result of the discrimination is negative, that is, if the values of the feeding numbers for all of the main scan direction lengths stored in the main assembly memory 312 are less than the predetermined value (500 in this example), the CPU 301 proceeds to step S2416.

If the result of the discrimination is affirmative, that is, if a value of the feeding number for any one of the main scan direction lengths exceeds the predetermined value (500 in this example), the CPU 301 executes the fixing element refreshing operation (S2414). After the completion of the fixing element refreshing operation, the CPU 301 resets the values for all of the main scan direction lengths on the main assembly memory 312 to zero. That is, the counter values are reset (S2415).

In step S2416, the CPU 301 records the count of the main assembly memory 312 for each main scan direction length as the information of the feeding number. As the operation has proceeded through the flow of step S2415, the feeding numbers for all the main scan direction lengths as the information of the feeding number become zero.

In addition, the CPU (recording portion, writing portion) 301 stores the time and day information in the memory 154 and the main assembly memory 312 (S2417). In the main assembly memory 312, the record is made in correlation with the ID of the first fixing device 150. In this embodiment, the time and day information is that at the completion of the process of step S2416.

The CPU 301 displays "printable" on the operating portion 180 to notify of the operativity of the image forming apparatus 400 (S2418). The apparatus is shifted into the stand-by mode.

The information of the feeding number is stored in the memory 154 before entering the stand-by mode. By this, a correct feeding number can be stored in the memory 154 even when the first fixing device 150 is removed from the image forming apparatus 400 during the stand-by mode.

The writing in the memory 154 in step S2407 may be effected only when the jamming occurs in first fixing device 150 and/or the second fixing device 170 in step S2406. It is expected for the front door 140 to be opened by the operator after the occurrence of the jamming because the jamming occurs in the fixing portion. This is because in the case of the jamming in the fixing portion, the operator clears the recording material 102 stagnating in the first fixing device 150 and/or the second fixing device 170. The liability that the first fixing device 150 is exchanged by the operator arises when the front door 140 is opened.

In such a case, the sensors 153, 155 function as the jam detecting portion. The sensors may be an optical sensor, for example. The CPU 301 receives the signals from the sensors 153 and/or 155 to detect the stagnation of the recording material 102 in the first fixing device 150 (jamming in the fixing portion). For example, in the case that after the elapse of the predetermined period after the passage of the recording material 102 by the sensor 155 disposed at an upstream side with respect to the feeding direction of the recording material 102, the downstream side sensor 153 does not detect the passage of the recording material 102, the CPU 301 discriminates that the recording material 102 stagnates between the sensors 155 and 153. The predetermined time is counted by the timer 307.

In the fixing element refreshing operation in step S2307 (FIG. 26), and step S2414 (FIG. 27), the duration of the rubbing treatment by the refreshing roller 156 may not be constant. That is, the CPU 301 carries out the rubbing treatment for a time period corresponding to the amount, beyond the predetermined count (500 in this example), of the count (excess amount) of the feeding number for the main scan direction length.

For example, for the predetermined value of 500, when the count is 500 in step 2413, the rubbing treatment duration in step S2414 is 30 sec, and when the count is 600 in step S2413, the rubbing treatment duration in step S2414 is 40 sec.

In this case, the duration of the rubbing treatment may be gradually or stepwisely increased with the increase of the exceeding amount of the count. The data (table, function or the like) for providing the correspondence between the exceeding amount of the count relative to the predetermined value and the rubbing treatment duration is stored in the ROM 303 beforehand.

As described hereinbefore, the exchange of the first fixing device 150 by the operator necessitates the opening and closing of the front door 140 of the image forming apparatus 400. When the front door 140 of the image forming apparatus 400 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU 301 reads the information out of the memory 154 of the first fixing device 150 to acquire the data in the memory 154. The control is then effected on the basis of the later one of the pieces of the feeding number information stored in the memory 154 and the main assembly memory 312. By this, the CPU 301 can execute the fixing element refreshing operation for the first fixing device 150 on the basis of the more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

Embodiment 25

In Embodiment 24, when the count of the feeding number for any one of the main-scan direction lengths exceeds the predetermined value during the printing operation, the CPU 301 carries out the fixing element refreshing operation after the completion of the printing job, and then apparatus shifts to the stand-by mode.

In Embodiment 25, when the total count of the feeding numbers for the main-scan direction lengths exceeds the predetermined value, the CPU 301 executes the fixing element refreshing operation in the period of the printing job.

The same applies to the second fixing device 170.

In the description of this embodiment, the same reference numerals as in Embodiment 24 are assigned to the elements having the corresponding functions in this embodiment, and the detailed description thereof is omitted for simplicity.

In the following, the description will be made with respect to the first fixing device 150. The same applies to the second fixing device 170.

In the main assembly memory 312, the number of the recording materials 102 fed into the first fixing device 150 is stored for each 5 mm of the main scan direction length of the recording material 102 in correlation with the ID of the first fixing device 150. After the total of the feeding numbers for the respective main scan direction lengths exceeds the predetermined value (500 in this example), the fixing element refreshing operation is executed for the first fixing device 150, by the CPU 301. Thereafter, the feeding numbers for all of the main scan direction lengths correlated with the ID of the first fixing device 150 are reset (zero). When the total count exceeds the predetermined value (500 in this example), again, the CPU 301 executes the fixing element refreshing operation.

In place of counting the recording materials for each main scan direction length on the main assembly memory 312, all the recording materials fed into the first fixing device 150 may be counted irrespective of the main scan direction length.

The fixing element refreshing operation in this embodiment (in the period of the execution of the printing job) may be carried out after the interruption of the printing job (that is, by expanding the interval between the adjacent recording materials 102 fed into the first fixing device 150), or while printing is continuously carried out (that is, while executing the fixing process operation). However, the former is preferable. In such a case, the likelihood of the production of the disturbance of the toner image during the fixing process operation attributable to the vibration or the like caused by the contact of the refreshing roller 156 to the fixing roller 151 for the execution of the fixing element refreshing operation can be reduced.

(Control Flow)

Referring to flow charts of FIGS. 24 and 25 of Embodiment 24 and the flow charts of FIGS. 29 and 30, the description will be made. The operations in flow chart are carried out by the CPU 301 as the executing portion controlling the operation of the various mechanisms of the image forming apparatus 400 on the basis of control programs stored in the ROM 303. The description will be made as to the first fixing device 150, but the same applies to the second fixing device 170.

(37.1. Sequence Upon Actuation of the Main Switch and Upon Closing the Front Door)

The sequence upon actuation of the main switch and upon closing the front door will be described referring to the flowchart of FIGS. 24 and 25.

In this embodiment, in steps S2102 (FIG. 24) and S2203 (FIG. 25), the operation proceeds to the refreshing sequence of FIG. 29.

As to the other structures, they are the same as those of Embodiment 24, and the descriptions thereof are omitted for the sake of simplicity.

(37 2. Refreshing Sequence)

FIG. 29 is a flow chart of a refreshing sequence. The flow chart of FIG. 29 shows the details of step S2102 (FIG. 25), and step S2203 (FIG. 25) and the refreshing sequence in step S2615 which will be described hereinafter.

Steps S2501-S2504 are the same as steps S2301-S2304 of FIG. 26, and therefore, the description thereof is omitted for the sake of simplicity.

If the result of discrimination in S2504 is negative, the CPU 301 makes a discrimination in step S2506 on the basis of the number information stored in the main assembly memory 312 corresponding to the ID of the fixing device acquired in step S2501. If the total count of the feeding numbers for all of the main scan direction lengths correlated with the ID of the first fixing device 150 is not more than the predetermined number (500 in this example) in step S2506, the CPU 301 proceeds to step S2509. In this case, the main assembly memory 312 already stores the feeding number to be set for the counter. If the result of discrimination in step S2506 is negative, the operation may proceed to step S2511.

If, on the other hand, the total count of the feeding numbers for all of the main scan direction lengths correlated with the ID of the first fixing device 150 exceeds the predetermined number (500 in this example) in step S2506, the CPU 301 proceeds to step S2507.

The step S2507 is the same as step S2307 of FIG. 26, and therefore, the description thereof is omitted.

After the completion of the fixing element refreshing operation, the CPU 301 sets the counts for the respective main scan direction lengths to zero. That is, the counts in the main assembly memory 312 are reset (S2508). By this, when the total count exceeds again the predetermined number after the execution of the fixing element refreshing operation, the CPU 301 can execute the fixing element refreshing operation. The CPU 301 makes the recording in correlation with the ID of the first fixing device 150. By this, the information indicative of the execution of the fixing element refreshing operation is recorded in the main assembly memory 312 in correlation with the ID of the first fixing device 150.

Steps S2509 and S2510 are the same as steps S2309 and S2310 of FIG. 26, and therefore, the description thereof is omitted.

On the other hand, if the result of discrimination in step S2503 is negative, and if the result of discrimination in step S2504 is affirmative, the CPU 301 makes and the discrimination in step S2505 on the basis of the number information of the memory 154 of the first fixing device 150. In step S2505, the total count of the feeding numbers for all of the main scan direction lengths stored in the memory 154 exceeds the predetermined number (500 in this example), the CPU 301 proceeds to step S2507 to execute the fixing element refreshing operation. If, on the other hand, the total count of the feeding numbers for all of the main scan direction lengths stored in the memory 154 is not more than the predetermined number (500 in this example), the CPU 301 proceeds to step S2511.

A step S2511 is the same as step S2311 of FIG. 26, and therefore, the description thereof is omitted.

(37.3. Sequence for Recording Material Counting)

FIG. 30 is a flow chart of counting of the recording materials. More particularly, it is a flow chart of printing job execution by the image forming apparatus 400.

Steps S2601 and S2602 are the same as steps S2401 and S2402 (FIG. 27), and therefore, the description is omitted.

If the CPU 301 detects that the recording material 102 is fed to the first fixing device 150 (S2604, Yes) before the printing job is finished (S2603, No), the CPU 301 increments the count of the main assembly memory 312. The CPU 301 increments the count for the ID of the first fixing device 150. The ID of the first fixing device 150 has already been acquired in step S2501 of the refreshing sequence of FIG. 29 which is executed in response to the actuation of the main switch 101 or the closure of the front door 140. The CPU 301 increments the count for the main scan direction length of the recording material 102 fed to the fixing device, of the counts stored in the main assembly memory 312. The information of the main scan direction length of the fed recording material 102 is acquired by the CPU 301 on the basis of the content of the printing job in step S2601. The CPU 301 detects the feeding of the recording material 102 to the first fixing device 150 depending on the signal from the sensor 155.

On the other hand, if the feeding of the recording material 102 to the first fixing device 150 is not detected in step S2604, the CPU 301 does not increment the count, and proceeds to step S2606. This occurs, for example, in the case that after the detection of the passage of the recording material 102, the passage of the next recording material 102 is not detected after elapse of predetermined time, despite the non-completion of the printing job. The predetermined time period is counted by the timer 307.

If the CPU 301 detects the jamming in the image forming apparatus 400 (S2606), the CPU 301 proceeds to step S2612.

The steps S2612-S2614 are the same as steps S2407-S2409 of FIG. 27, respectively.

In step S2615, the CPU 301 executes the refreshing sequence of FIG. 29.

The steps S2616-S2617 are the same as steps S2411-S2412 of FIG. 27, respectively.

If the jamming in the image forming apparatus 400 is not detected in step S2606, the CPU 301 proceeds to step S2607.

In step S2607, the CPU 301 discriminates whether or not the total count of the feeding numbers for all of the main scan direction lengths correlated with the ID of the first fixing device 150 in the main assembly memory 312 exceeds the predetermined number (500 in this example).

If the total count of the feeding numbers for all of the main scan direction lengths correlated with the ID of the first fixing device 150 is not more than the predetermined number (500 in this example) in step S2607, the CPU 301 proceeds to step S2603. The CPU 301 continuous the execution of the printing job until it is finished.

If, on the other hand, the total count of the feeding numbers for all of the main scan direction lengths correlated with the ID of the first fixing device 150 exceeds the predetermined number (500 in this example) in step S2607, the CPU 301 proceeds to step S2608.

In step S2608, the CPU 301 executes the fixing element refreshing operation.

Steps S2602-S2611 are the same as steps S2415-S2417 of FIG. 27, and therefore, the description thereof is omitted for the sake of simplicity.

Thereafter, the operation returns to step S2603, where the CPU 301 continues the printing job until the printing job is finished.

After the printing job is completed (S603, Yes), the CPU 301 shifts to the stand-by mode.

As described hereinbefore, the exchange of the first fixing device 150 by the operator necessitates the opening and closing of the front door 140 of the image forming apparatus 100. When the front door 140 of the image forming apparatus 400 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU 301 reads the information out of the memory 154 of the first fixing device 150 to acquire the data in the memory 154. The control is then effected on the basis of the later one of the pieces of the feeding number information stored in the memory 154 and the main assembly memory 312. By this, the CPU 301 can execute the fixing element refreshing operation for the first fixing device 150 on the basis of the more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

Embodiment 26

In Embodiment 24 and Embodiment 25, the CPU (recording portion, writing portion) 301 stores the time and day information in the memory 154 and the main assembly memory 312 as the information for discriminating which information in the memory 154 and the main assembly memory 312 should be based. The same applies to the second fixing device 170.

In this embodiment, the information indicative of the number of the recordings into the memory 154 is stored in place of the time and day information.

The description will be made particularly on the difference from Embodiment 24. In the description of this embodiment, the same reference numerals as in Embodiment 24 are assigned to the elements having the corresponding functions in this embodiment, and the detailed description thereof is omitted for simplicity.

The description will be made as to the first fixing device 150, but the same applies to the second fixing device 170.

In this embodiment the memory 154 of the first fixing device 150 as the fixing storing portion stores the number information and a cumulative number of recordings of the number information (number information) in the memory 154. The memory 154 stores the ID of the fixing device (fixing device A, for example) as the identifying information for discriminating the fixing device from the other fixing devices, and therefore, the memory 154 functions as the discrimination portion.

On the other hand, the main assembly memory 312 as the main assembly storing portion stores the same number information recorded in the memory 154, the number information in correlation with the fixing device ID of the first fixing device 150.

The CPU 301 renews and records the number of the number information stored in the memory 154 each time the number information is recorded in the memory 154.

The CPU 301 compares the number information stored in the memory 154 of the first fixing device 150 mounted in the image forming apparatus 400 and the number information stored in the main assembly memory 312, and discriminates which is larger. The CPU 301 counts the feeding number on the basis of the number information with the larger one of the number information.

In this embodiment, the memory 154 stores the cumulated count of the recordings of the number information as the number information, but the cumulative number may be counted including the number of recordings other than the number information. In such a case, when (1) the information other than the number information is written, (2) the number information is written, and then (3) the number information is written, the cumulative number is three.

(38. Control Flow)

Referring to flow charts of FIGS. 24 and 25 of Embodiment 24 and the flow charts of FIGS. 31 and 32, the description will be made. The operations in flow chart are carried out by the CPU 301 as the executing portion controlling the operation of the various mechanisms of the image forming apparatus 400 on the basis of control programs stored in the ROM 303. The description will be made as to the first fixing device 150, but the same applies to the second fixing device 170.

(38.1. Sequence Upon Actuation of the Main Switch and Upon Closing the Front Door)

The sequence upon actuation of the main switch and upon closing the front door will be described referring to the flowchart of FIGS. 24 and 25.

In this embodiment, in steps S2102 (FIG. 24) and S2203 (FIG. 25), the operation proceeds to the refreshing sequence of FIG. 31.

As to the other structures, they are the same as those of Embodiment 24, and the description thereof are omitted for the sake of simplicity.

(38.2. Refreshing Sequence)

FIG. 31 is a flow chart of a refreshing sequence. The flow chart of FIG. 31 shows the details of step S2102 (FIG. 24), and step S2203 (FIG. 25) and the refreshing sequence in step S2810, which will be described hereinafter.

The steps S2701-S2703 are the same as steps S2301-S2303 of FIG. 26, respectively.

If the result of discrimination in the step S2703 is Yes, the CPU 301 discriminates which one of the number information of the memory 154 and the number in the main assembly memory 312 is to be used (S2704). More specifically, it is discriminated as to whether or not the number-of-times information stored in the memory 154 is larger than the number-of-times information stored in the main assembly memory 312 in correlation with the ID of the first fixing device 150.

If the result of the discrimination is affirmative (S2704, YeS2), the CPU 301 proceed to step S2705.

If, on the other hand, the results of the discrimination is negative (S2704, No), the CPU 301 proceeds to step S2706. If, the number-of-times information stored in the memory 154 is the same as the number-of-times information stored in the main assembly memory 312 in correlation with the ID of the first fixing device 150 (S2704, No), the CPU 301 proceeds to step S2706.

The step S2705 is the same as step S2305 of FIG. 26.

The step S2706 is the same as step S2306 of FIG. 26.

The step S2707 is the same as step S2307 of FIG. 26.

The step S2708 is the same as step S2308 of FIG. 26.

The step S2709 is the same as step S2309 of FIG. 26.

In step S2710, the CPU 301 stores the number-of-times information in the memory 154 and the main assembly memory 312. In the main assembly memory 312, the record is made in correlation with the ID of the first fixing device 150. When the larger one of the number-of-times as a result of comparison in step S2704 (larger one of the number-of-times information stored in the memory 154 and the number-of-times information stored in the main assembly memory 312 in correlation with the ID of the first fixing device 150) is N, the N+1 is recorded as the number-of-times information at step S2710. Here, N is an integer not less than 0. In step S2710, N+1 is stored as the number-of-times information.

Step S2711 is the same as step S2311 of FIG. 26.

(38.3. Sequence for Recording Material Counting)

FIG. 32 is a flow chart of counting of the recording materials. More particularly, it is a flow chart of printing job execution by the image forming apparatus 400.

The steps S2801-S2807 are the same as steps S2401-S2407 of FIG. 27, respectively.

In step S2808, the CPU 301 stores the number-of-times information in the memory 154 and the main assembly memory 312. Here, when the number-of-times information stored in the memory 154 and the main assembly memory 312 indicate M, the number-of-times information M+1 is recorded. In the main assembly memory 312, the record is made in correlation with the ID of the first fixing device 150.

Upon the actuation of the main switch, the opening of the front door 140, the above-described refreshing sequence (FIG. 31) after the jam clearance, the same number-of-times information is recorded in the memory 154 and the main assembly memory 312.

The step S2809 is the same as step S2409 of FIG. 27.

In step S2810, the CPU 301 executes the refreshing sequence of FIG. 31.

The steps S2812-S2812 are the same as steps S2411-S2412 of FIG. 27, respectively.

The steps S2813-S2816 are the same as steps S2413-S2416 of FIG. 27, respectively.

In step S2817, the CPU 301 stores the number-of-times information in the memory 154 and the main assembly memory 312. Here, when the number-of-times information stored in the memory 154 and the main assembly memory 312 indicate L, the number-of-times information L+1 is recorded. In the main assembly memory 312, the record is made in correlation with the ID of the first fixing device 150.

The step S2818 is the same as the step S2418 of FIG. 27.

As described hereinbefore, the exchange of the first fixing device 150 by the operator necessitates the opening and closing of the front door 140 of the image forming apparatus 400. When the front door 140 of the image forming apparatus 400 is opened by the operator, the first fixing device 150 may be exchanged. In addition, when the main switch 101 is off, the first fixing device 150 may have been exchanged. Therefore, upon the actuation of the main switch 101 of the image forming apparatus 400 and/or the closure of the front door 140, the CPU 301 reads the information out of the memory 154 of the first fixing device 150 to acquire the data in the memory 154. The control is then effected on the basis of the later one of the pieces of the feeding number information stored in the memory 154 and the main assembly memory 312. By this, the CPU 301 can execute the fixing element refreshing operation for the first fixing device 150 on the basis of the more accurate information of the feeding number, and therefore, the deterioration of the image quality of the image on the output recording material 102 can be suppressed.

In the description of the foregoing embodiment, the description has been made with respect to the first fixing device 150, but the same applies to the second fixing device 170.

In the foregoing, an integer not less than 0 is recorded as the number-of-times information, and the number-of-times information is incremented by 1 for each recording of the information in the memory 154 by the CPU 301, but the number-of-times information recording method is not limited to such an example. Referring to FIG. 31, another method will be described.

The number of times which is larger as a result of comparison in step S2704 between the number-of-times information stored in the memory 154 and the number-of-times information stored in the main assembly memory 312 in correlation with the ID of the first fixing device 150 is X. Suppose that in step S2710, the CPU 301 records X+Y as the number-of-times information.

At this time, Y may be 0.1, so that the CPU 301 increments the number-of-times information by 0.1 for each recording of the information in the memory 154. In such a case, the number of times (X, Y, X+Y) of the number-of-times information includes a non-integer.

At this time, Y may be 2, so that the CPU 301 increments the number-of-times information by 2 for each recording of the information in the memory 154.

Alternatively, Y may be −1, so that the CPU 301 decrements the number-of-times information by 1 for each recording of the information in the memory 154. In this case, the number of times (X, Y, X+Y) of the number-of-times information includes a negative number. Further in this case, in step S2704, the CPU 301 proceeds to step S2705, if the value indicated by the number-of-times information of the memory 154 is smaller than the value indicated by the number-of-times information of the main assembly memory 312 correlated with the ID of the first fixing device 150 (S2704, YeS2). For example, this is the case when the number-of-times information of the memory 154 indicates −4, and the number-of-times information of the main assembly memory 312 indicates −2. If, on the other hand, the value indicated by the number-of-times information of the memory 154 is not smaller than the value indicated by the number-of-times information of the main assembly memory 312 correlated with the ID of the first fixing device 150 (S2704, No), the CPU 301 proceeds to step S2706.

In the foregoing, the description that has been made particularly about the difference from Embodiment 24, but this embodiment may be incorporated in the Embodiment 25 in place of the time and day information stored in the memory 154. The detailed description of such a modification is omitted for the sake of simplicity.

Embodiment 27

In foregoing Embodiments 24-26, the IDs of the fixing device as the identifying information are stored in the memories 154, 174, respectively, and therefore, the memories 154, 174 function also as the discrimination portion, but the method for discriminating the fixing device is not limited to such a method.

For example, resistors as the discrimination portions may be provided on the first fixing device 150, the second fixing device 170 and the replacement fixing device prepared outside the image forming apparatus 400.

The resistors provided on them have resistance values different from each other.

In the state that the first fixing device 150 is mounted in the image forming apparatus 400, a current flowing through the resistor upon the application of a predetermined voltage across the resistor of the first fixing device 150 is detected.

More specifically, the image forming apparatus 400 includes, as the means for discriminating the first fixing device 150, a voltage application portion for applying the predetermined voltage across the resistor and an ammeter for measuring the current flowing through the resistor. The CPU 301 monitors the output of the ammeter.

When the regular voltage is applied, the current corresponds to the resistance value one by one because of the Ohm's law. The CPU 301 acquires an output of the ammeter predetermined resistance of the resistor. The first fixing device 150 and the replacement fixing device have the resistors having different resistance values, and therefore, the CPU 301 is capable of discriminating the fixing device depending on the difference of the output of the ammeter. Thus, the resistance value is the identifying information.

The CPU 301 stores resistance value acquired from the resistor of the first fixing device 150 mounted in the main assembly in correlation with the number information and the time and day information in main assembly memory 312.

In this case, in step S2301 (Embodiment 24) of FIG. 26, step S2501 (Embodiment 25) of FIG. 29, or step S2701 of FIG. 31, the CPU 301 acquires the resistance value of the resistor of the first fixing device 150 through the above-described method concurrently with the reading of the information from the memory 154 of the first fixing device 150.

The method of writing (recording) the ID of the fixing device into the main assembly memory 312 is not limited to the use of the resistance value as the identifying information. For example, the main assembly memory 312 may include a Table of the correspondence between the resistance values of the resistors, and the number information may be recorded in correlation with the name of the fixing device (fixing device A, for example).

The CPU 301 may use the output of the ammeter as the identifying information without acquiring the resistance value of the resistor. That is, the CPU 301 may record the output of the ammeter in the main assembly memory 312 as in the ID of the fixing device.

The same applies to the means for discriminating the second fixing device 170.

In this case, the discrimination member 311 includes the voltage application portion and the ammeter for discriminating the first fixing device 150, and the voltage application portion and the ammeter for discriminating the second fixing device 170. The CPU 301 is connected with the discrimination member 311 to discriminate the first fixing device 150 and/or the second fixing device 170 mounted in the image forming apparatus 400. When the first fixing device 150 is mounted in the image forming apparatus 400, the discrimination member 311 becomes electrically connectable with the resistor of the first fixing device 150. In addition, when the second fixing device 170 is mounted in the image forming apparatus 400, the discrimination member 311 becomes electrically connectable with the resistor of the second fixing device 170.

Embodiment 28

As for another example of the method for discriminating the fixing device, a DIP switch is usable as the discrimination portion provided on the fixing device (first fixing device 150, second fixing device 170 and replacement fixing device).

More particularly, the switches different depending on the individual fixing devices are in ON state beforehand (the on-off state and position of the switches are different depending on the fixing devices). The CPU 301 is connected with the DIP switch of the fixing device mounted in the image forming apparatus 400, and the switch in ON state produces a signal to the CPU 301 in response to an input signal from the CPU 301. The CPU 301 detects the signal from the ON state switch (acquires the fixing device ID) to discriminate the fixing device.

For example, the CPU 301 supplies signals to the first and second switches. When the CPU 301 detects the output signal from the first switch, the CPU 301 discriminates it is the fixing device A, when the CPU 301 detects the output signal from the second switch, it is the fixing device B, and when the CPU 301 detects the signals from both of the first and second switches, it is the fixing device C.

In this case, the discrimination member 311 shown in FIG. 23 includes the DIP switch for discriminating the first fixing device 150 and the DIP switch for discriminating the second fixing device 170. The CPU 301 is connected with the DIP switches (discrimination member 311) of the first fixing device 150 and/or second fixing device 170 mounted in the main assembly of the image forming apparatus 400, and discriminates them.

Embodiment 29

The image forming apparatus 400 may be set at a mode not executing the above-described fixing element refreshing operation, by the setting of the user. In such a case, the operating portion 180 is provided with a selector which displays for the selection between the mode in which the fixing element refreshing operation is executed and the mode in which it is not executed. The user is capable of selecting one of the modes through the operating portion 180. The information of the selected mode is stored in the main assembly memory 312 as the set information of the image forming apparatus 400. The operation program to be executed when the fixing element refreshing operation non-executing mode is selected is stored in the ROM 303. When such a mode is selected, the CPU 301 executes the program.

The fixing element refreshing operation is necessary in order to suppress the glossiness non-uniformity due to the difference in the surface roughness between the (I) non-passing portion, the (II) passing portion, and the (III) boundary area of the fixing roller 151, as described hereinbefore. The difference in the surface roughness of the fixing roller 151 appears as the glossiness unevenness when the recording material 102 passes through the nip in contact with the (I) non-passing portion, the (II) passing portion, and the (III) boundary area of the fixing roller 151. Therefore, the glossiness unevenness can be suppressed by using the different fixing device having the same structure, for the respective main scan direction length of the recording material 102 as the first fixing device 150. In view of this, some user who is concerned with the glossiness property evenness prepares the fixing devices for respective main scan direction length of the recording material 102 in order to avoid the deterioration of the print quality.

In such a case, that is, the glossiness unevenness caused by the edge portions of the recording materials 102, it is desirable not to execute the fixing element refreshing operation to avoid the fine scores provided by the refreshing roller 156 influences the glossiness property of the image.

By making the modes (execution and non-execution of the fixing element refreshing operation) selectable by the user, the apparatus can meet wider needs of the users.

Embodiment 30

With respect to the embodiments 24-29, the contact of the end portions of the recording materials 102 with the fixing roller 151 is taken as the cause of the difference in glossiness on the fixed image, but the causes are not limited to that. For example, a separation claw contacting the fixing roller 151 may be provided to prevent the recording material 102 from wrapping around the fixing roller 151.

In such a case, with the cumulation of the fixing process, there is a likelihood that contact damage may occur by the contact of the separation claw to the surface of the fixing roller 151. In the case that a plurality of separation claws are provided at intervals in the longitudinal direction (axial direction) of the fixing roller 151, the surface of the fixing roller 151 is roughened adjacent to the contact position with separation claw, with the result of unevenness of the surface state over the length of the fixing roller 151. As a result, the glossiness difference may arise on the fixed image.

Even in such a case, the influence to the image quality by the contact damage can be reduced by providing the refreshing roller 156 and executing the fixing element refreshing operation.

Embodiment 31

In Embodiments 24-30, the refreshing roller 156 is provided for the fixing roller 151, and the surface of the fixing member is rubbed, but a rubbing rotatable member may be provided for a surface of a pressing belt 152 and/or a pressing roller 172 to rub the surface of the pressing member.

Embodiment 32

A plurality of image forming apparatuses 400 described in the foregoing may be used to constitute an image forming system.

Embodiment 33

In the exchangeable fixing device system, the user exchanges the fixing devices depending on the kind of the recording material 102 or the preference. In such a case, there is a possibility that a better quality prints can be provided if the fixing device not selected by the operator is used, that is, there is a likelihood that the advantage of the exchanging system is not enjoyed. Therefore, the image forming apparatus 400 notifies the operator of the matching between the selected recording material 102 and the selected fixing device.

In the following, the description will be made referring to an Embodiment 24 (FIGS. 26 and 27). The other structures are the same as in Embodiment 24, and therefore, the detailed description thereof is omitted for simplicity. The description will be made as to the first fixing device 150, but the same applies to the second fixing device 170.

The memory 154 of the first fixing device 150 stores limiting information indicative of the kinds of the recording material 102 to be used with the first fixing device 150, and functions as a limitation information portion.

In step S2301 of FIG. 26, the CPU 301 acquires the limiting information concurrently with acquiring the information of the memory 154 of the first fixing device 150 mounted in the image forming apparatus 400. The CPU 301 acquires the kinds of the recording material 102 to be limited for the first fixing device 150 on the basis of the limiting information.

In step S2401 of FIG. 27, when the CPU 301 receives the printing job from the operator, the CPU 301 makes non-selectable the kinds of the recording material 102 not suitable for the first fixing device 150 on the selection screen.

Thus, the printing operation using improper first fixing device 150 can be prevented, thus assuring high quality prints.

The foregoing description has been made with respect to the first fixing device 150, but it is applicable to the second fixing device 170, and therefore, the description as to the second fixing device 170 will be omitted.

In this embodiment, the memories 154, 174 are used as the limiting information portion, but the following structure is usable.

For example, a resistor may be used. The first fixing device 150 is provided with a resistor functioning as a limiting information portion. The fixing device prepared outside the image forming apparatus 400 as a replacement fixing device is also provided with a resistor as the limiting information portion. The resistance value is different depending on the kind of the recording material 102 for which the fixing process of the first fixing device 150 is limited, and functions as the information for limiting the kind of the recording material 102 for use in the fixing process of the first fixing device 150. The method for acquiring the limiting information is the same as the method for acquiring the ID of the above-described fixing device (foregoing embodiments), and the description thereof is omitted.

In the main assembly memory 312, the information indicative of the kind of the recording material 102 to be limited in the fixing process corresponding to the resistance value (limiting information) of the memory (limiting information portion) is stored beforehand. For example, when the resistance value is R4, the fixing on envelope is prevented, and when the resistance value is R5, the fixing on thick sheet is prevented.

The information corresponding to the kinds of the recording material 102 to be prevented may not be stored in the main assembly memory 312 in combination with the limiting information. For example, the program executed by the CPU 301 may prevent the fixing process on the recording material 102 depending on the resistance value of the resistor (limiting information portion). In such a case, the program is stored in the ROM 303.

For example, the limiting information portion provided on the fixing device (first fixing device 150, second fixing device 170, and replacement fixing device) may be DIP switch including a plurality of switches. In such a case, the switches different depending on the fixing devices are in ON state beforehand as the limiting information, and the CPU 301 determines the kind of the recording material 102 to be prevented on the basis of the signal from the ON state switches. The other structures are the same as those of the DIP switch as the discrimination portion described hereinbefore.

In this embodiment, the limiting information portion and the discrimination portion are separate members on the fixing device, but one resistor or memory may include the limiting information portion and the discrimination portion.

In addition, this embodiment may be incorporated in Embodiment 25 or 26, although the description is made with respect to the case in which this embodiment is incorporated in Embodiment 24. The description as to the case in which this embodiment is incorporated in Embodiments 25 and 26 is omitted, because the foregoing description applies to such a case.

Embodiment 34

In the foregoing description of Embodiments 24-33, the operating portion 180 is provided with a display screen and a selection key, but the display screen may be a touch panel which also functions as a selector.

Embodiment 35

In the foregoing Embodiments 24-34, the image forming apparatus 400 comprises both of the first fixing device 150 and the second fixing device 170 (tandem fixing). However, the present invention is applicable to an image forming apparatus 400 comprising only one fixing device 150.

Embodiment 36

In the Embodiments 24-35, the image forming apparatus 400 comprises the image forming stations (120-123) for forming yellow, magenta, cyan, and black toner images (color image forming apparatus), but the present invention is applicable to a monochromatic image forming apparatus. For example, there is a monochromatic image forming station for forming the toner images in black only.

Embodiment 37

In the Embodiments 24-36, the image forming apparatus 400 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 400 feeds the recording material 102 from a recording material accommodating portion 103 to the transfer feeding belt. The transfer feeding belt electrostatically attracts the recording material 102 and carries it to a position where the recording material 102 faces the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-151202 filed on Jul. 30, 2015, 2015-151203 filed on Jul. 30, 2015, and 2015-151204 filed on Jul. 30, 2015, which are hereby incorporated by reference herein in their entirety.

What is claimed is:

1. An image forming apparatus comprising:

(a) an image forming station configured to form an unfixed toner image on a recording material;

(b) a mounting portion configured to selectively mount one of a plurality of detachably mountable fixing portions;

(c) a fixing portion, of the plurality of detachably mountable fixing portions, mounted in said mounting portion so as to be replaceable with another fixing portion, of the plurality of detachably mountable fixing portions, each of said fixing portions including:

(i) a first rotatable member;

(ii) a second rotatable member that cooperates with said first rotatable member to form a nip for fixing the unfixed toner image on the recording material fed from said image forming station;

(iii) a rubbing rotatable member configured to rub a surface of said first rotatable member during a rubbing treatment; and (iv) a storing portion capable of storing information;

(d) a counter configured to count a number corresponding to a number of the recording materials fed to said mounted fixing portion;

(e) a writing portion configured to write number information indicative of the number of recording materials fed to said mounted fixing portion in said storing portion of said mounted fixing portion; and (f) a controlling portion configured to acquire the number information stored in said storing portion of said mounted fixing portion, to determine whether to execute the rubbing treatment of said rubbing rotatable member to said first rotatable member of said mounted fixing portion, and to execute the rubbing treatment depending on the determination, wherein, in a case in which, in sequence, (1) the recording material is fed to said mounted fixing portion, (2) said mounted fixing portion is removed from said mounting portion and is replaced with said another fixing portion, and (3) said removed fixing portion is remounted to said mounting portion, said controlling portion determines whether to execute the rubbing treatment on the basis of both the number information acquired from said storing portion of said remounted fixing portion and the number of recording materials fed to said remounted fixing portion counted by said counter.

2. An apparatus according to claim 1, wherein said counter resets the number information stored in said storing portion of said mounted fixing portion in response to execution of the rubbing treatment by said controlling portion.

3. An apparatus according to claim 1, further comprising a receiving portion configured to receive an instruction of a size of the recording material to be fed to said mounted fixing portion, wherein said counter counts the number of the recording materials fed to said mounted fixing portion for each size of the recording material measured in a direction perpendicular to a feeding direction of the recording material, the size being acquired from the instruction received by said receiving portion, wherein said storing portion stores the number of recording materials fed to said mounted fixing portion for each of a plurality of sizes, and wherein said controlling portion executes the rubbing treatment when the number of the recording materials fed to said mounted fixing portion of any one of the plurality of sizes exceeds a predetermined number.

4. An apparatus according to claim 1, wherein, when the number of recording materials fed to said mounted fixing portion upon completion of an image forming process for forming the image on the recording material exceeds a predetermined number, said controlling portion executes the rubbing treatment, and then places said apparatus in a stand-by mode.

5. An apparatus according to claim 1, wherein, when a number of recording materials fed to said mounted fixing portion upon completion of an image forming process for forming the image on the recording material is a first number, which is greater than a predetermined number, said controlling portion executes the rubbing treatment for a first time period, and then places said apparatus in a stand-by mode, and wherein, when the number of recording materials fed to said mounted fixing portion upon completion of an image forming process for forming the image on the recording material is a second number, which is greater than the first number, said controlling portion executes the rubbing treatment for a second time period, which is longer than the first time period, and then places said apparatus in a stand-by mode.

6. An image forming apparatus comprising:

(a) an image forming station configured to form an unfixed toner image on a recording material;

(b) a mounting portion configured to selectively mount one of a plurality of detachably mountable fixing portions;

(c) a fixing portion, of the plurality of detachably mountable fixing portions, mounted in said mounting portion so as to be replaceable with another fixing portion, of the plurality of detachably mountable fixing portions, each of said fixing portions including:

(i) a first rotatable member;

(ii) a second rotatable member that cooperates with said first rotatable member to form a nip for fixing the unfixed toner image on the recording material fed from said image forming station;

(iii) a discrimination portion indicative of identifying information for discriminating said mounted fixing portion from the other fixing portion mountable on said mounting portion in place of said mounted fixing portion;

(iv) a rubbing rotatable member configured to rub a surface of said first rotatable member during a rubbing treatment; and (v) a fixing portion storing portion capable of storing number information;

(d) a counter configured to count a number corresponding to a number of the recording materials fed to said mounted fixing portion;

(e) a main assembly storing portion capable of storing information;

(f) a writing portion configured to write number information indicative of the number counted by said counter in said main assembly storing portion in correlation with the identifying information, and to write the number information stored in said fixing portion storing portion; and (g) an executing portion configured to execute the rubbing treatment of said rubbing rotatable member to said first rotatable member of said mounted fixing portion, when the number counted by said counter on the basis of the information acquired from said fixing portion storing portion and said main assembly storing portion exceeds a predetermined number.

7. An apparatus according to claim 6, further comprising an output portion configured to output time information, wherein said writing portion writes the number information in correlation with the identifying information and the time information in said main assembly storing portion and writes the number information in correlation with the time information in said fixing portion storing portion of said mounted fixing portion, and wherein said counter counts the recording materials fed to said mounted fixing portion, on the basis of the later number information of the number information stored in said fixing portion storing portion of said mounted fixing portion, and the number information stored in said main assembly storing portion in correlation with the identifying information of said mounted fixing portion.

8. An apparatus according to claim 6, wherein said fixing portion storing portion stores a number-of-times information indicative of a cumulative number of times of the writing performed by said writing portion, wherein said writing portion writes the number information in said fixing portion storing portion, renews the number-of-times information stored in said fixing portion storing portion, and writes the renewed number-of-times information in said main assembly storing portion in correlation with the number information and the identifying information, and wherein said counter counts the recording materials fed to said mounted fixing portion, on the basis of the larger number information of the number information stored in said fixing portion storing portion of said mounted fixing portion and the number information stored in said main assembly storing portion in correlation with the identifying information of said mounted fixing portion.

9. An apparatus according to claim 6, wherein said mounted fixing portion is mountable in another image forming apparatus having a counter which counts a number corresponding to a number of the recording materials fed to said fixing portion mounted therein, and renews the number indicated by the number information of said fixing portion storing portion in response to the counting, and wherein, when the number information of said fixing portion storing portion of said fixing portion has been renewed by the other image forming apparatus, and said fixing portion has been remounted in said image forming apparatus, said executing portion executes the rubbing treatment of said rubbing rotatable member to said first rotatable member of said mounted fixing portion when the number counted by said counter on the basis of the renewed number information stored in said fixing portion storing portion exceeds the predetermined number.

10. An apparatus according to claim 6, wherein, when the number counted by said counter exceeds the predetermined number upon completion of an image forming process for forming the image on the recording material, said executing portion executes the rubbing treatment and then places said apparatus in a stand-by mode.

11. An apparatus according to claim 6, wherein, when the number counted by said counter upon completion of an image forming process for forming the image on the recording material is a first number, which is greater than the predetermined number, said executing portion executes the rubbing treatment for a first time period, and then places said apparatus in a stand-by mode, and wherein, when the number counted by said counter upon completion of an image forming process for forming the image on the recording material is a second number, which is greater than the first number, said executing portion executes the rubbing treatment for a second time period which is longer than the first time period, and then places said apparatus in a stand-by mode.

12. An image forming apparatus comprising:

(a) an image forming station configured to form an unfixed toner image on a recording material;

(b) a mounting portion configured to selectively mount one of a plurality of detachably mountable fixing portions;

(c) a fixing portion, of the plurality of detachably mountable fixing portions, mounted in said mounting portion so as to be replaceable with another fixing portion, of the plurality of detachably mountable fixing portions, each of said fixing portions including:

(i) a first rotatable member;

(ii) a second rotatable member that cooperates with said first rotatable member to form a nip for fixing the unfixed toner image on the recording material fed from said image forming station;

(iii) a discrimination portion indicative of identifying information for discriminating said mounted fixing portion from said another fixing portion;

(iv) a rubbing rotatable member configured to rub a surface of said first rotatable member during a rubbing treatment; and (v) a fixing portion storing portion capable of storing information;

(d) a counter configured to count a number corresponding to a number of the recording materials fed to said mounted fixing portion;

(e) a main assembly storing portion capable of storing information;

(f) a writing portion configured to write number information indicative of a number of recording materials fed to said mounted fixing portion in said main assembly storing portion in correlation with the identifying information and to write the number information in said fixing portion storing portion; and (g) a controlling portion configured to determine whether to execute the rubbing treatment of said rubbing rotatable member to said first rotatable member of said mounted fixing portion, wherein, in a case in which, in sequence, (1) the recording material is fed to said mounted fixing portion, (2) said mounted fixing portion is removed from said mounting portion and is replaced with said another fixing portion, and (3) said removed fixing portion is remounted to said mounting portion, said controlling portion determines whether to execute the rubbing treatment on the basis of the number information acquired from said fixing portion storing portion of said remounted fixing portion, the number information stored in said main assembly storing portion in correlation with the identifying information of said remounted fixing portion, and the number of recording materials fed to said remounted fixing portion counted by said counter.

13. An apparatus according to claim 12, further comprising an output portion configured to output time information, wherein said writing portion writes the number information in correlation with the identifying information and the time information in said main assembly storing portion, and writes the number information in correlation with the time information in said fixing portion storing portion, and wherein, when said controlling portion determines, on the basis of the later number information of the number information stored in said fixing portion storing portion of the mounted fixing portion and the number information stored in said main assembly storing portion in correlation with the identifying information of said mounted fixing portion, that a number of recording materials fed to said mounted fixing portion exceeds a predetermined number, said controlling portion executes the rubbing treatment.

14. An apparatus according to claim 12, wherein said fixing portion storing portion stores a number-of-times information indicative of a cumulative number of times of the writing by said writing portion, wherein said writing portion writes the number information in said fixing portion storing portion, renews the number-of-times information stored in said fixing portion storing portion, and writes the renewed number-of-times information in said main assembly storing portion in correlation with the number information and the identifying information, and wherein, when said controlling portion determines, on the basis of the later number information of the number information stored in said fixing portion storing portion of said mounted fixing portion and the number information stored in said main assembly storing portion in correlation with the identifying information of said mounted fixing portion, that a number of recording materials fed to said mounted fixing portion exceeds a predetermined number, said controlling portion executes the rubbing treatment.

15. An apparatus according to claim 12, wherein said mounted fixing portion is mountable in another image forming apparatus having a counter which counts a number corresponding to a number of the recording materials fed to said fixing portion mounted therein, and renews the number indicated by the number information of said fixing portion storing portion in response to the counting, and wherein, when the number information of said fixing portion storing portion of said mounted fixing portion has been renewed by the other image forming apparatus, said controlling portion executes the rubbing treatment of said rubbing rotatable member to said first rotatable member of said mounted fixing portion when the number counted by said counter on the basis of the renewed number information stored in said storing portion fixing device storing portion exceeds a predetermined number.

16. An apparatus according to claim 12, further comprising a receiving portion configured to receive an instruction of a size of the recording material to be fed to said mounted fixing portion, wherein said counter counts the number of the recording materials fed to said mounted fixing portion for each size of the recording material measured in a direction perpendicular to a feeding direction of the recording material, the size being acquired from the instruction received by said receiving portion, wherein said writing portion writes the number information in said main assembly storing portion, for each of a plurality of width sizes, and writes the number information on said fixing portion storing portion for each of the plurality width sizes, and wherein said controlling portion executes the rubbing treatment when any one of numbers for the sizes exceeds a predetermined number.

17. An apparatus according to claim 12, wherein, when a number of recording materials fed to said fixing portion upon completion of an image forming process for forming the image on the recording material exceeds a predetermined number, said controlling portion executes the rubbing treatment and then places said apparatus in a stand-by mode.

18. An apparatus according to claim 12, wherein, when a number of recording materials fed to said fixing portion upon completion of an image forming process for forming the image on the recording material is a first number, which is greater than a predetermined number, said controlling portion executes the rubbing treatment for a first time period, and then places said apparatus in a stand-by mode, and wherein, when the number of recording materials fed to said fixing portion upon completion of an image forming process for forming the image on the recording material is a second number, which is greater than the first number, said controlling portion executes the rubbing treatment for a second time period, which is longer than the first time period, and then places said apparatus in a stand-by mode.

19. An image forming apparatus comprising:

(A) an image forming station configured to form an unfixed toner image on a recording material, (B) a mounting portion; and (C) a fixing portion mounted in said mounting portion, said fixing portion being replaceable with another fixing portion that is mountable to said mounting portion, said mounted fixing portion including:

(a) a first rotatable member;

(b) a second rotatable member that cooperates with said first rotatable member to form a nip for fixing the unfixed toner image on the recording material fed from said image forming station, (c) a rubbing rotatable member configured to rub a surface of said first rotatable member during a rubbing treatment;

(d) a storing portion capable of storing number information, (e) a counter configured to count a number corresponding to a number of recording materials fed to said mounted fixing portion;

(f) a writing portion configured to write, as the number information, information indicative of a number of recording materials fed to said mounted fixing portion into said storing portion of said mounted fixing portion on the basis of the number counted by said counter; and (g) a controlling portion configured to execute the rubbing treatment, wherein, in a case that the recording material is fed to said mounted fixing portion and the number information is written into said storing portion of said mounted fixing portion by said writing portion, and, thereafter, said mounted fixing portion is replaced with another fixing portion, and subsequently said removed fixing portion is remounted to said mounting portion, said controlling portion acquires the latest number information from said storing portion of the remounted fixing portion, and wherein, in a case that the recording material is subsequently fed to said remounted fixing portion, said controlling portion executes the rubbing treatment when the number counted by said counter on the basis of the acquired number information exceeds a predetermined number.

20. An apparatus according to claim 19, wherein said counter resets the number information stored in said storing portion of said mounted fixing portion in response to execution of the rubbing treatment by said controlling portion.

21. An apparatus according to claim 19, further comprising a receiving portion configured to receive an instruction of a size of the recording material to be fed to said mounted fixing portion, wherein said counter counts the number corresponding to the number of the recording materials fed to said mounted fixing portion for each size of the recording material measured in a direction perpendicular to a feeding direction of the recording material, the size being acquired from the instruction received by said receiving portion, wherein said storing portion stores the number of recording materials fed to said fixing portion for each of the sizes, and wherein said controlling portion executes the rubbing treatment when any one of numbers for the sizes exceeds a predetermined number.

22. An image forming apparatus comprising:

(A) an image forming station configured to form an unfixed toner image on a recording material, (B) a mounting portion; and (C) a fixing portion mounted in said mounting portion, said fixing portion being replaceable with another fixing portion which is mountable to said mounting portion, said mounted fixing portion including:

(a) a first rotatable member;

(b) a second rotatable member that cooperates with said first rotatable member to form a nip for fixing the unfixed toner image on the recording material fed from said image forming station, (c) a rubbing rotatable member configured to rub a surface of said first rotatable member during a rubbing treatment;

(d) a storing portion capable of storing number information, (e) a counter configured to count a number corresponding to a number of recording materials fed to said mounted fixing portion;

(f) a writing portion configured to write, as the number information, information indicative of a number of recording materials fed to said mounted fixing portion into said storing portion of said mounted fixing portion on the basis of the number counted by said counter; and (g) a controlling portion configured to execute the rubbing treatment, wherein, in a case that the recording material is fed to said mounted fixing portion and the number information is written into said storing portion of said mounted fixing portion by said writing portion, and thereafter, said mounted fixing portion is replaced with said another fixing portion, and subsequently said removed fixing portion is remounted to said mounting portion, said controlling portion acquires the latest number information from said storing portion of the remounted fixing portion, and wherein, in a case that the recording material is subsequently fed to said remounted fixing portion, said controlling portion executes the rubbing treatment when the number of the recording materials fed to the remounted fixing portion on the basis of the number counted by said counter and the acquired number information exceeds a predetermined number.

23. An apparatus according to claim 22, wherein said counter resets the number information stored in said storing portion of said mounted fixing portion in response to execution of the rubbing treatment by said controlling portion.

24. An apparatus according to claim 22, further comprising a receiving portion configured to receive an instruction of a size of the recording material to be fed to said mounted fixing portion, wherein said counter counts the number corresponding to the number of the recording materials fed to said mounted fixing portion for each size of the recording material measured in a direction perpendicular to a feeding direction of the recording material, the size being acquired from the instruction received by said receiving portion, wherein said storing portion stores the number of recording materials fed to said fixing portion for each of the sizes, and wherein said controlling portion executes the rubbing treatment when any one of numbers for the sizes exceeds a predetermined number.

25. An image forming apparatus comprising:

(A) an image forming station configured to form an unfixed toner image on a recording material, (B) a mounting portion; and (C) a fixing portion mounted in said mounting portion, said fixing portion being replaceable with another fixing portion which is mountable to said mounting portion, said mounted fixing portion including:

(a) a first rotatable member;

(b) a second rotatable member that cooperates with said first rotatable member to form a nip for fixing the unfixed toner image on the recording material fed from said image forming station, (c) a rubbing rotatable member configured to rub a surface of said first rotatable member during a rubbing treatment;

(d) a storing portion capable of storing number information;

(e) a counting portion configured to count a number corresponding to a number of recording materials fed to said mounted fixing portion and to write, as the number information, information indicative of a number of recording materials fed to said mounted fixing portion into said storing portion of said mounted fixing portion; and (f) a controlling portion configured to execute the rubbing treatment, wherein, in a case that the recording material is fed to said mounted fixing portion and the number information is written into said storing portion of said mounted fixing portion by said counting portion, and thereafter, said mounted fixing portion is replaced with said another fixing portion, and subsequently said removed fixing portion is remounted to said mounting portion, said controlling portion acquires the latest number information from said storing portion of the remounted fixing portion, and wherein, in a case that the recording material is subsequently fed to said remounted fixing portion, said controlling portion executes the rubbing treatment when the number counted by said counter on the basis of the acquired number information exceeds a predetermined number.

26. An apparatus according to claim 25, wherein said counting portion resets the number information stored in said storing portion of said mounted fixing portion in response to execution of the rubbing treatment by said controlling portion.

27. An apparatus according to claim 25, further comprising a receiving portion configured to receive an instruction of a size of the recording material to be fed to said mounted fixing portion, wherein said counting portion counts the number corresponding to the number of the recording materials fed to said mounted fixing portion for each size of the recording material measured in a direction perpendicular to a feeding direction of the recording material, the size being acquired from the instruction received by said receiving portion, wherein said storing portion stores the number of recording materials fed to said fixing portion for each of the sizes, and wherein said controlling portion executes the rubbing treatment when any one of numbers for the sizes exceeds a predetermined number.

28. An image forming apparatus comprising:

(A) an image forming station configured to form an unfixed toner image on a recording material, (B) a mounting portion; and (C) a fixing portion mounted in said mounting portion, said fixing portion being replaceable with another fixing portion which is mountable to said mounting portion, said mounted fixing portion including:

(a) a first rotatable member;

(b) a second rotatable member that cooperates with said first rotatable member to form a nip for fixing the unfixed toner image on the recording material fed from said image forming station, (c) a rubbing rotatable member configured to rub a surface of said first rotatable member during a rubbing treatment;

(d) a discrimination portion indicative of identifying information for discriminating said mounted fixing portion from said another fixing portion; and (e) a fixing portion storing portion capable of storing information;

(f) a counter configured to count a number corresponding to a number of recording materials fed to said mounted fixing portion;

(g) a main assembly storing portion capable of storing information;

(h) a writing portion configured to write number information indicative of a number of recording materials fed to said mounted fixing portion; on the basis of the number counted by said counter; into said main assembly storing portions in correlation with the identifying information of said mounted fixing portion; and to write the number information into said fixing portion fixing storing portion of said mounted fixing portion; and (i) a controlling portion configured to execute the rubbing treatment; wherein; in a case that the recording material is fed to said mounted fixing portion and the number information is written into said main assembly storing portion and said storing portion of said mounted fixing portion by said writing portion; and thereafter; said mounted fixing portion is replaced with said another fixing portion; and subsequently said removed fixing portion is remounted to said mounting portion; said controlling portion acquires the identifying information from said discrimination portion of the remounted fixing portion; and acquires the latest number information from said fixing portion storing portion; and wherein; in a case that the recording material is subsequently fed to said remounted fixing portion; said controlling portion executes the rubbing treatment when the number counted by said counter on the basis of the number information acquired from said fixing portion storing portion and the number information stored in said main assembly storing portion in correlation with the identifying information exceeds a predetermined number.

29. An apparatus according to claim 28, further comprising an output portion configured to output time information, wherein said writing portion writes the number information in correlation with the identifying information and the time information into said main assembly storing portion and writes the number information in correlation with the time information in said fixing portion storing portion, and wherein said controlling portion operates said counter on the basis of the later number information of the number information stored in said fixing portion storing portion of said mounted fixing portion and the number information stored in said main assembly storing portion in correlation with the identifying information of said mounted fixing portion, and said controlling portion executes the rubbing treatment when the number counted by said counter exceeds the predetermined number.

30. An apparatus according to claim 28, wherein said fixing portion storing portion stores a number-of-times information indicative of a cumulative number of times of the writing by said writing portion, wherein said writing portion writes the number information in said fixing portion storing portion and renews the number-of-times information stored in said fixing portion storing portion, and writes the renewed number-of-times information in said main assembly storing portion in correlation with the number information and the identifying information, and wherein, when said controlling portion operates said counter on the basis of the larger number information of the number information stored in said fixing portion storing portion of said mounted fixing portion and the number information stored in said main assembly storing portion in correlation with the identifying information of said mounted fixing portion, and said controlling portion executes the rubbing treatment when the number counted by said counter exceeds the predetermined number.

31. An apparatus according to claim 28, further comprising a receiving portion configured to receive an instruction of a size of the recording material to be fed to said mounted fixing portion, wherein said counter counts the number of the recording materials fed to said mounted fixing portion for each size of the recording material measured in a direction perpendicular to a feeding direction of the recording material, the size being acquired from the instruction received by said receiving portion, wherein said writing portion writes the number information in said main assembly storing portion, for each width size, and writes the number information on said fixing portion storing portion for each width size, and wherein said controlling portion executes the rubbing treatment when any one of numbers for the sizes exceeds the predetermined number.

32. An apparatus according to claim 28, wherein said counter resets the number information stored in said fixing portion storing portion of said mounted fixing portion and the number information stored in said main assembly storing portions in correlation with the identifying information of said mounted fixing portion, in response to execution of the rubbing treatment by said controlling portion.

* * * * *